US006910688B2

(12) United States Patent
Saito et al.

(10) Patent No.: US 6,910,688 B2
(45) Date of Patent: Jun. 28, 2005

(54) SHEET DISCHARGING APPARATUS AND IMAGE FORMING APPARATUS EQUIPPED WITH THE SAME

(75) Inventors: Takashi Saito, Yamanashi-ken (JP); Shinya Sasamoto, Nirasaki (JP)

(73) Assignee: Nisca Corporation, Yamanashi-ken (JP)

( * ) Notice: Subject to any disclaimer, the term of this patent is extended or adjusted under 35 U.S.C. 154(b) by 247 days.

(21) Appl. No.: 10/273,127

(22) Filed: Oct. 18, 2002

(65) Prior Publication Data

US 2003/0090055 A1 May 15, 2003

(30) Foreign Application Priority Data

Oct. 23, 2001 (JP) ..... 2001-324279
Oct. 23, 2001 (JP) ..... 2001-324280
Oct. 31, 2001 (JP) ..... 2001-335892

(51) Int. Cl.[7] ..... B65H 31/00
(52) U.S. Cl. ..... 271/220; 270/58.12
(58) Field of Search ..... 271/220, 221, 271/223, 234, 236, 241, 251; 270/58.12, 58.08, 58.09

(56) References Cited

U.S. PATENT DOCUMENTS 5,020,785 A * 6/1991 Kosaka et al. ..... 270/58.11
5,120,047 A * 6/1992 Mandel et al. ..... 271/220
5,320,336 A * 6/1994 Asami ..... 270/58.08
6,142,466 A * 11/2000 Dickhoff ..... 271/220
6,311,971 B1 * 11/2001 Greer et al. ..... 271/220
6,412,774 B1 * 7/2002 Saito et al. ..... 271/220
6,550,758 B2 * 4/2003 Ardery et al. ..... 270/58.12
6,561,504 B2 * 5/2003 Mlejnek et al. ..... 270/58.12
2003/0006543 A1 * 1/2003 Tamura et al. ..... 270/52.01

FOREIGN PATENT DOCUMENTS

JP 63-143167 6/1988
JP 05185767 A * 7/1993 ..... B42C/1/12
JP 4-77554 7/1998
JP 2000-86064 3/2000
JP 2003002513 A * 1/2003 ..... B65H/31/34

* cited by examiner

*Primary Examiner*—Patrick Mackey
(74) *Attorney, Agent, or Firm*—Manabu Kanesaka

(57) ABSTRACT

A sheet discharge apparatus includes a discharge device for discharging sheets, a storage device for receiving the sheets discharged by the discharge device, alignment reference members for aligning at least one side of the sheets discharged to the storage device, rotating bodies (belt unit) that contact the sheets at a predetermined position on the storage device to move the sheets to the alignment reference members, a support device for supporting the rotating bodies to move freely between an activating position that contacts the sheets at the predetermined position and a retracted position away from the sheets at the predetermined position, and a control device for controlling the support device to position the rotating bodies at the retracted position when the sheets reach the predetermined position before a trailing edge of the sheets in a discharge direction is discharged to the storage device by the discharge device.

16 Claims, 47 Drawing Sheets

S
8
22
65
62
160
161
162
163
67
67b
68d
69
61

SHEET DISCHARGING APPARATUS AND IMAGE FORMING APPARATUS EQUIPPED WITH THE SAME

BACKGROUND OF THE INVENTION

This invention relates to a sheet discharge apparatus that discharges sheets discharged from an image forming apparatus such as copiers, printers, facsimile machines or a combination of two or more of these, to a storage tray.

Conventionally, sheet discharge apparatuses that are mounted to image forming apparatuses, such as copiers, printers and facsimiles or a combination of two or more of these, and that form aligned sheet bundles urged toward an aligning member such as a side fence by rotating bodies such as rollers, paddles and belts for aligning each sheet fed to a storage tray from the image forming apparatus and for finishing aligned sheet bundles using staples, punching holes or by applying glue, are well known.

In these sheet discharge apparatuses, rotating bodies such as discharge rollers are arranged to discharge sheets to a storage tray. These sheet discharge apparatuses are structured to align each sheet discharged to the storage tray, and through such structure, the rotating bodies such as the rollers, paddles and belts for alignment do not hinder sheet discharge operation of the discharge means.

For example, as disclosed in FIG. 42 in Japanese Patent Publication (Tokkai) No. 02-28471, the friction roller 504 for alignment is arranged retractable from the opening 218H disposed at the reference wall 218D on the storage tray 218. This is configured so that the rotating body having the friction roller 540 aligns each sheet S1 and S2 discharged to the storage tray 218 by the discharge means having the discharge rollers 202 and 208 against the side wall 218F, allowing the rotating bodies having the friction roller 540 for alignment not to hinder the sheet discharge operation of the discharge means having composed by the discharge rollers 202 and 208.

However, in the conventional sheet discharge apparatus described above, because the rotating body for alignment (friction roller 540) is arranged to enter into the storage tray 218 under the discharge means (discharge rollers 202 and 208) that discharges the sheets to the storage tray 218, the number of sheets that can be aligned decreases, resulting in a problem of not fully utilizing the storage space of the storage tray, even though there is additional storage space remaining on the upper portion of the storage tray 218.

An object of the present invention is to provide a sheet discharge apparatus having rotating bodies for alignment and fully utilizing the storage capacity of a storage tray without hindering the discharge operation of the discharge means such as discharge rollers, and to provide an image forming apparatus equipped with the same.

SUMMARY OF THE INVENTION

The following provides a detailed description of the configuration of this invention.

A sheet discharge apparatus according to the present invention is equipped with discharge means for discharging sheets; storage means for receiving the sheets discharged by the aforementioned discharge means; a alignment reference member for aligning at least one side of the sheets discharged to the aforementioned storage tray; rotating bodies contacting the sheets at a predetermined position on the aforementioned storage means to move the sheets to the aforementioned alignment reference member; support means for supporting the aforementioned rotating bodies to freely move between an activating position contacting the sheets at the aforementioned predetermined position and a retracted position away from the sheets at the aforementioned determined position; and control means for controlling the aforementioned support means to position the aforementioned rotating bodies at the aforementioned retracted position in a case that the aforementioned sheet reaches the aforementioned predetermined position before the trailing edge of the sheets in the discharge direction is discharged to the aforementioned storage means by the aforementioned discharge means.

It is acceptable to use rollers, paddles or belts as the rotating bodies.

Furthermore, as the support means for supporting the rotating bodies to freely move between the activating position and the retracted position, for example, the rotating bodies for alignment such as rollers, paddles or belts frictionally abut to slide around the drive support shaft and normally the rotationally drive of the support shaft is transmitted to the rotating bodies. However, by applying a force greater than a predetermined force, the rotating bodies revolve relatively around the support shaft to enable their switching between the activating position and the retracted position. It is possible to employ another actuator as the drive source that applies a force greater than the predetermined force required to revolve the rotating bodies.

According to this invention, the following describes an example of "a case that the sheet reaches a predetermined position before the trailing edge of the sheets in the discharge direction is discharged to the aforementioned storage means by the aforementioned discharge means". For example, this can be (i) the sheet moves in a direction (horizontal direction) traversing the transport/discharge direction by the offset means, etc., and the edge of the sheet comes to a predetermined position (the position the rotating bodies can act to align the sheet) or (ii) the sheet edge passes over a predetermined position (the position where the rotating bodies can act to align the sheet) only through being discharged by the discharge means without the sheet being offset (moved horizontally), due to a sheet size or a discharge reference.

In the sheet discharge apparatus according to this invention, the aforementioned support means supports the aforementioned rotating bodies to freely move between an activating position contacting the sheets at the aforementioned predetermined position and the retracted position away from the sheets at the aforementioned predetermined position around a rotating pivot established above the aforementioned discharge means.

The sheet discharge apparatus according to the present invention is equipped with control means for controlling the aforementioned support means to position the aforementioned rotating bodies at the aforementioned alignment position at least until the aforementioned sheets reach the aforementioned determined position.

The sheet discharge apparatus according to the present invention is equipped with control means for controlling the aforementioned support means to hold the aforementioned rotating bodies at the aforementioned retracted position until a trailing edge of the aforementioned sheet is discharged from the aforementioned discharge means.

The sheet discharge apparatus of the present invention is equipped with offset means for offsetting a position of the sheet relative to the aforementioned rotating bodies to move the sheet discharged to the aforementioned storage means by the aforementioned discharge means to the aforementioned predetermined position.

This is an embodiment to perform the offset process that offsets the sheet position relatively in the horizontal direction. With this offset process, the sheet sweeping action by the rotating bodies for alignment works effectively until the sheet bundle on the storage means reaches beyond a fixed stacking height. However, as described above in (i), in the case that the offset means moves the sheet in a direction (horizontal direction) traversing the transport and discharge direction until the sheet edge reaches the predetermined position (the position the rotating bodies can act to align the sheet), the rotating bodies receive a force in the horizontal direction by the sheet, thereby causing shaking to the left and right and making accurate alignment impossible.

In such a case, retracting the rotating bodies to a retracted position prevents mal-alignment caused by the shaking in the horizontal direction, as described above, and thus has a special effect.

The sheet discharge apparatus according to the present invention is equipped with control means for controlling the aforementioned support means to move the aforementioned rotating bodies at least twice from the aforementioned retracted position to the aforementioned activating position when the aforementioned rotating bodies move the sheets discharged to the aforementioned storage means to the aforementioned alignment reference member. According to this invention, the rotating bodies are moved at least two times from the retracted position (the position where the rotating bodies are separated from the sheet) to the activating position (the position where the rotating bodies contact the sheet) when the rotating bodies move the sheets discharged to the storage means to the alignment reference member. In other words, the rotating bodies, such as the rollers, paddles and belts repeatedly move away from the sheets and then to contact the sheets to move the sheets to the alignment reference member. For that reason, even if the sheet is fed obliquely and hits the alignment reference member or the leading edge is curled, the restriction on the sheet is freed by the separation of the rotating bodies (moving to the retracted position), to allow the sheet leading edge to slide down under its own weight and become flat, thereby alleviating the curl. Then, subsequently, the rotating bodies move again to the activating position (the position to contact the sheet) to move the sheet again to the alignment reference member to ensure an accurate sheet alignment.

The sheet discharge apparatus of the present invention is equipped with finishing means for finishing the sheets on the aforementioned storage means after the aforementioned rotating bodies complete moving the final sheet discharged to the aforementioned storage means by the aforementioned discharge means to the aforementioned alignment reference member.

As the finishing means, there is a device for stapling aligned sheet bundles, punching therein with holes or applying glue.

The sheet discharge apparatus according to the present invention is equipped with control means for controlling the aforementioned support means to hold the aforementioned rotating bodies at the aforementioned activating position for the final sheet discharged to the aforementioned storage means until the finishing by the aforementioned finishing means is completed.

In the sheet discharge apparatus of the present invention, the aforementioned rotating bodies is set to transport the sheet over a distance exceeding a distance from the aforementioned rotating bodies to the aforementioned alignment reference member.

With this feature, because the sheet is fed by applying a force higher than a force for feeding the sheet over a distance where the edge thereof touches the alignment reference member, normally the sheets bend. Thus, by using a restoring force of the sheet, it is possible to align the edge of the sheet in parallel to the alignment reference member. Also, in a case that the sheet slips while the sheet is moving or the sheet curls, so that the feeding distance is not sufficient that the sheet edge does not reach the alignment reference member and the sheet is not aligned, it is possible to align properly by adjusting the feeding distance.

In the sheet discharge apparatus according to the present invention, the aforementioned control means variably controls the transport distance of the sheet by the aforementioned rotating bodies according to a size of the sheet. When sheets with various sizes are used or the sizes of the sheets discharged from the discharge means differ, the distance until the sheet edge touches the alignment reference member, in other words, the distances the sheet must be transported by the rotating bodies differ. With this invention, it is possible to adjust the transport distance of the sheet by the rotating bodies and perform the appropriate alignment according to the sheet size.

The sheet discharge apparatus according to the present invention is equipped with sheet bundle discharge means for discharging the sheets finished by the aforementioned finishing means from the aforementioned finishing means, and the aforementioned control means controls the aforementioned support means to hold the aforementioned rotating bodies at the aforementioned retracted position when the aforementioned sheet bundle discharge means discharges the sheets finished by the aforementioned finishing means from the aforementioned finishing means.

With this operation, it is possible to securely discharge the sheet bundles without an extra load caused by the rotating bodies touching the sheets during discharging the sheet bundles.

The sheet discharge apparatus according to the present invention is provided with control means for rotating the aforementioned rotating bodies in a direction that the sheet moves toward the alignment reference member in the process of moving the rotating bodies from the aforementioned activating position to the aforementioned retracted position. According to this invention, because the rotating bodies are rotated in the direction that the sheet moves toward the alignment reference member in the process of moving the rotating bodies from the activating position to the retracted position, even if the sheet tries to move away from the alignment reference member, the rotating bodies are rotating in the direction that the sheet moves toward the alignment reference member, thereby preventing the sheet from moving away from the alignment reference member in the process of moving the rotating bodies from the activating position to the retracted position.

The sheet discharge apparatus according to the present invention is provided with control means for rotating the aforementioned rotating bodies in the alignment direction in a retracted state in a process of storing the sheets discharged from the aforementioned discharge means to the aforementioned storage means. Therefore, when the sheet is discharged from the discharge means, the rotating bodies are rotated in the alignment direction, so even if the discharged sheets have curl, the sheet touched by the rotating bodies can smoothly enter between the rotating bodies and the storage means by the rotation of the rotating bodies.

The sheet discharge apparatus according to the present invention is provided with control means for rotating the aforementioned rotating bodies in the alignment direction in the retracted state in a process of storing the sheets discharged from the aforementioned discharge means to the aforementioned storage means, and for rotating the rotating bodies in the direction that the sheets move toward the alignment reference member in the process of moving the aforementioned rotating bodies from the activating position to the retracted position. Therefore, when the sheets are discharged from the discharge means, the rotating bodies are rotated in the alignment direction. Thus, even if the discharged sheets curl, the sheet touched by the rotating bodies can smoothly enter between the rotating bodies and the storage means by the rotation of the rotating bodies. Also, in the process of moving the rotating bodies from the activating position to the retracted position, because the rotating bodies are rotating in the direction that the sheets move toward the alignment reference member, even if the sheets are moving in the direction away from the alignment reference member, thereby preventing the sheets from moving away from the alignment reference member.

The sheet discharge apparatus according to the present invention is provided with control means for rotating the aforementioned rotating bodies in the direction that the sheets move toward the alignment reference member while the rotating bodies are moving at least from the aforementioned retracted position to the activating position, and are moving again to the aforementioned retracted position. Therefore, because the rotating bodies are constantly moving in the direction to move the sheets toward the alignment reference member, the rotating bodies can prevent the sheets from separating from the alignment reference member even if the rotating bodies are separated from the sheets.

The image forming apparatus according to the present invention is equipped with the aforementioned sheet discharge apparatus.

Figures 26A, 26B:
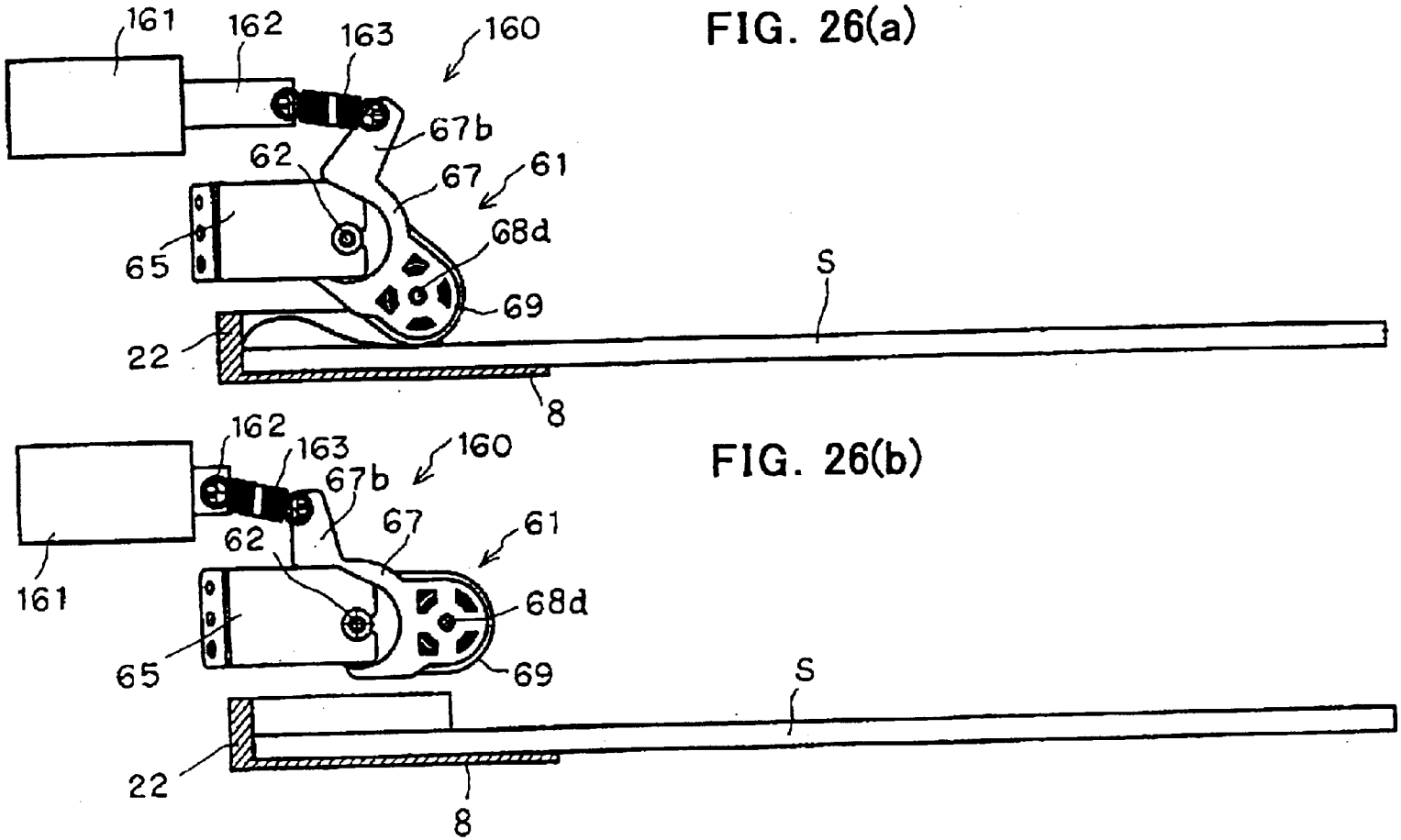
FIGS. 26(*a*) and 26(*b*) are view showing the support means of the belt unit which is the rotating body in the embodiment of the present invention, wherein FIG. 26(*a*)
Figure 27:
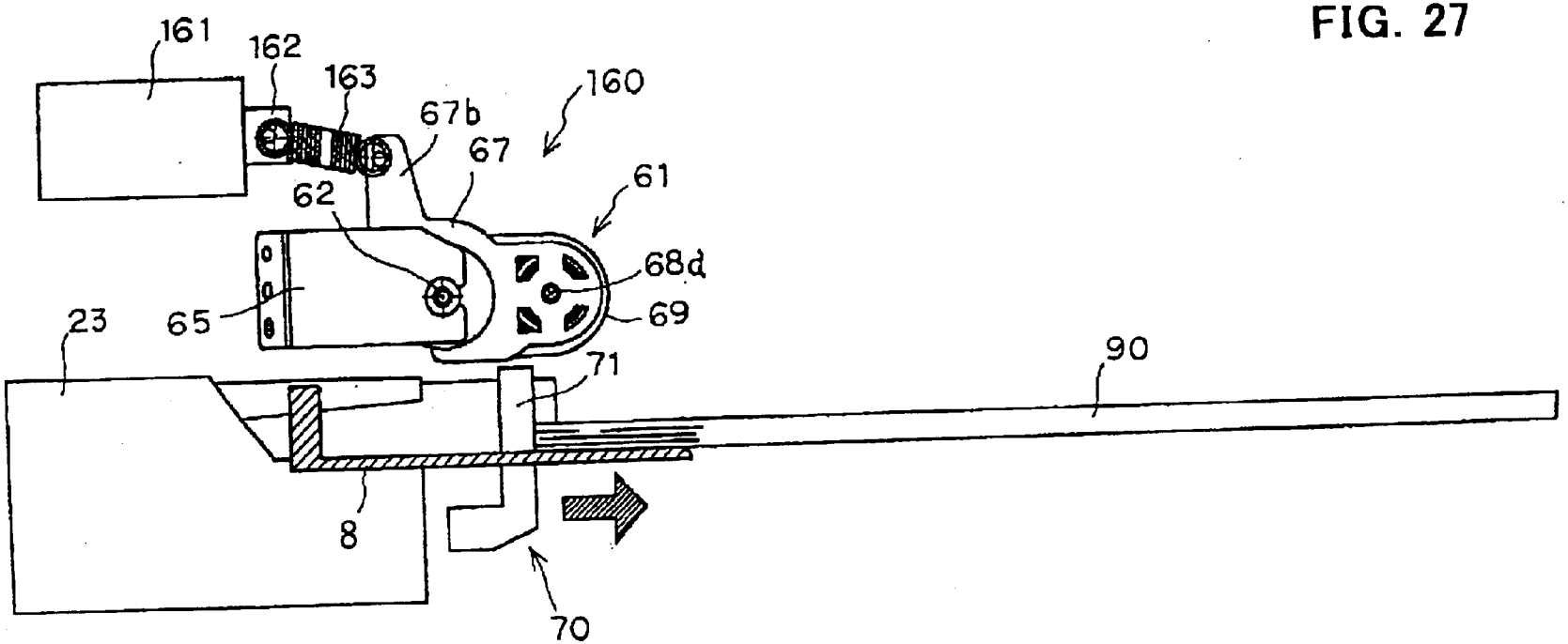
Figure 28:
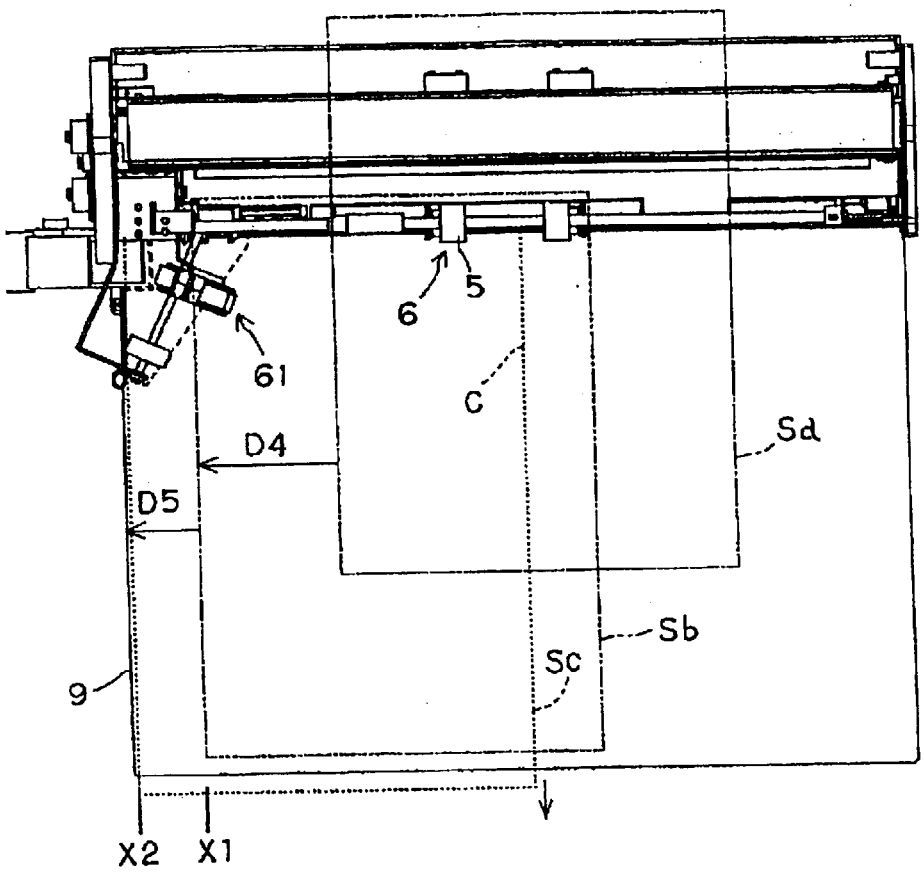
Figures 29A, 29B:
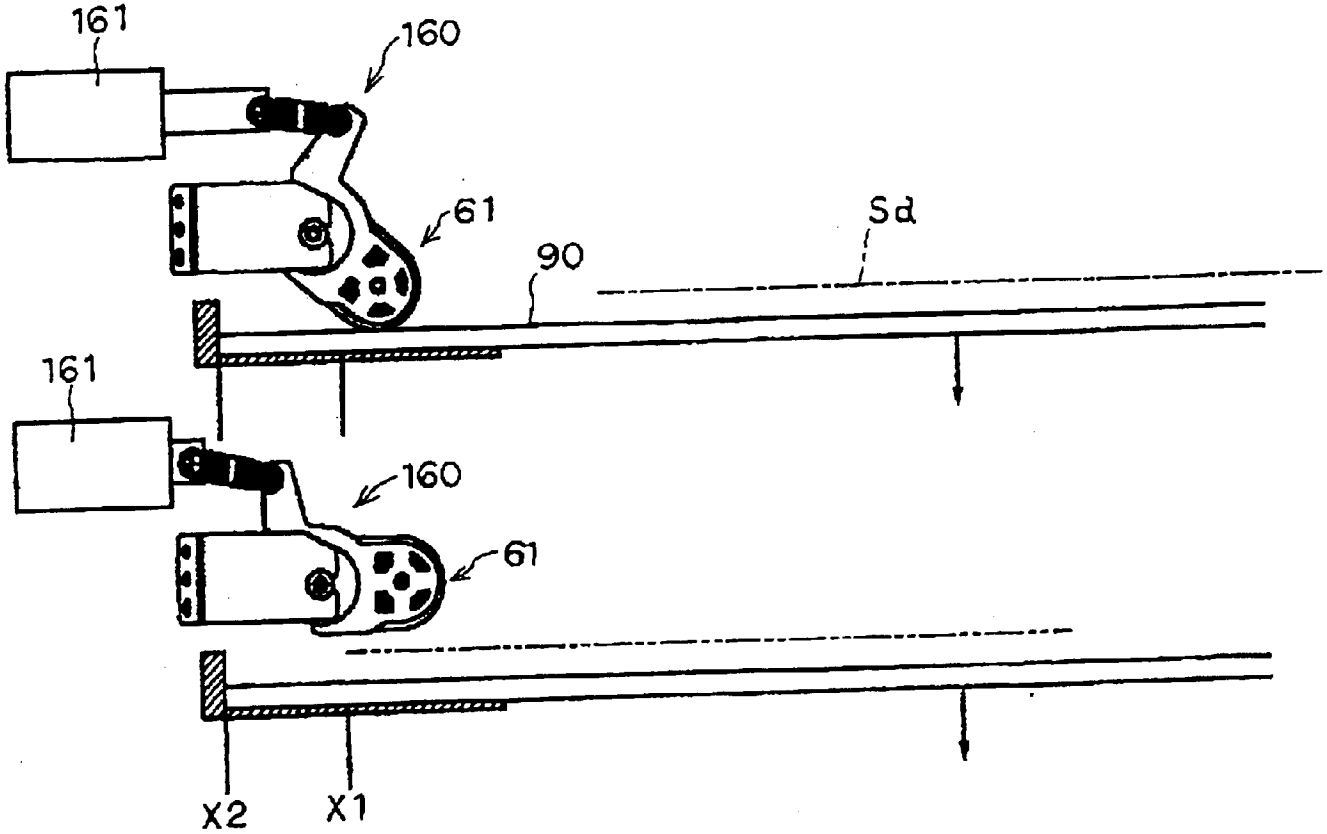
Figure 30:
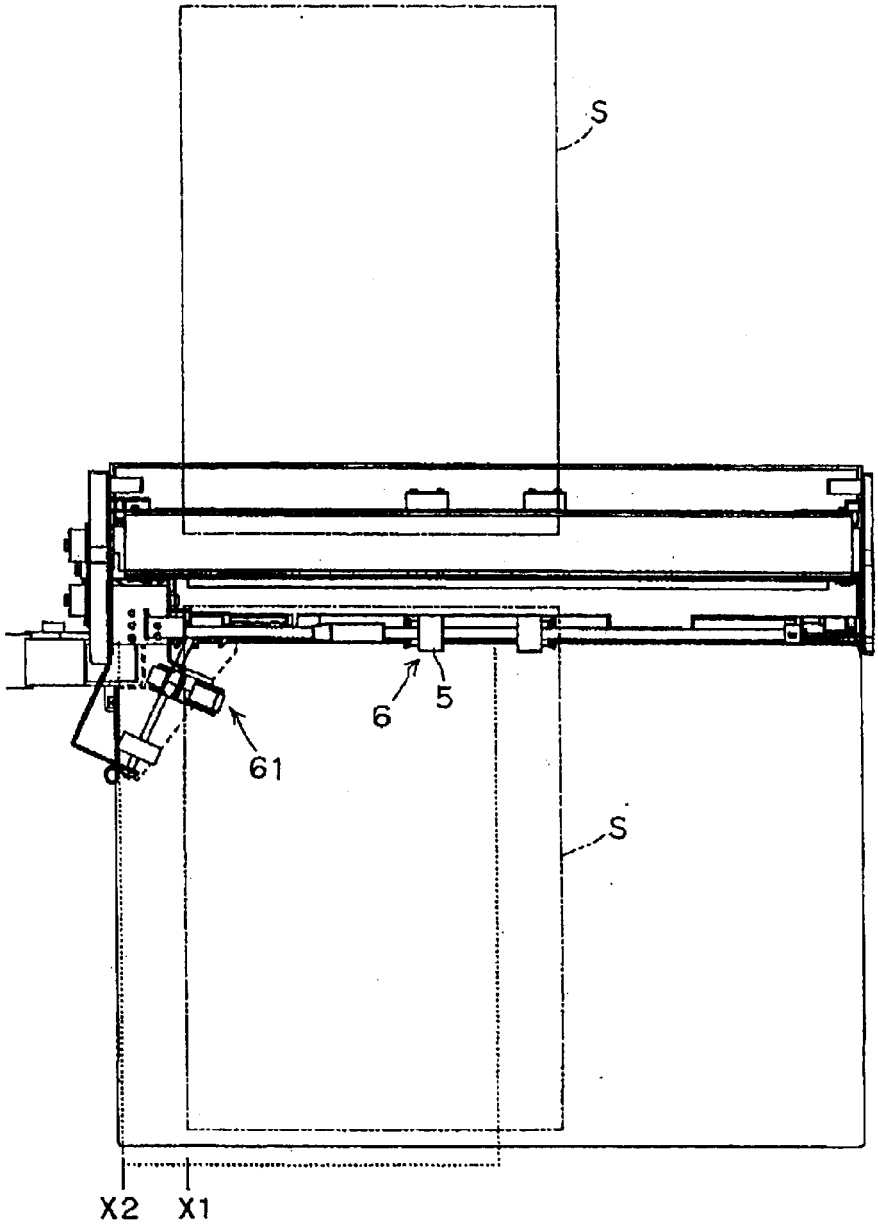
Figures 31A, 31B:
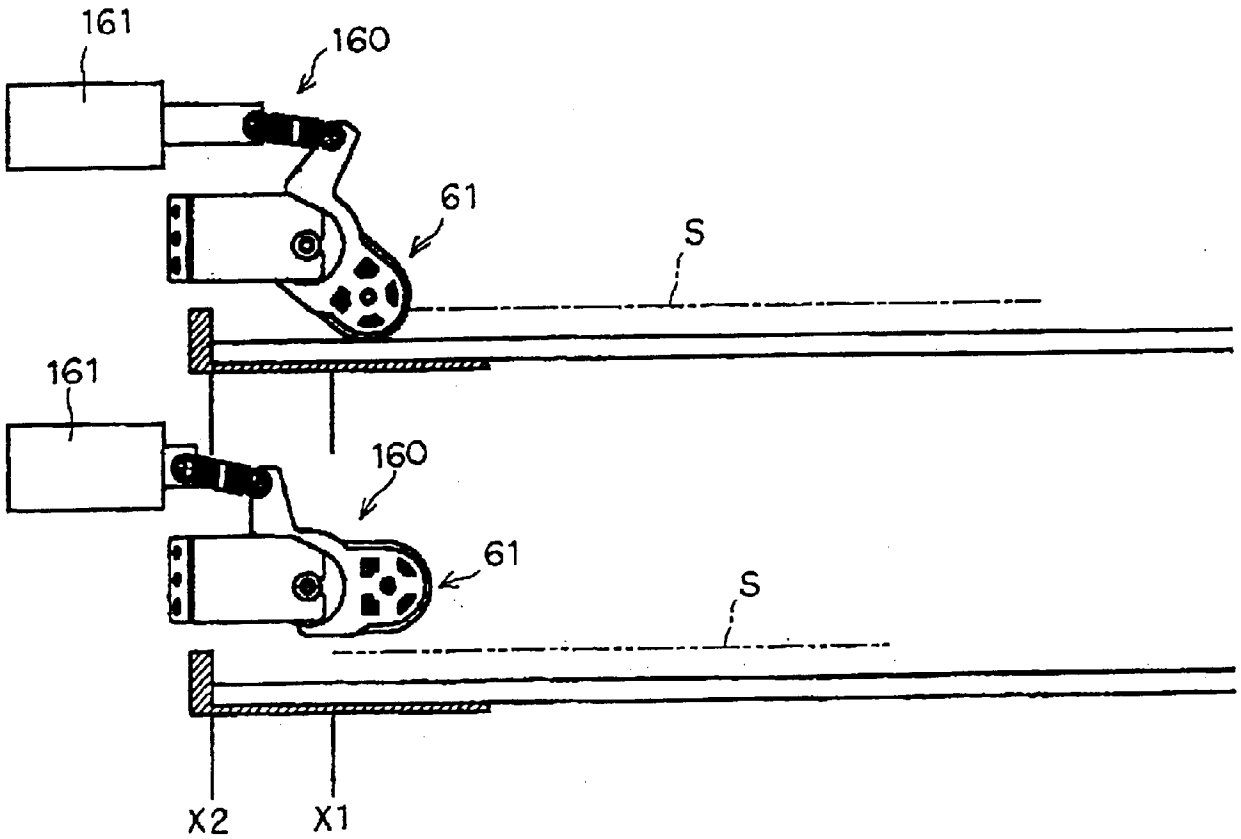
Figure 32:
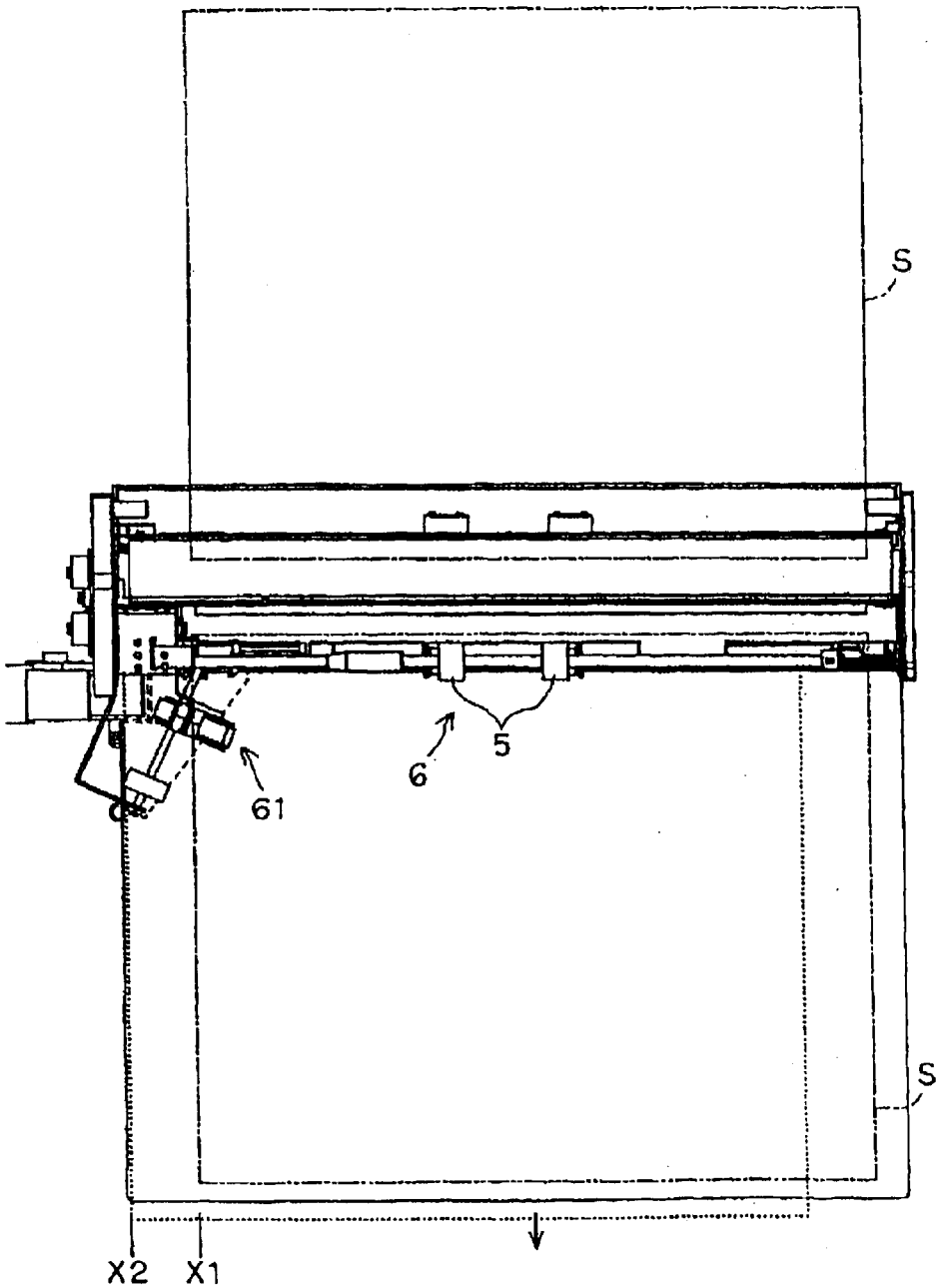
Figures 33A, 33B:
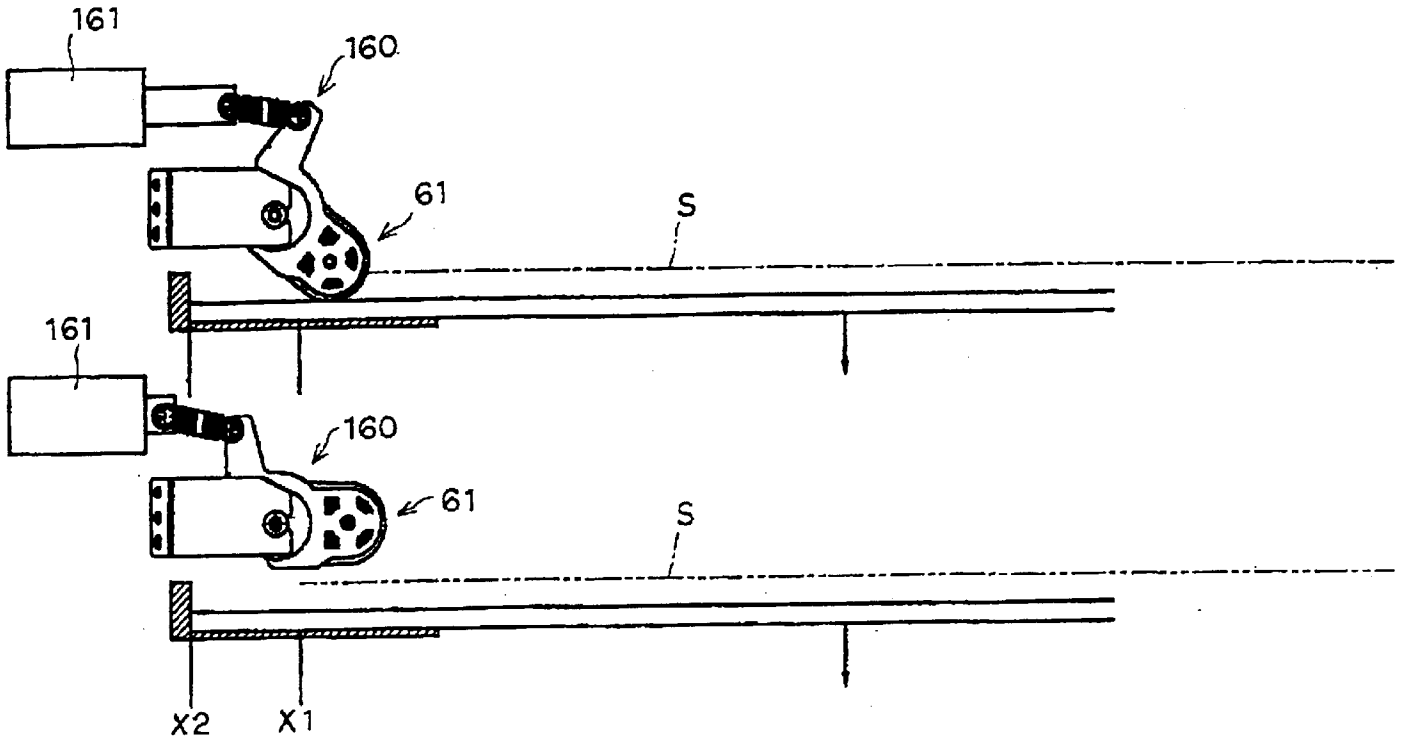
Figure 34:
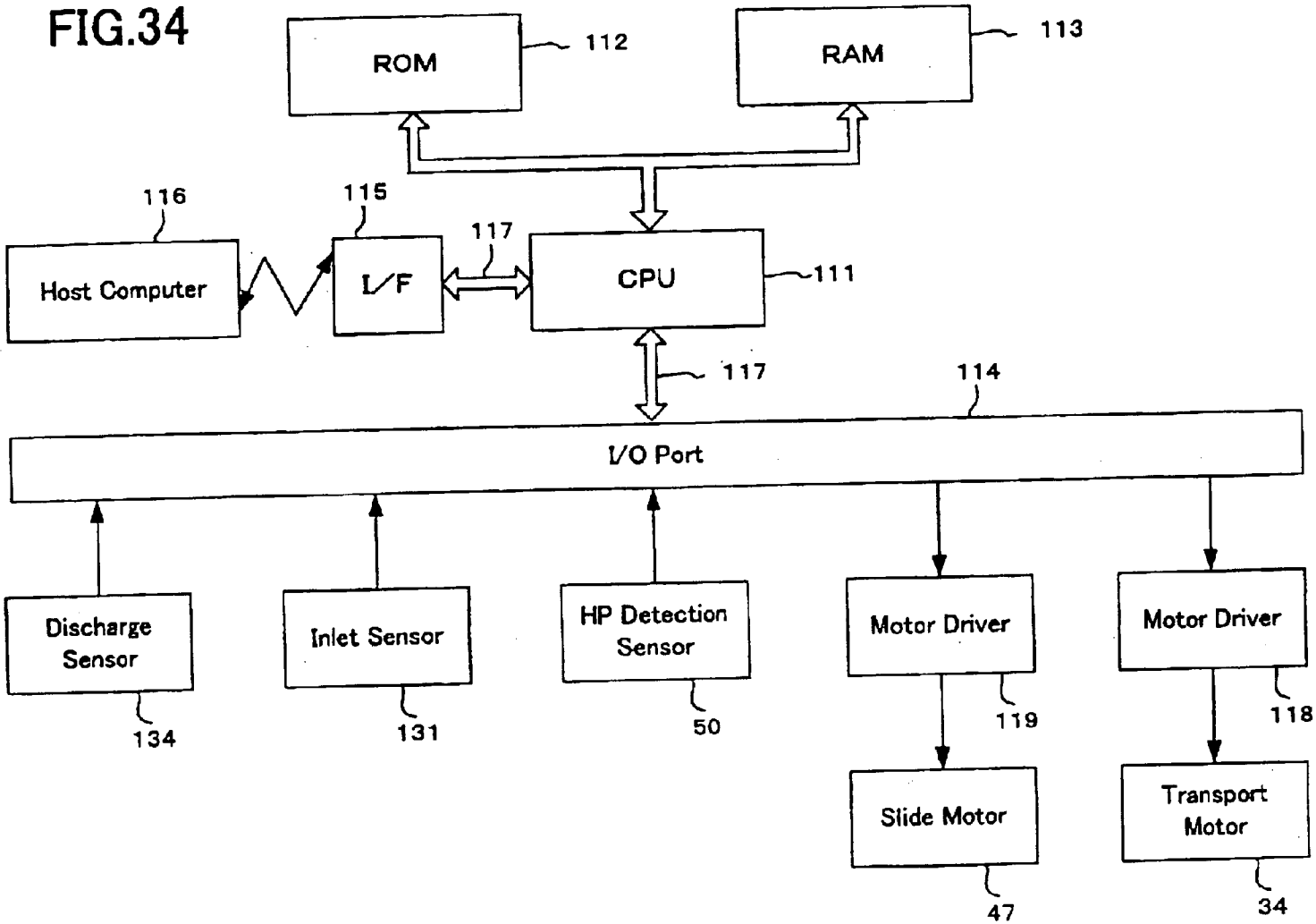
Figure 35:
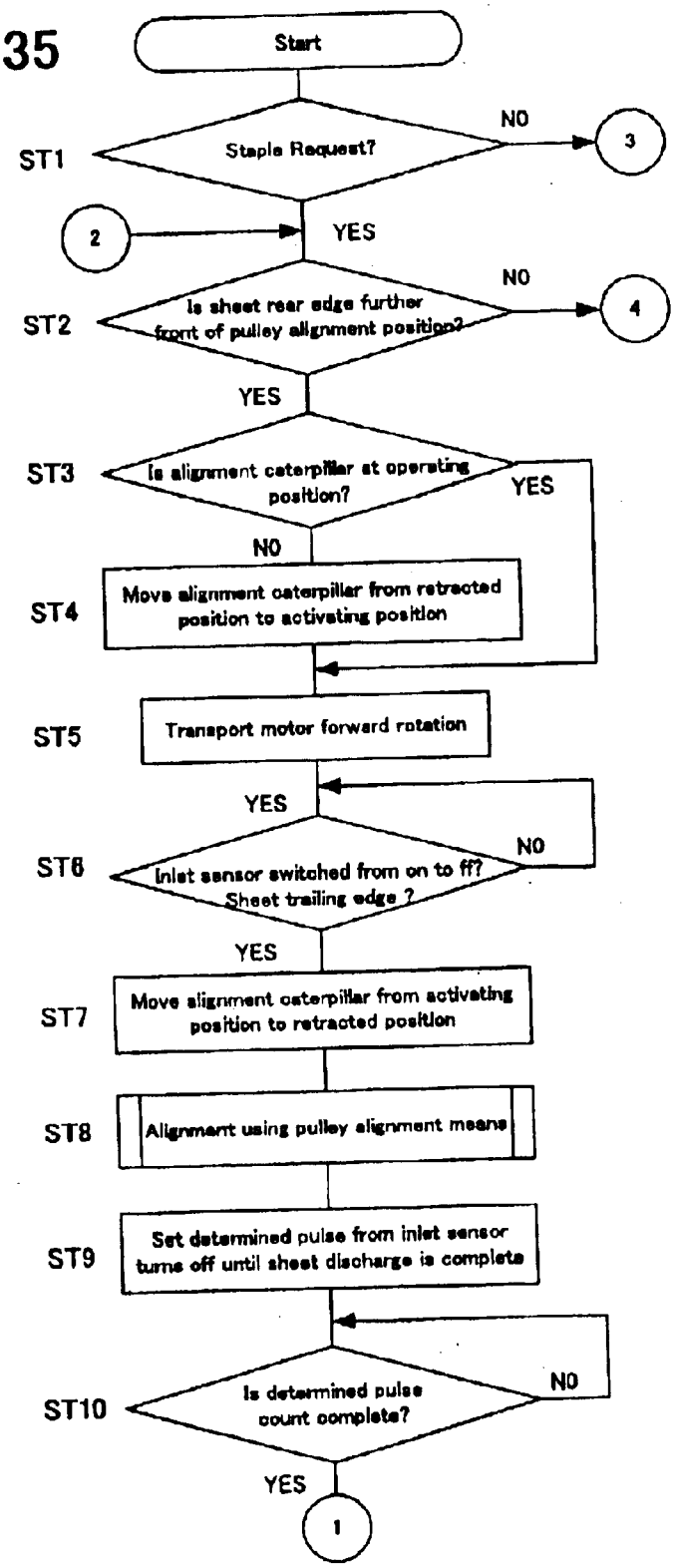
Figure 36:
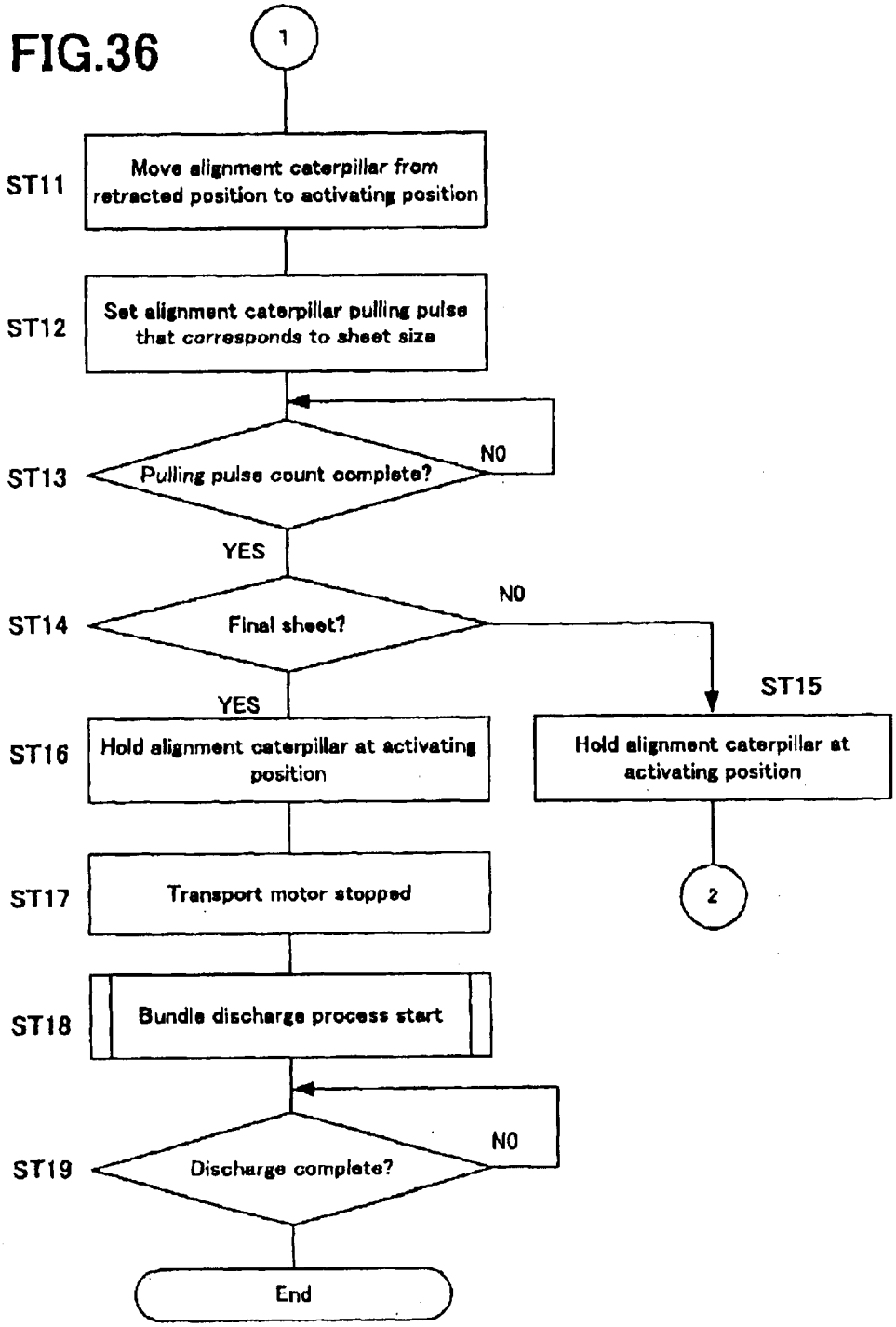
Figure 37:
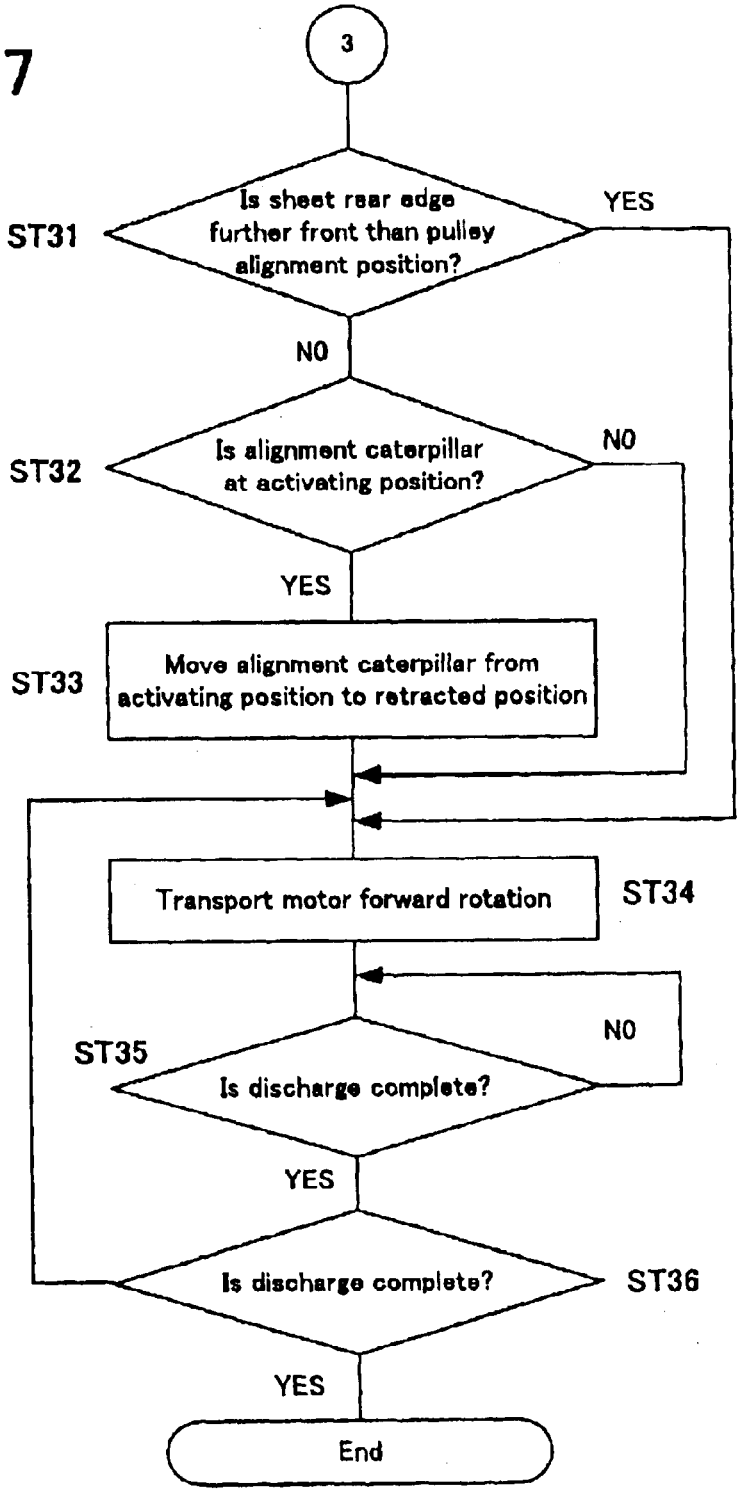
Figure 38:
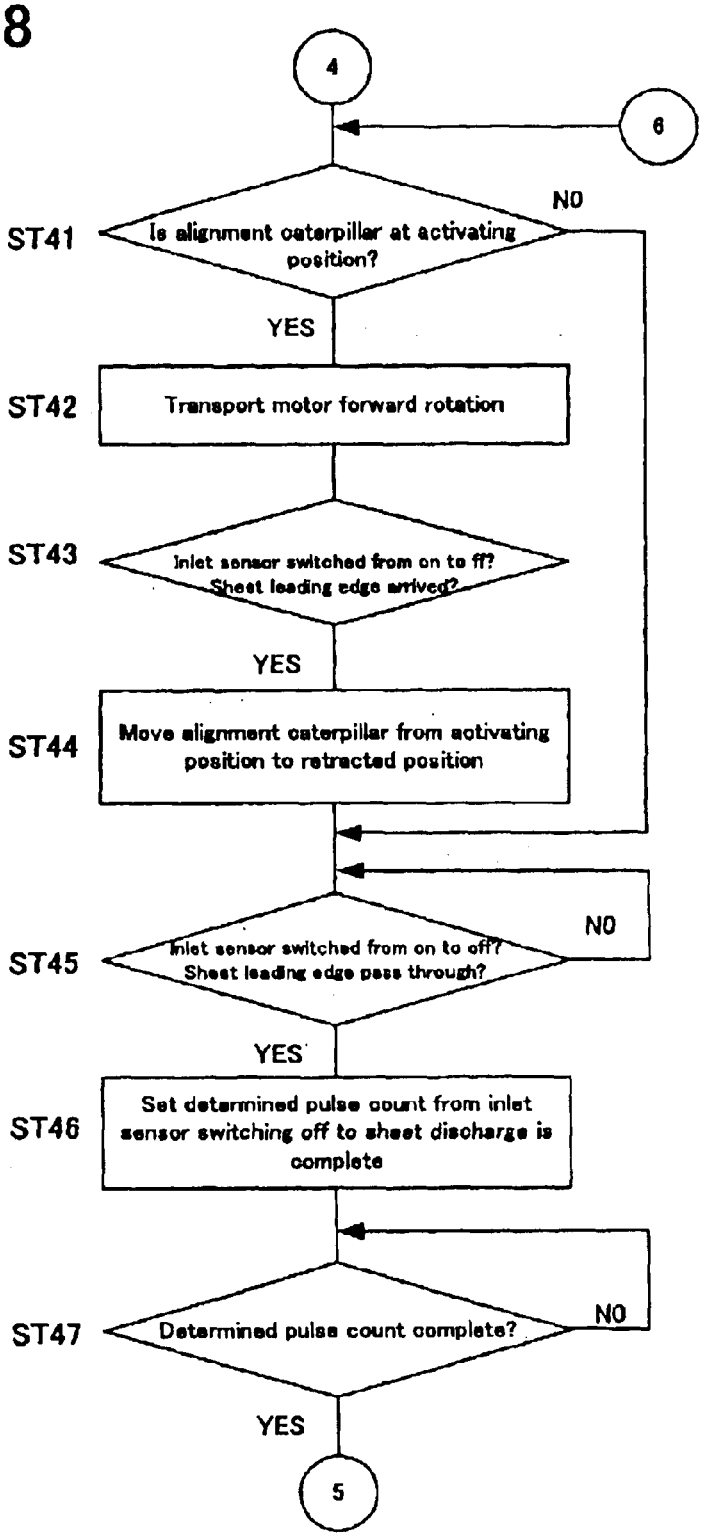
Figure 39:
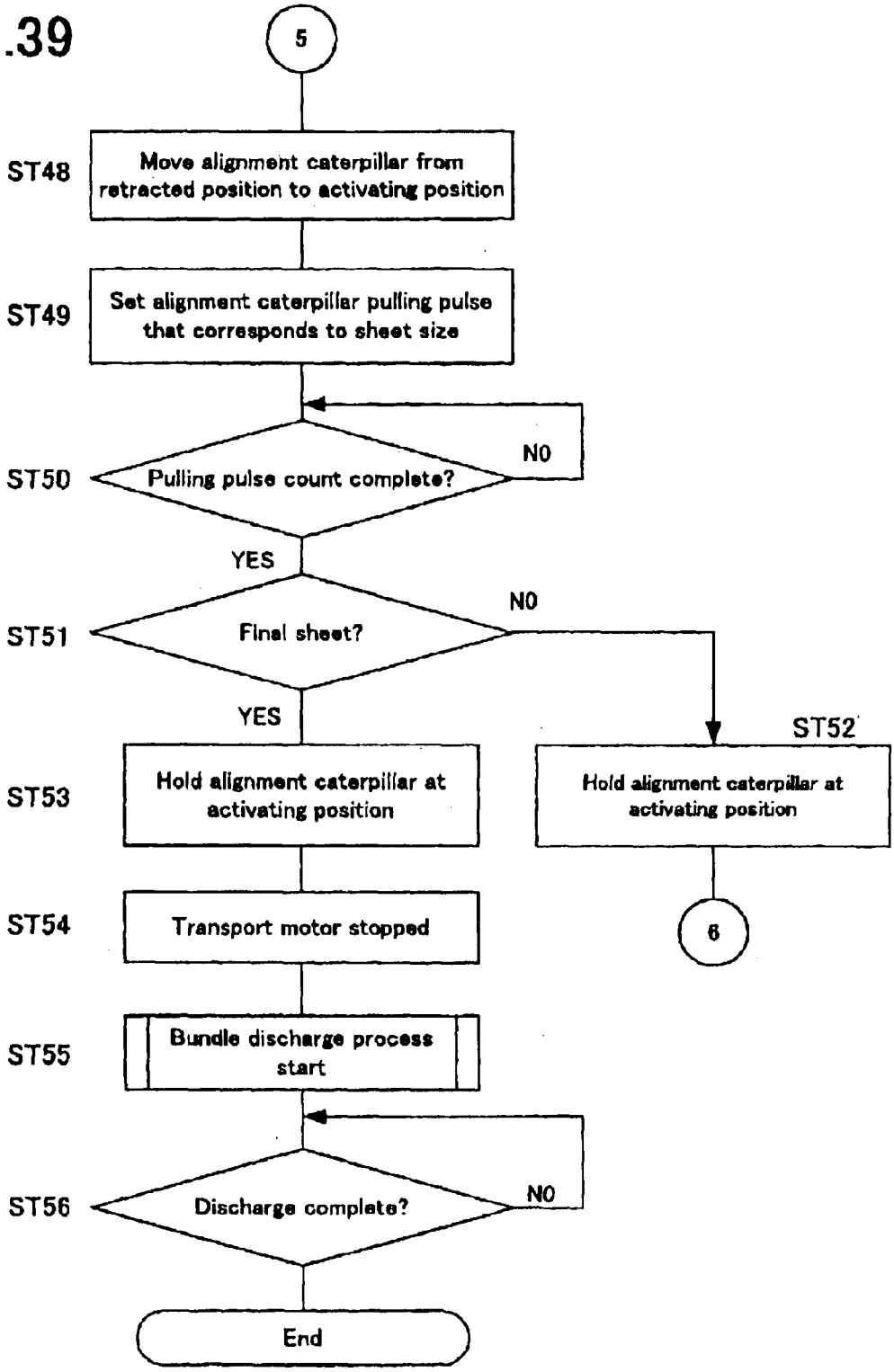
Figure 40:
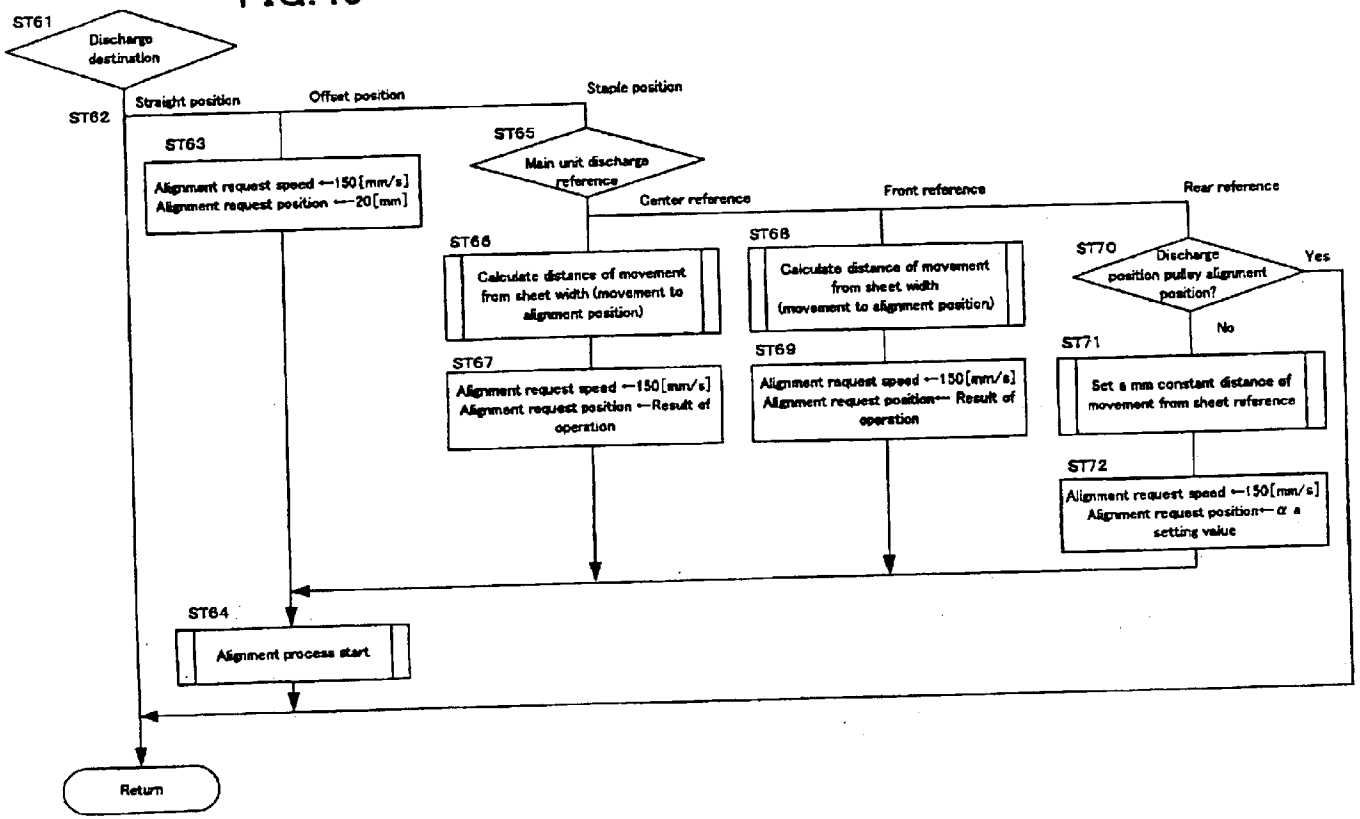
Figure 41:
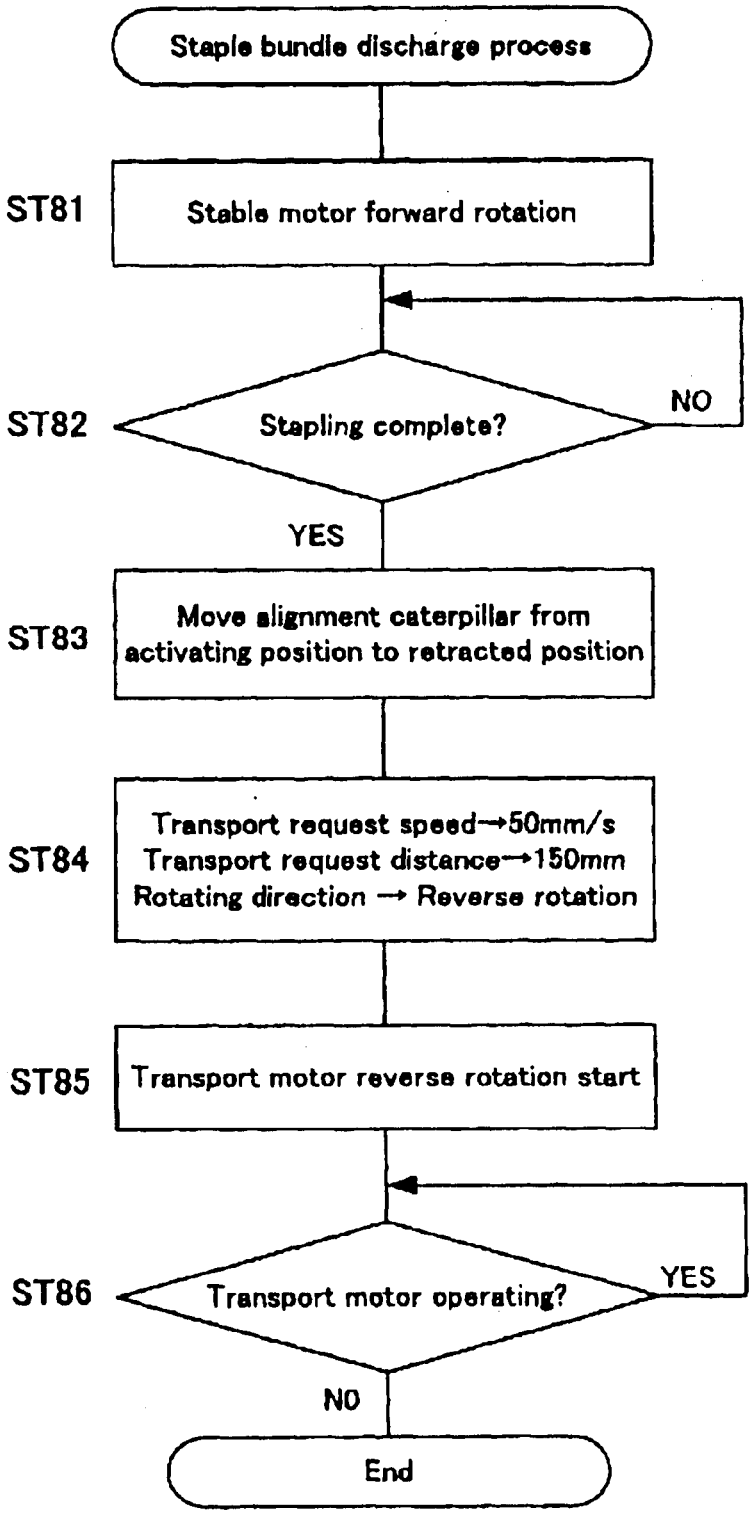
Figure 42:
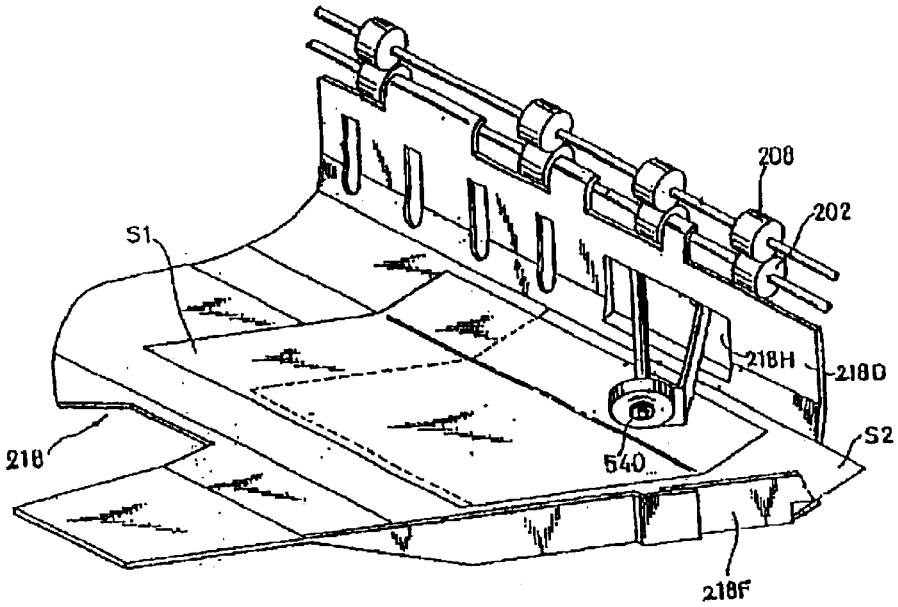
FIG. 42 Prior Art
Figure 43:
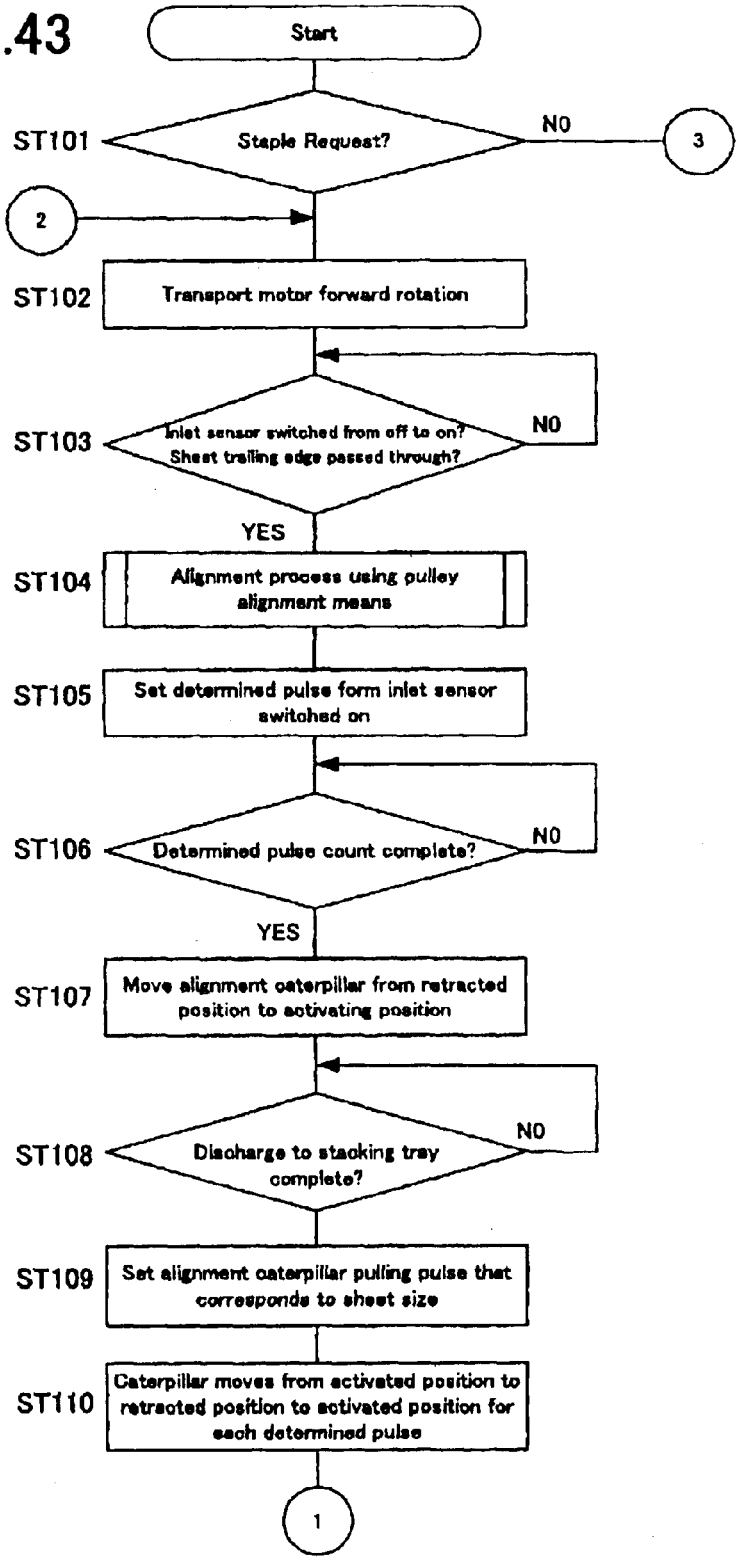
Figure 44:
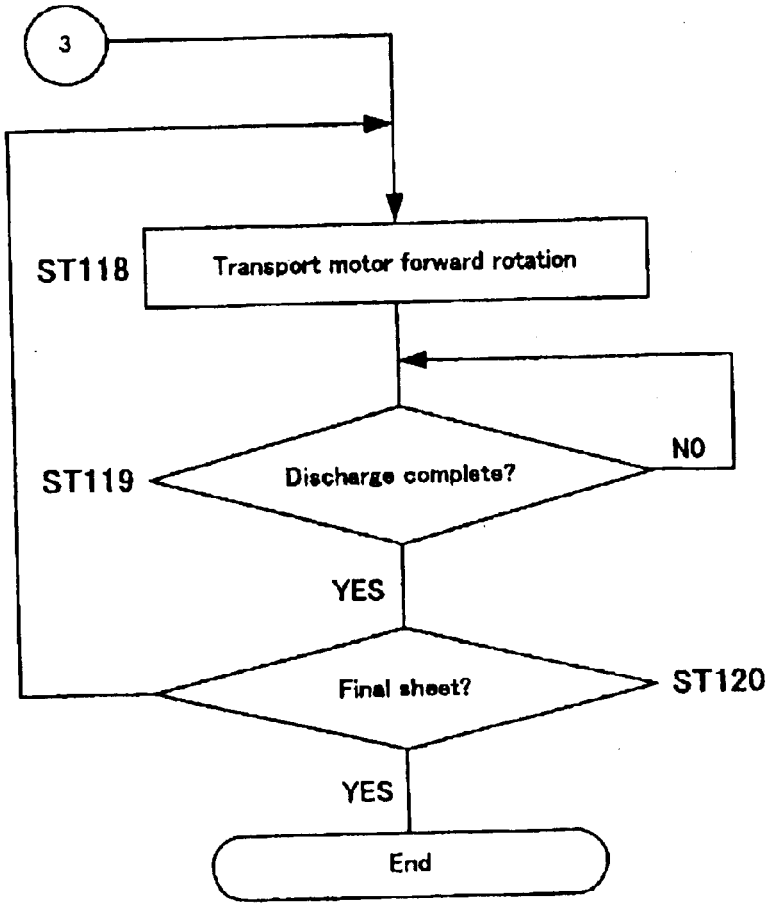
Figure 45:
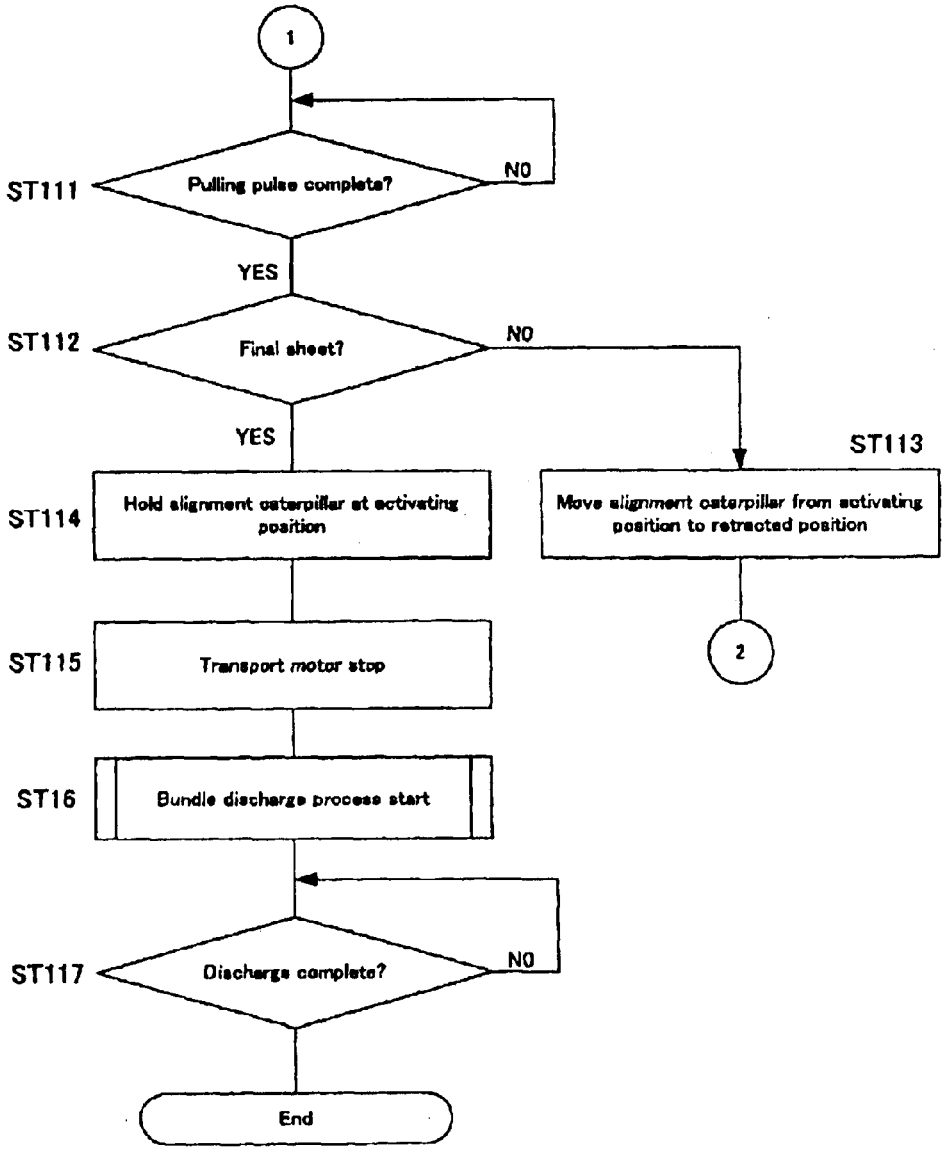
Figure 46:
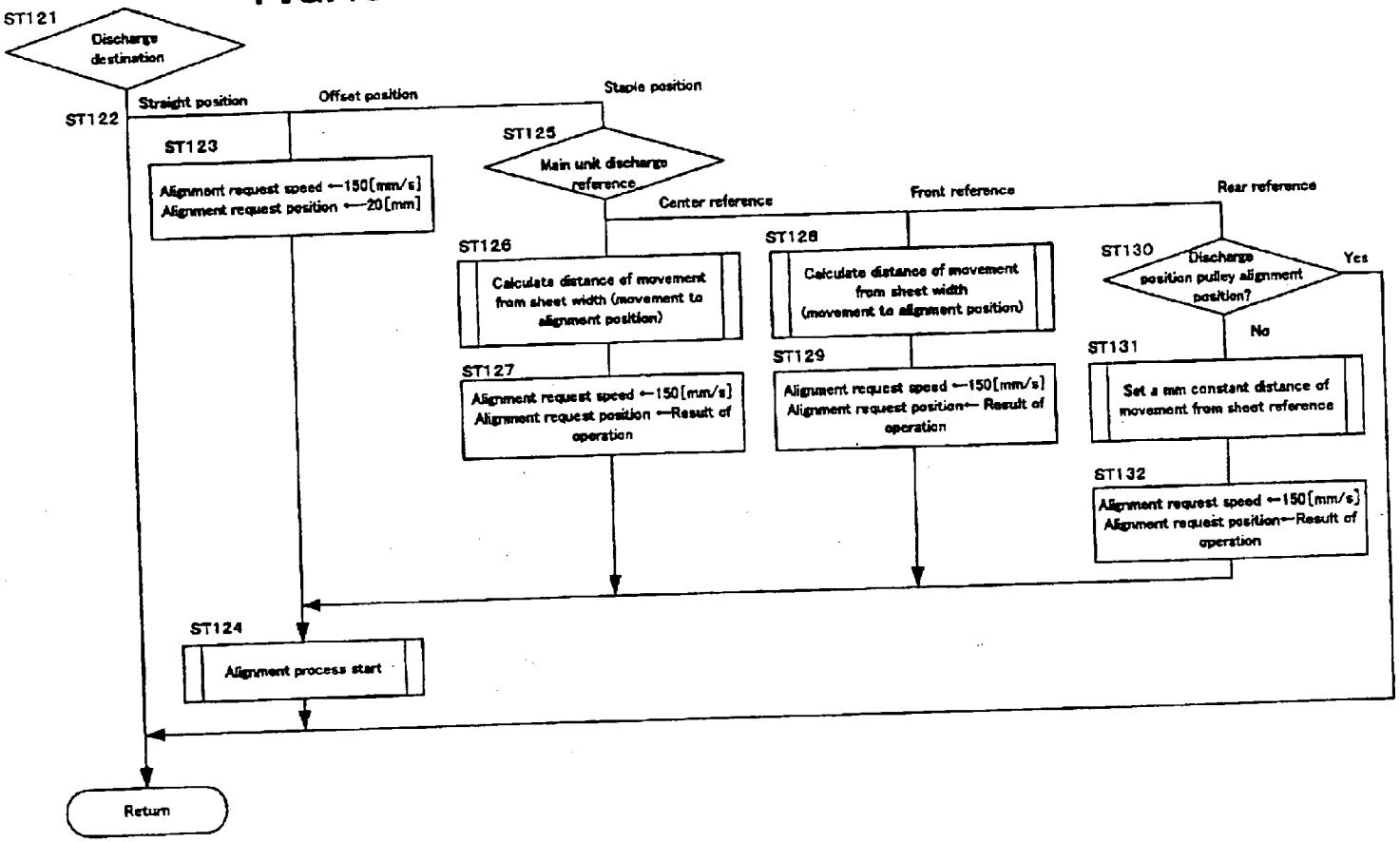
Figure 47:
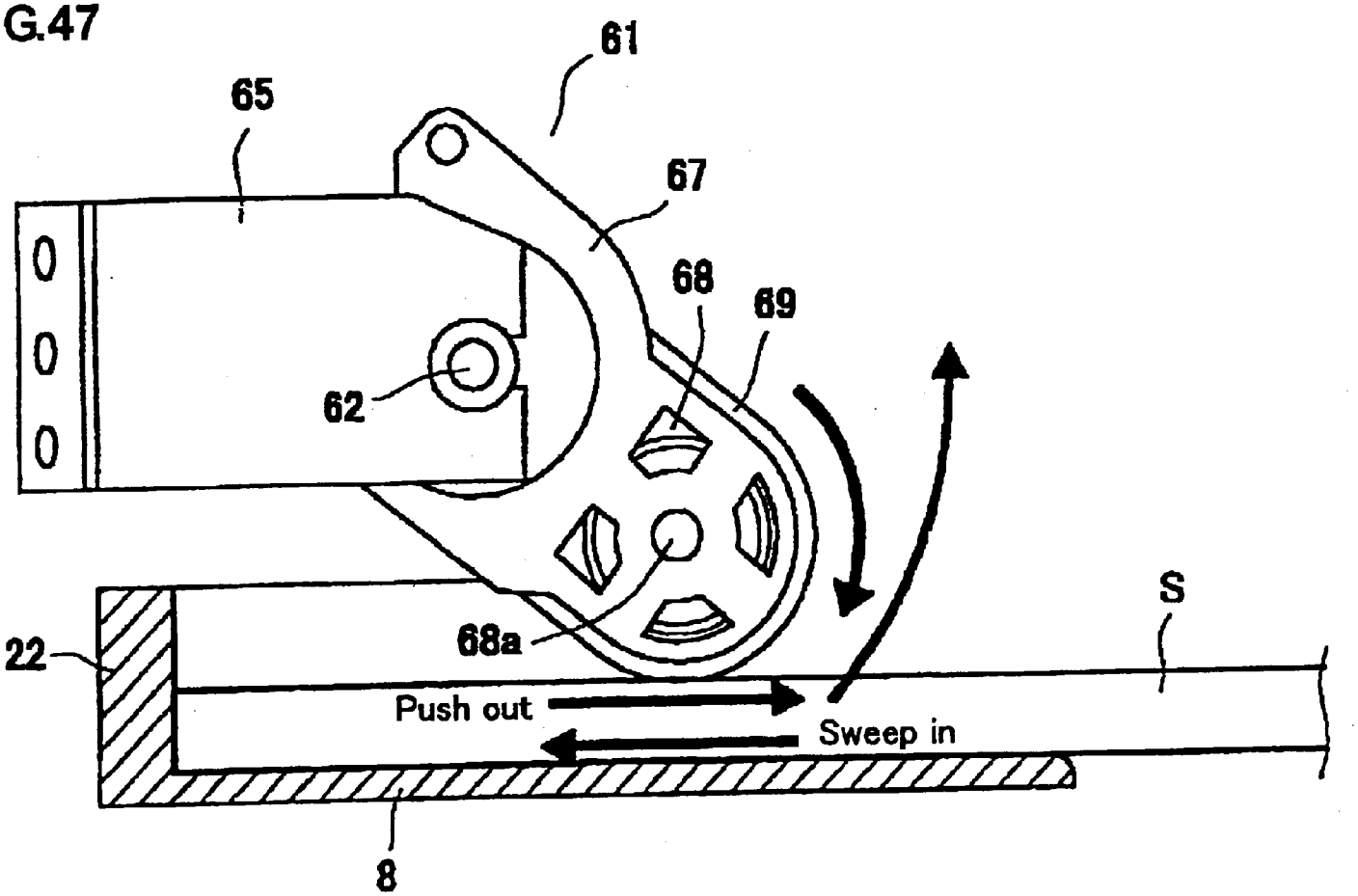

shows the belt unit at the activating position and FIG. 26(*b*) shows the belt unit at the retracted position;

FIG. 27 is a drawing showing the belt units which are the rotating bodies held at the retracted position when stapling and performing the bundle discharge in the embodiment of the present invention;

FIG. 28 is a drawing showing the sheet being discharged while moving horizontally toward the belt units which are the rotating bodies for alignment in the embodiment of the present invention;

FIGS. 29(*a*) and 29(*b*) are views showing a portion of the support means of the belt units which are the rotating bodies in FIG. 28, wherein FIG. 29(*a*) shows the belt units at the activating position and FIG. 29(*b*) shows the belt units at the retracted position;

FIG. 30 is a drawing showing a case where the sheet is discharged in a state that the rotating bodies align an edge of the sheet to the predetermined position for the alignment in the embodiment of the present invention;

FIGS. 31(*a*) and 31(*b*) are views showing a portion of the support means of the belt units which are the rotating bodies in FIG. 30, wherein FIG. 31(*a*) shows the belt units at the activating position and FIG. 31(*b*) shows the belt units at the retracted position;

FIG. 32 is a drawing showing a case where the sheet is discharged with an edge thereof aligned at the predetermined position for the rotating bodies to align because of a large size of the sheet in the embodiment of the present invention;

FIGS. 33(*a*) and 33(*b*) are views showing a portion of the support means of the belt units which are the rotating bodies in FIG. 32, wherein FIG. 33(*a*) shows the belt units at the activating position and FIG. 33(*b*) shows the belt units at the retracted position;

FIG. 34 is a drawing showing the configuration of the control apparatus on the sheet discharge apparatus according to the present invention;

FIG. 35 is a drawing showing a portion of the control flow to operate the pre-alignment, alignment and the sheet finishing process on the sheet discharge apparatus according to the present invention;

FIG. 36 is a view showing the control flow continued from FIG. 35 in the sheet discharge apparatus according to the present invention;

FIG. 37 is a view showing the control flow continued from FIG. 35 in the sheet discharge apparatus according to the present invention;

FIG. 38 is a view showing the control flow continued from FIG. 35 in the sheet discharge apparatus according to the present invention;

FIG. 39 is a view showing the control flow continued from FIG. 38 in the sheet discharge apparatus according to the present invention;

FIG. 40 is a view showing the control flow for performing alignment using the pre-alignment means as defined in FIG. 35 according to the present invention;

FIG. 41 is a view showing the control flow for performing the stapling and bundle discharge process as defined in FIG. 36 according to the present invention;

FIG. 42 is a view showing a portion of the configuration of the conventional sheet discharge apparatus;

FIG. 43 is a view showing a portion of the control flow to operate the pre-alignment, alignment and the sheet finishing process in the sheet discharge apparatus according to the present invention;

FIG. 44 is a view showing a portion of the control flow to operate the pre-alignment, alignment and the sheet finishing process in the sheet discharge apparatus according to the present invention;

FIG. 45 is a view showing a portion of the control flow continued from FIG. 43 to operate the pre-alignment, alignment, the sheet finishing process and the sheet bundle discharge according to the present invention;

FIG. 46 is a view showing the control flow for performing alignment using the pre-alignment means as defined in FIG. 43 according to the present invention; and FIG. 47 is a view explaining the operation when the rotating bodies are elevated according to the present invention.

DETAILED DESCRIPTION OF PREFERRED EMBODIMENTS

The following describes in detail the preferred embodiments according to the present invention in reference to the drawings provided.

A. Mounting Structure and Transport System (FIG. 1)

Figure 1:
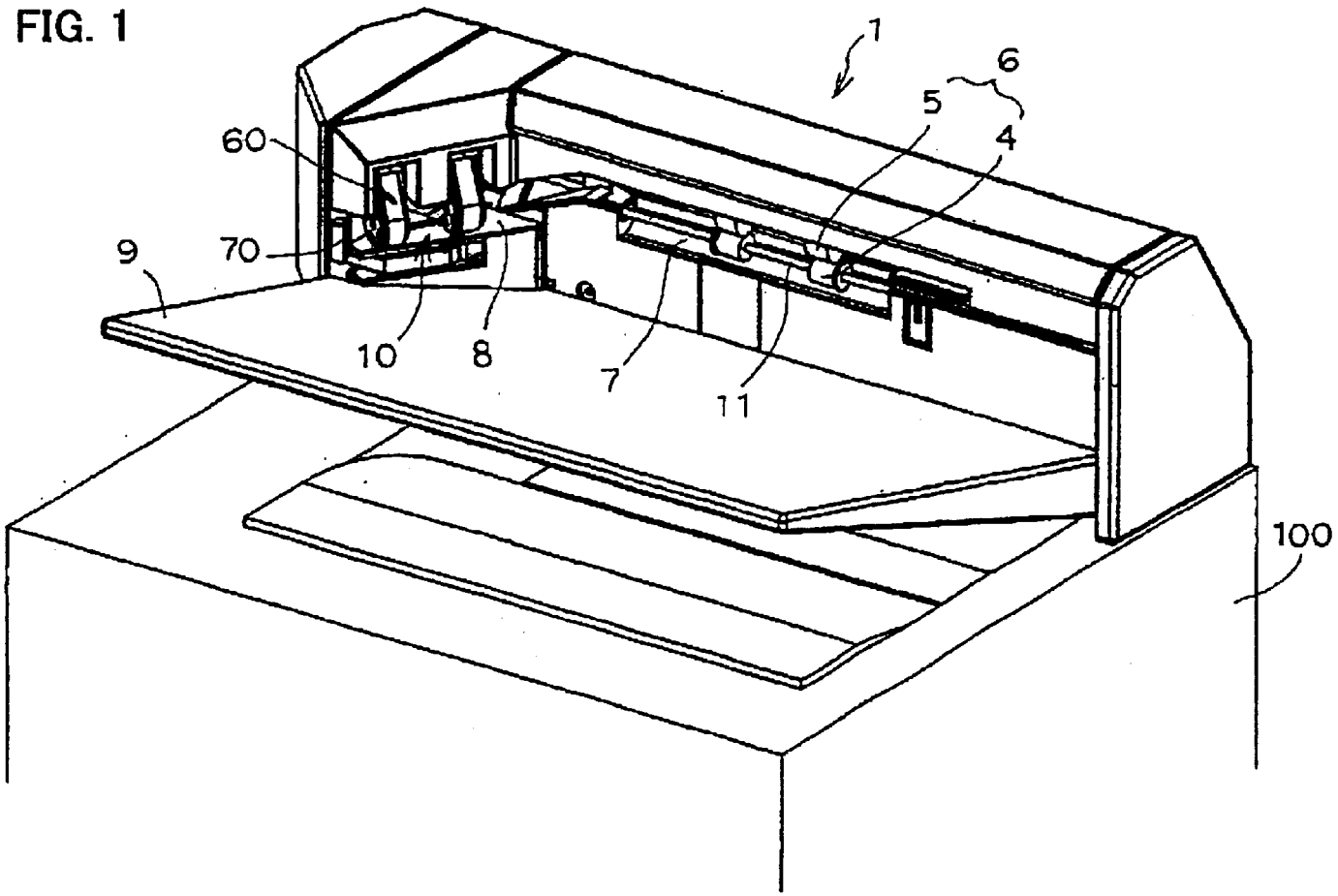
FIG. 1 is an external view of the sheet discharge apparatus of the present invention.

FIG. 1 shows one embodiment of the image forming apparatus provided with the sheet discharge apparatus according to the present invention. In this embodiment, the sheet discharge apparatus 1 according to the present invention is structured to be detachably mounted to the top of the image forming apparatus 100 comprising a page printer. More specifically, to connect the sheet discharge apparatus 1 and the image forming apparatus 100, a lock arm 1*a* (FIG. 2) is protrudingly established on the lower side of the sheet discharge apparatus 1, the lock arm mating with a holding portion (not shown in the drawings) inside of the image forming apparatus 100 to mount the sheet discharge apparatus 1 on the top of the image forming apparatus 100.

Note that although the image forming apparatus 100 comprises a page printer in this embodiment, it is also perfectly acceptable to apply the sheet discharge apparatus according to the present invention to a copier as well.

Figure 2:
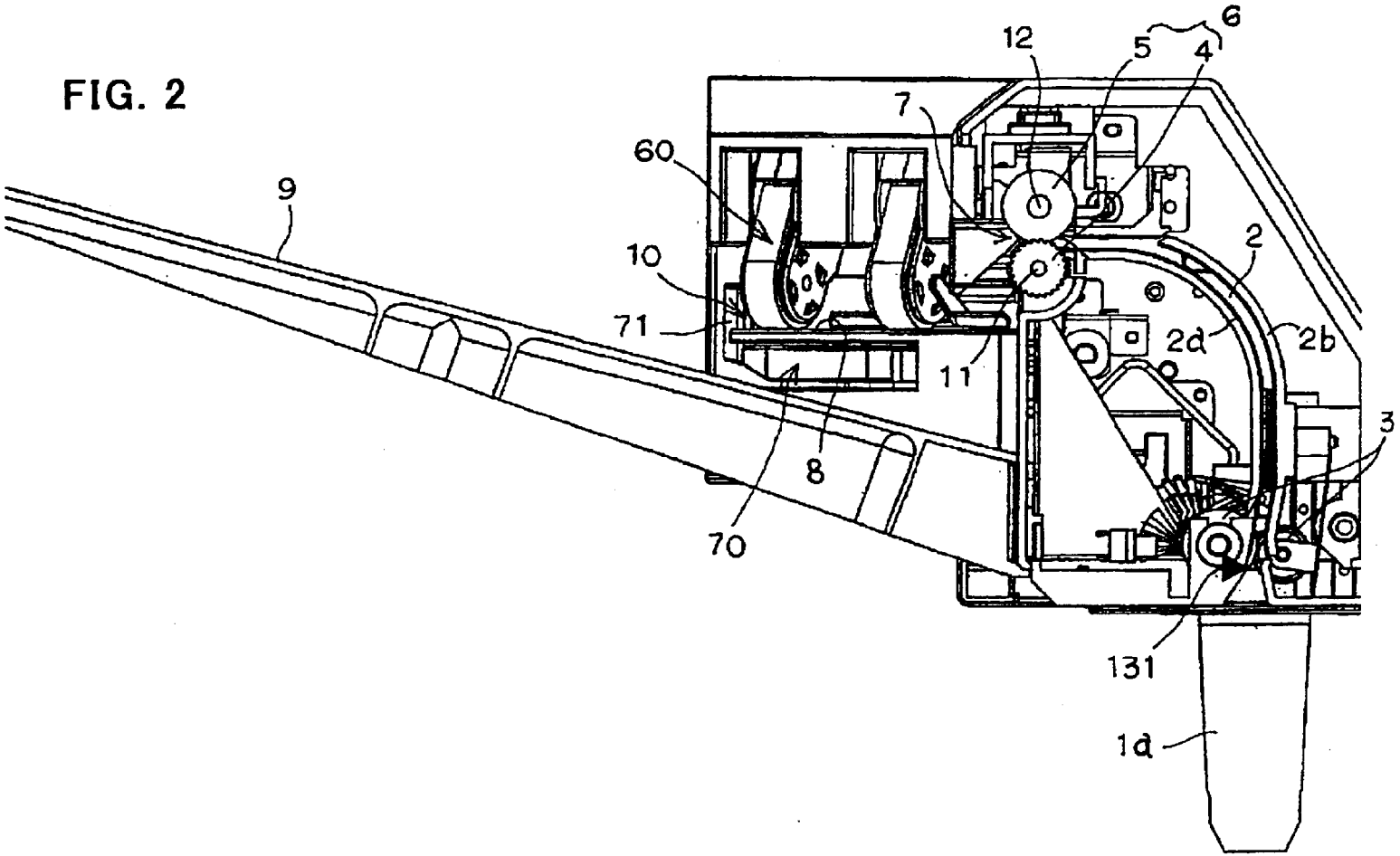
FIG. 2 is a sectional view showing the sheet discharge apparatus according to the present invention separated vertically at the paper path portion.

FIG. 2 shows the configuration of the transport system to receive, then to discharge printed or copied sheets (called sheets below) from the image forming apparatus 100.

Sheets discharged toward the top from the discharge portion, not shown in the drawings, on the image forming apparatus 100 are fed to the paper path (sheet transport path) 2 formed by the upper guide 2*a* and the lower guide 2*b* inside of the sheet discharge apparatus 1. This paper path 2 extends substantially vertically to the back of the sheet discharge apparatus 1 and bends to the front. To the lower edge, the inlet the paired transport rollers 3 are disposed. In other words, the aforementioned copy sheets are fed into the paper path 2 by the paired transport rollers 3 disposed at the lower edge inlet of the paper path 2, and further downstream into the sheet discharge apparatus and are discharged from the discharge outlet 7.

B. Sheet Discharge Means 6

In FIG. 1, to the discharge outlet 7 on the sheet discharge apparatus 1 are arranged the paired tray discharge rollers 4 and 5 composed of the discharge roller 4 which is a follower roller and the tray discharge roller 5 which is a drive roller as the sheet discharge means 6.

Figure 20:
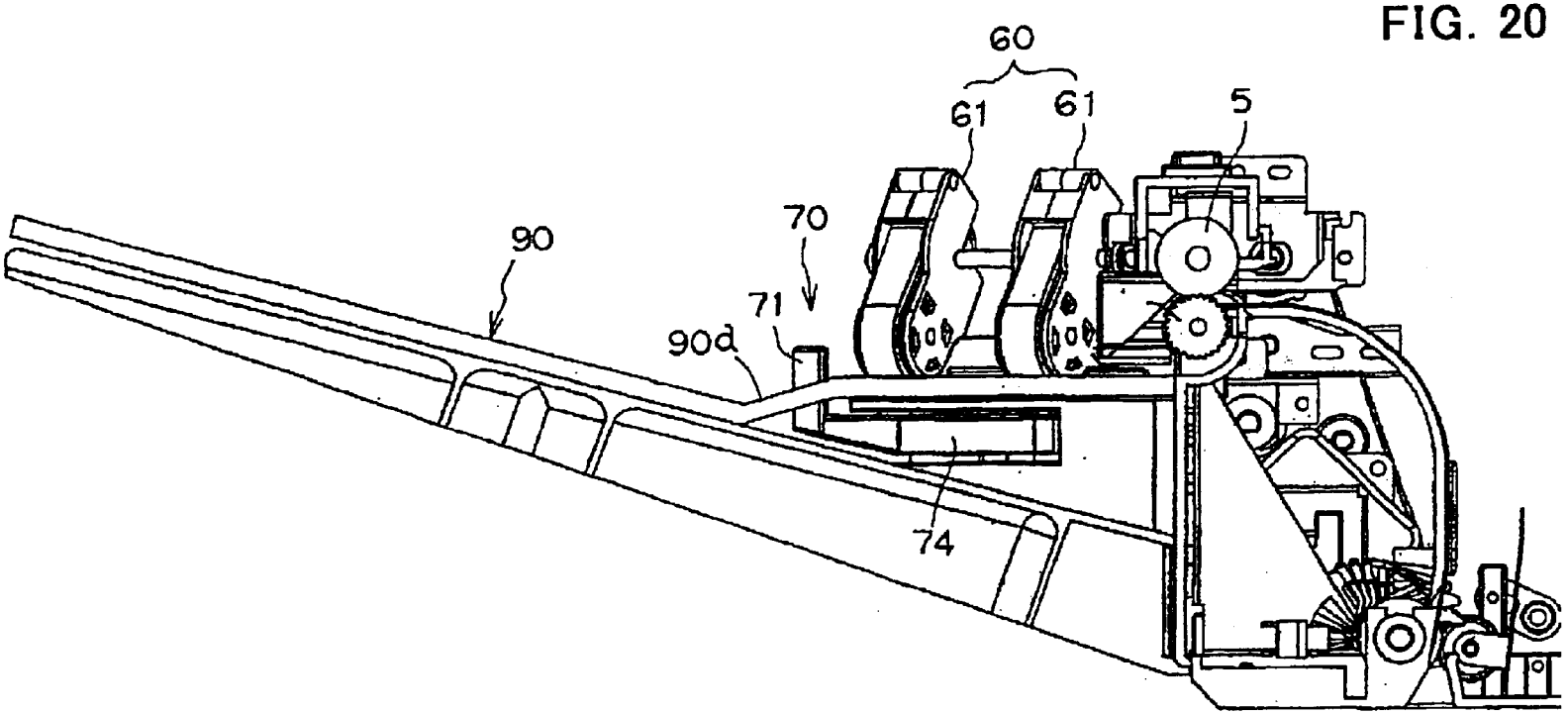
FIG. 20 is a drawing showing a partial sectional view of the positional relationships among the fixed stacking portion (the first tray), the storage tray (the second tray), and the vertical direction of the sheet bundle in the sheet discharge apparatus according to the present invention.
Figure 21:
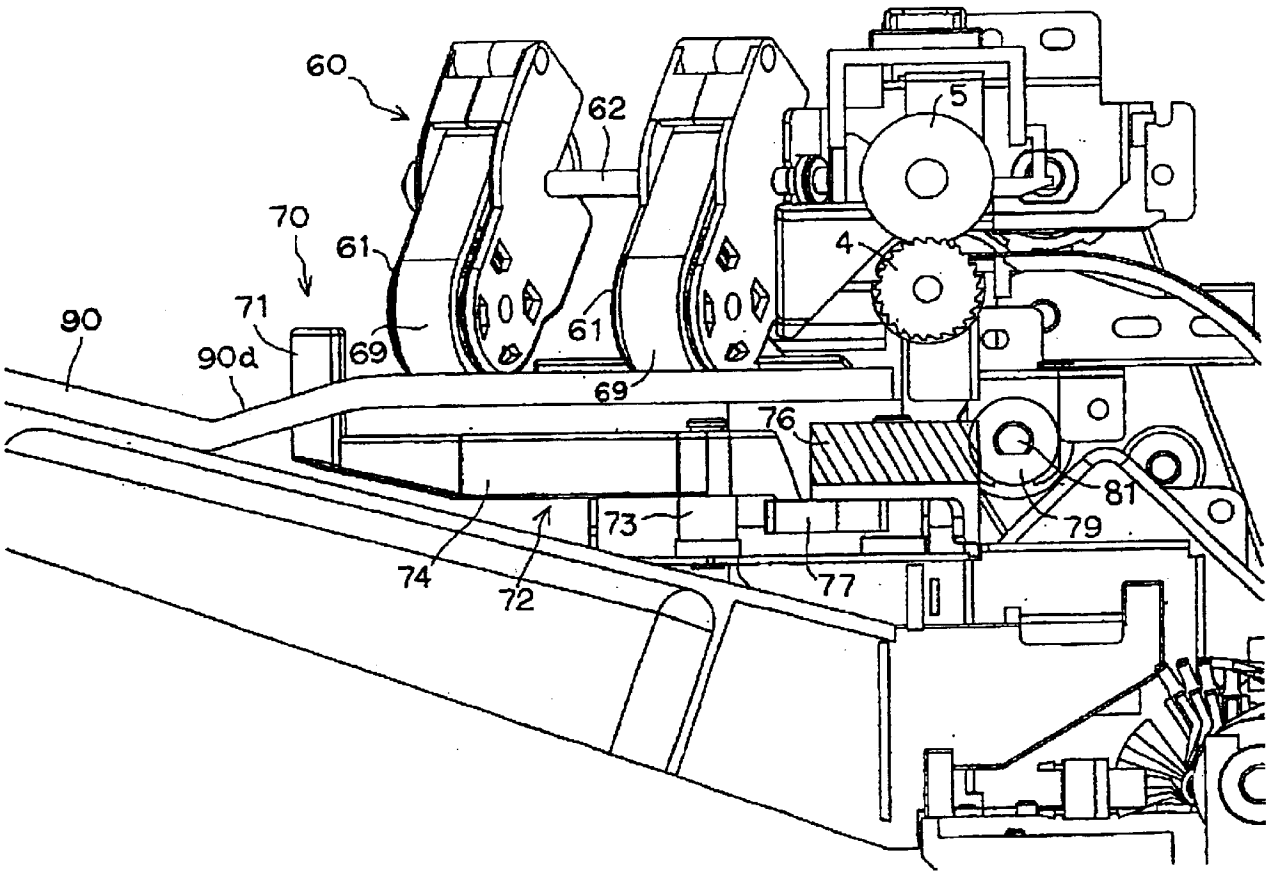
FIG. 21 is a side view showing a partial sectional view of the sheet bundle discharge means (sheet moving means) in the sheet discharge apparatus according to the present invention.

Also, downstream of the direction of sheet transport of the paired tray discharge rollers 4 and 5 is established the sheet storage means comprising the first tray (fixed stacking portion 8) and the second tray (storage tray 9). Also, the fixed stacking portion 8 (the first tray) is disposed as a configuring element of the support means (the sheet single corner portion support means) 10 that supports one corner of sheets discharged by the aforementioned discharge means 6 in the upstream side in the discharge direction. In this embodiment, the fixed stacking portion 8 is configured to support one corner of the sheet's trailing edge side. Furthermore, below the fixed stacking portion 8 is disposed the storage tray 9 (the second tray) having a size large enough to receive the maximum sized sheets discharged. Also, sheets are discharged by the paired tray discharge rollers 4 and 5 from the discharge outlet 7 to the fixed stacking portion 8 and the top of the stacking surface on the storage tray 9 and are stacked as shown in FIG. 20 and FIG. 21.

To enable a configuration for the paired tray discharge rollers 4 and 5 on the sheet discharge means 6 to rotate, near the discharge outlet 7 inside of the sheet discharge apparatus 1 are rotatingly arranged the two support shafts 11 and 12 that extend in parallel vertically, the aforementioned paired tray discharge rollers 4 and 5 being mounted in an appropriate plurality (in this case, a pair of two) midway on the each of the support shaft 11 and the support shaft 12.

Figure 5:
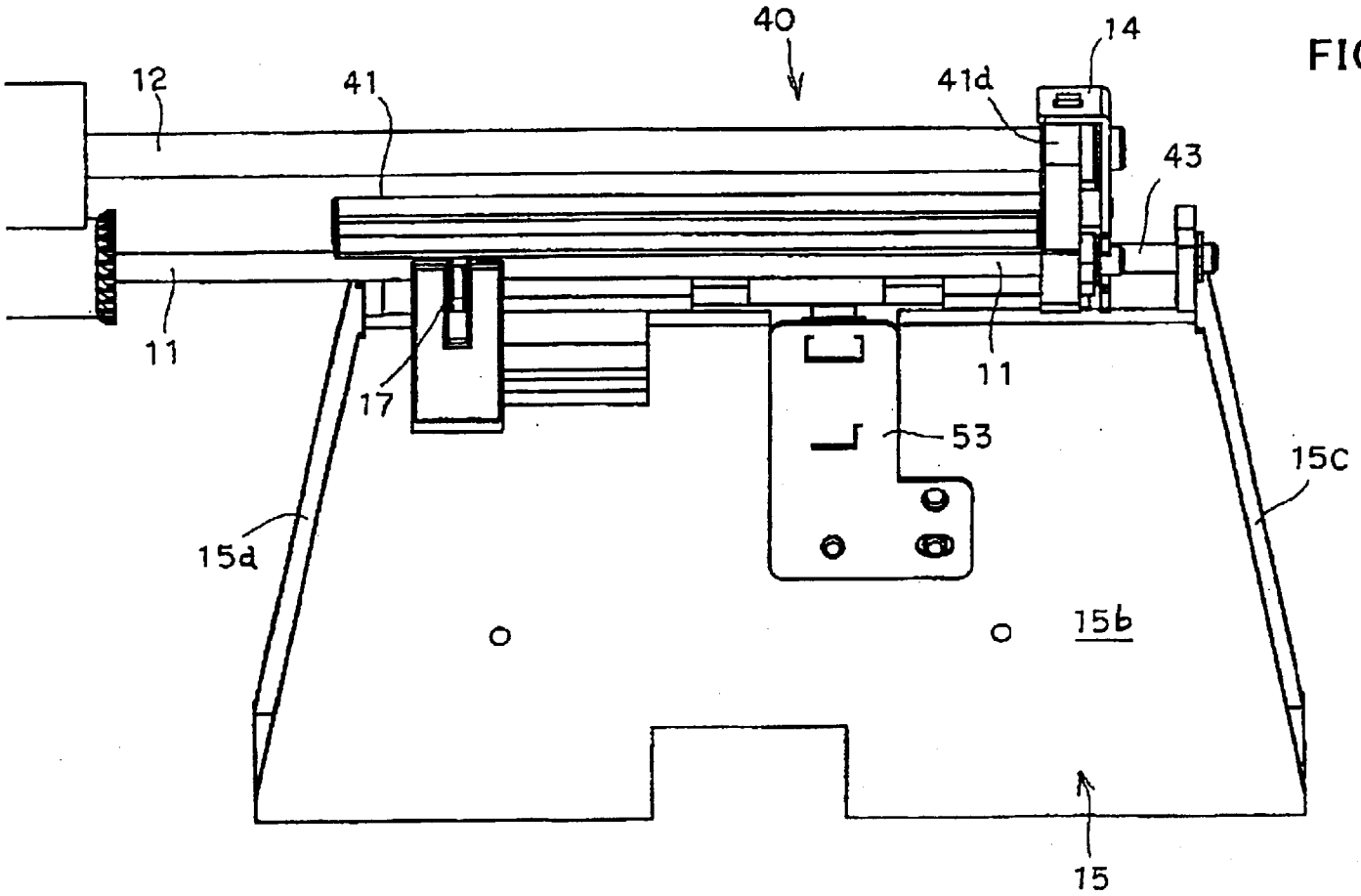
FIG. 5. is an expanded view showing the stand frame that supports the right edge of the support shaft of the sheet discharge apparatus shown in FIG. 4.
Figure 6:
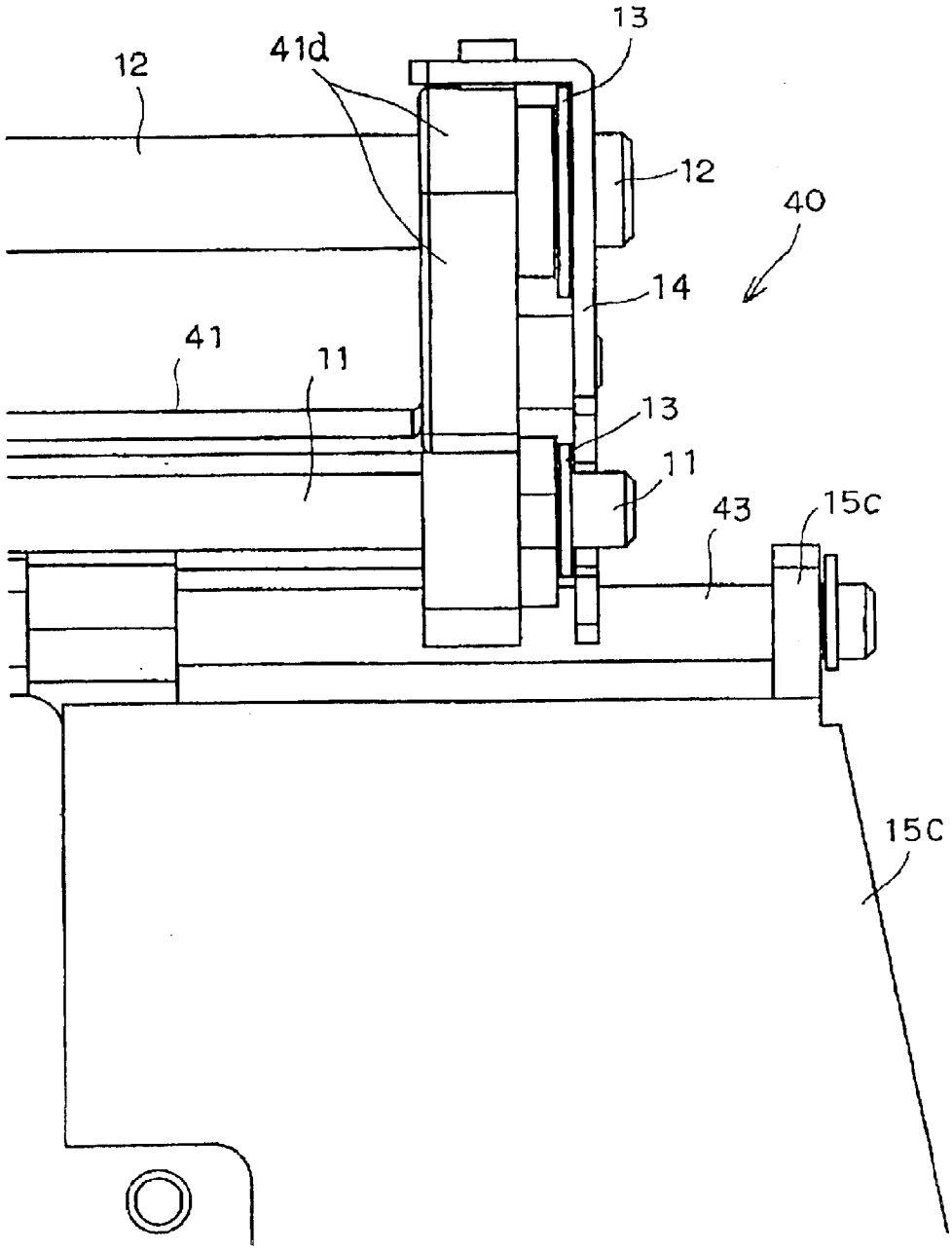
FIG. 6 is a further expanded view of a part of FIG. 5.

As is clearly shown in FIG. 5 and FIG. 6, the leading ends (the right side of FIG. 3) of both of the two support shafts 11 and 12 are inserted into the ear portion 41*a* protrudingly established on the outer edge of the upper surface on the sliding joint plate 41 which is a part of the sheet pre-alignment moving means (side alignment means) 40 dually used with the sheet side feed means of the sorting means (jog means) and are unitized to enable move according to the sliding joint plate 41.

More specifically, to the leading edges of each of the support shafts of 11 and 12 beyond their penetration of the ear portion 41*a* of the sliding joint plate 41 is disposed the E ring 13. The removal preventing member 14 used commonly on both support shafts 11 and 12 is disposed on the outer ends in the shaft direction of both the support shafts 11 and 12. The actions of the E ring 13 and the commonly used removal preventing member 14 disposed on the outer ends are unitized so that the shafts do not come out in the shaft direction.

Also, of the two support shafts 11 and 12, unitized as described above, the leading end of the lower support shaft 11 is rotatingly and in the shaft direction, movingly supported by a resilient vertically movable U-shaped first bearing member 17 on the upper portion of the U-shaped stand frame 15 established on one side in the sheet width direction of the base frame 1*c* (FIG. 7) in the sheet discharge apparatus 1.

Figure 10:
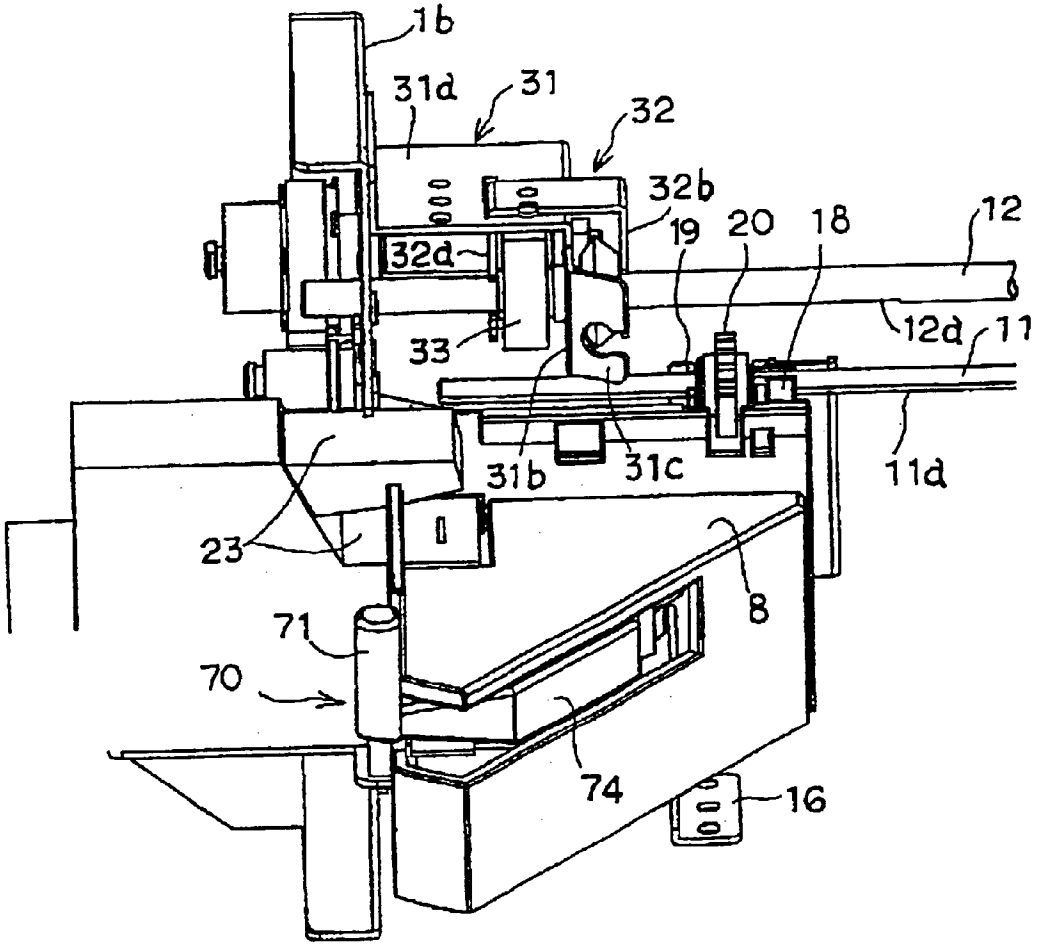
FIG. 10 is an expanded view showing the structure that supports the left edge of the support shaft of the sheet discharge apparatus shown in FIG. 4.
Figure 11:
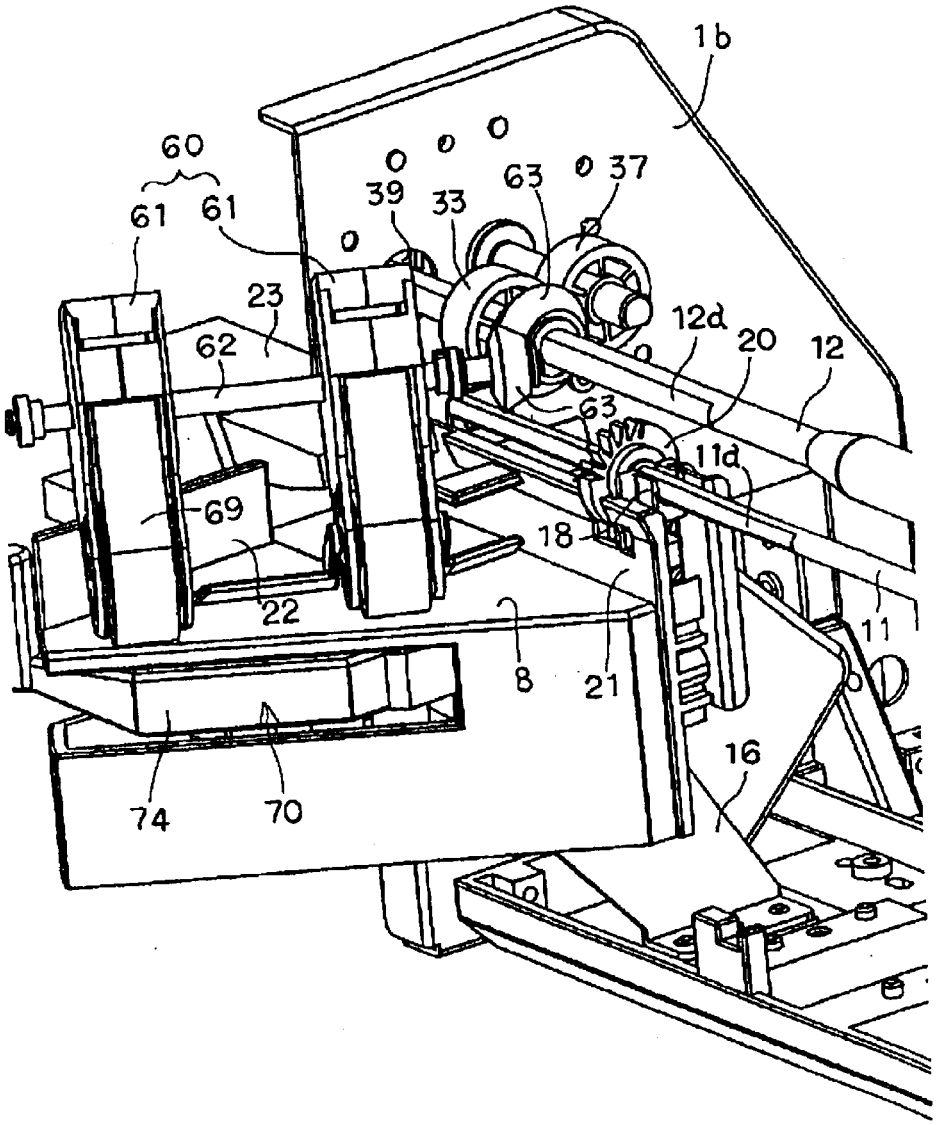
FIG. 11 is an expanded view of the left edge of the support shaft of the sheet discharge apparatus shown in FIG. 4.

On the other hand, with regard to the reference side (the left side of FIG. 3) of the aforementioned two support shafts 11 and 12, the shafts are rotatingly and slidingly supported in the shaft direction. More specifically, in FIG. 10 and FIG. 11, the reference side of the support shaft 11 of the two support shafts 11 and 12, is rotatingly and in the shaft direction, movingly supported by a resilient vertically movable U-shaped second bearing member 18 on the first support member 16 that is mounted to the side frame 1*b* of the sheet finishing apparatus 1. In this embodiment, as shown in FIG. 10 and FIG. 11, the reference side of the shaft 11 is formed as an cornered shape 11*a* having a sectional D shape, the cornered shape 11*a*. This cornered shape 11*a* is supported by the U-shaped second bearing member 18, resiliently supported for vertical movement with regard to the first support member 16, and is rotatingly and in the shaft direction, movingly supported.

Also, to this cornered shape 11*a* on the support shaft 11 the discharge paddle 20 made of a resilient material (rubber, in this case) comprising a plurality of teeth in the circumference direction is mated to allow the free sliding on the cornered shape 11*a* in the shaft direction. To fix the absolute position in the shaft direction of this discharge paddle 20, to the support shaft 11 the first slide regulating member 19 is mounted at a position slightly separated from the aforementioned second bearing member 18, the discharge paddle 20 is disposed between the aforementioned second bearing member 18 and the first slide regulating member 19 so the support shaft. 11 moves relative to the discharge paddle 20 but the discharge paddle 20 position is not changed. Also, the support shaft 11 is configured to advance and retract in the shaft direction penetrating the first slide regulating member 19 shaft hole and the notched opening portion 38 established in the side frame 1*b* while leaving the discharge paddle 20, the movement thereof in the shaft direction regulated by the first slide regulating member 19, between the first slide regulating member 19 and the second bearing member 18. Note that the aforementioned sectional D shaped cornered shape 11*a* formed on the reference side of the support shaft 11 slidingly penetrates in the shaft direction not only the discharge paddle 20, but the first slide regulating member 19 as well.

In other words, from both sides of the discharge paddle 20, the support shaft 11 is formed in a D shape for at least for the distance for the support shaft to advance and retract, the shaft hole in the discharge paddle 20 also is formed into a D shape. Such configuration enables the rotation of the support shaft 11 to be transmitted to the discharge paddle 20 positioned between the second bearing member 18 and the first slide regulating member 19 even when the support shaft 12 and the support shaft 11 are advanced or retracted (sliding in the shaft direction). Therefore, while the paired tray discharge rollers 4 and 5 are advancing and retracting in the shaft direction along with the support shafts 11 and 12, and sheets are being discharged, the discharge paddle 20 exists at a predetermined position between the first slide regulating member 19 and the second bearing member 18. In other words, by rotating without moving in the shaft direction, the discharge paddle 20 is configured to discharge sheets.

Furthermore, the reference side of the upper support shaft 12 also is movingly supported in the shaft direction with regard to the second supporting member 31 mounted on the side frame 1*b*. In other words, as shown in FIG. 10, to the inner wall of the side frame 1*b* are disposed the upper surface wall 31*a* that extends slightly inside from the side frame 1*b* and the second supporting member 31 that comprises the vertical downward bent wall 31*b* that continues downward therefrom. Further, the upside-down U-shaped second slide regulating member 32 that comprises the leg portion 32*a* and the leg portion 32*b* is disposed with its one leg portion 32*a* penetrating vertically downward the aforementioned second supporting member 31 upper surface wall 31*a*. Also, between the leg portion 32*a* on the second slide regulating member 32 and the vertical downward wall 31*b* on the second supporting member 31, the interlock gear 33 is disposed on the support shaft 12, the aforementioned interlock gear 33 allows a relative sliding of the shaft direction with regard to the support shaft 12 penetrating therethrough, but is supported not to allow relative rotation.

In this embodiment, as is shown in FIG. 10 and FIG. 11, the reference side of the support shaft 12 is formed as the cornered shape 12*a* having a sectional D shape, the cooperative action of the cornered shape 12*a* and the bearing portion of the second supporting member 31 allows the rotation of the reference side of the support shaft 12 by the interlock gear 33 and movement in the shaft direction.

The slide support structure described above allows the support shafts 11 and 12 to rotate and to move together accompanying the movement of the slide joint plate 41 in the shaft direction, the leading ends thereof joined together by the slide joint plate 41.

Figure 12:
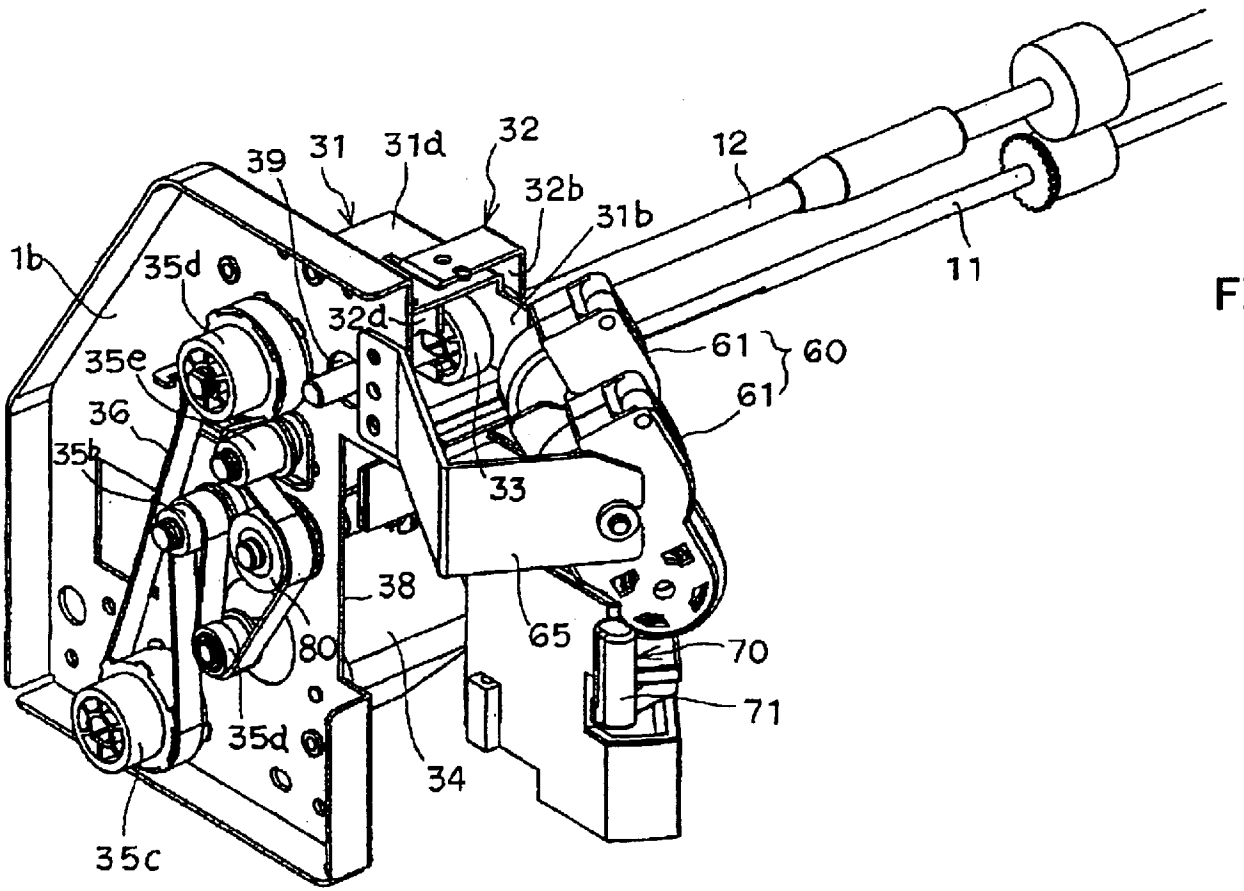
FIG. 12 is a perspective view of the drive mechanism of the support shaft of the sheet discharge apparatus shown in FIG. 4.

As shown in FIG. 12, to the side frame 1*b* are disposed the transport motor 34 that rotatingly drives the aforementioned support shaft 12 and that applies transport force to the sheets and the force transmission mechanism. Specifically, the output from the transport motor 34 is transmitted from the motor pulley 35*a* mounted on that output shaft to the relay pulley 35*b*, the transport roller pulley 35*c* and the follower pulley 35*d* via the timing belt 36 and the force transmission mechanism is configured so that transmits to the interlock pulley 37 disposed on the same shaft as the follower pulley 35*d*. The interlock gear 33 disposed on the aforementioned support shaft 12 mates with the interlock gear 37 that is the output side of the force transmission mechanism. Thus, the drive from the transport motor 34 is received by the interlock gear 33 and rotates the support shaft 12, accompanying that, the follower side support shaft 11 also rotates.

Specifically, the tray discharge roller 5 is the drive roller rotated by the transport motor 34 via the aforementioned force transmission mechanism. The other, the tray discharge roller 4, is a follower roller in contact with the tray discharge roller 5 and rotates by the rotation of the tray discharge roller 5.

Figure 13:
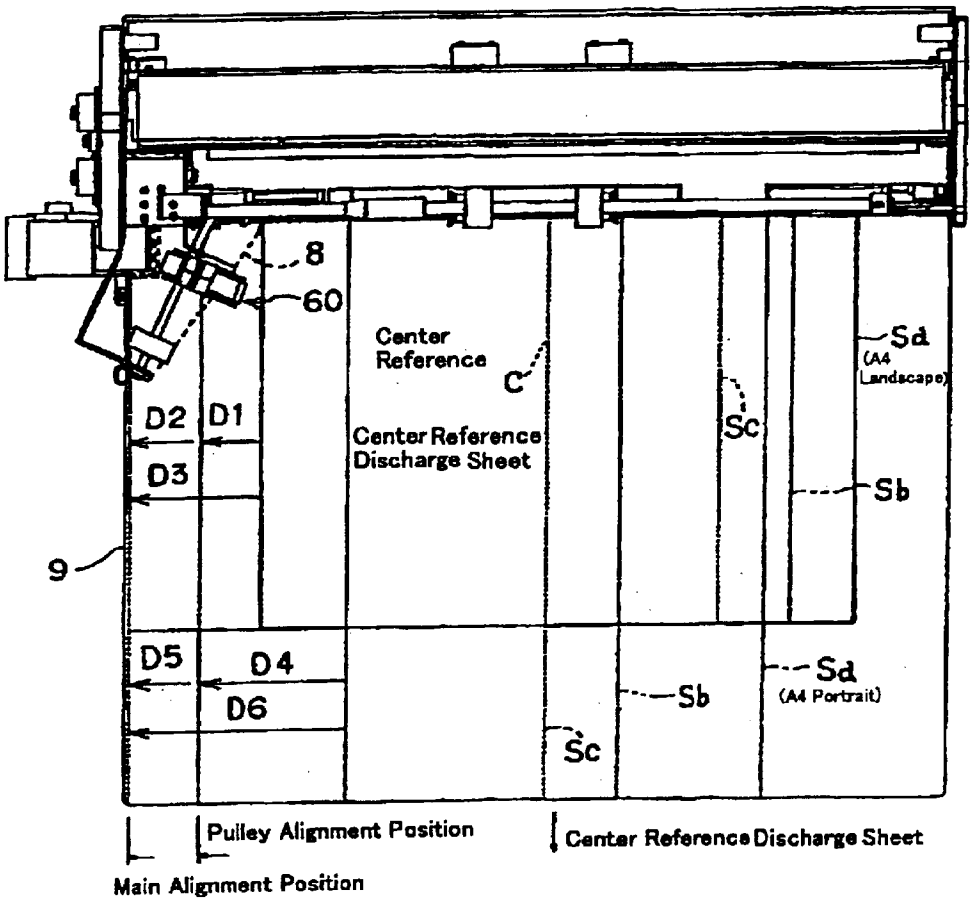
FIG. 13 is a drawing showing the relationships among the sheet positions discharged from the sheet discharge apparatus according to the present invention, the pre-alignment position and the alignment position.
Figure 14:
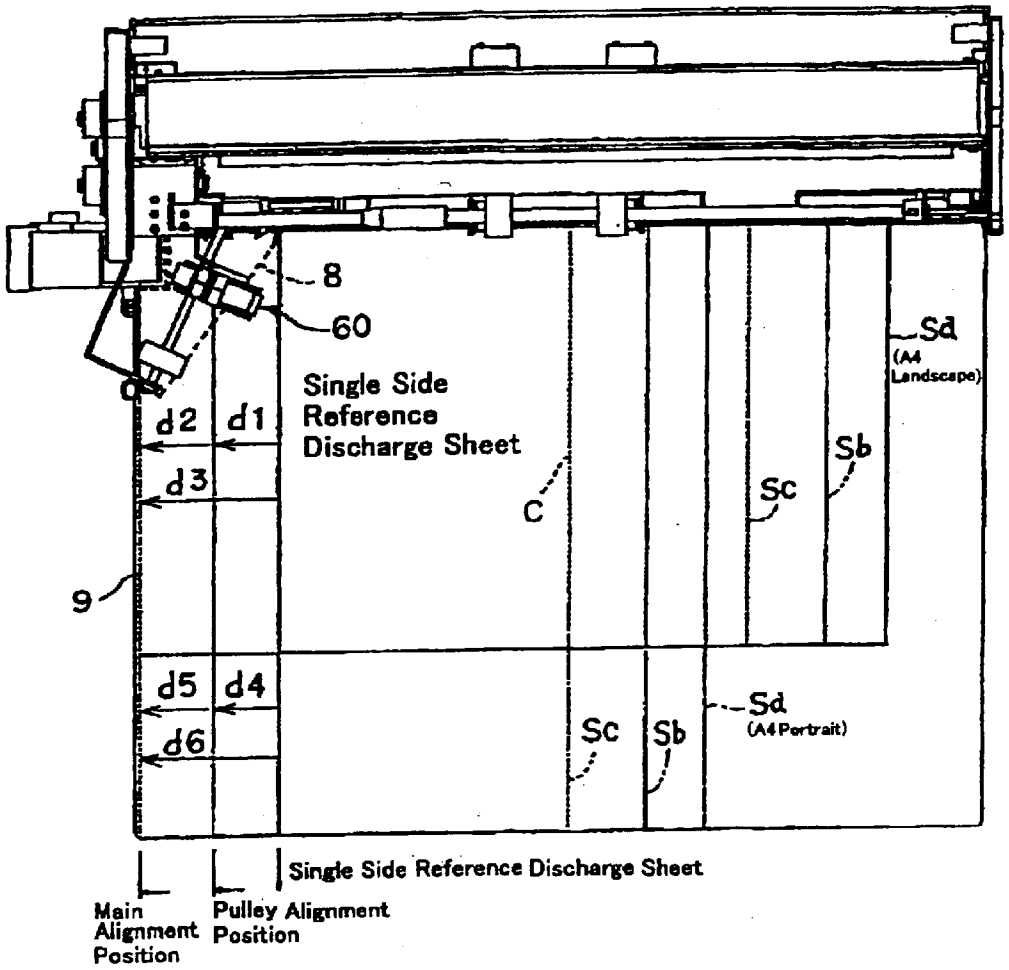
FIG. 14 is a drawing showing the relationships among the sheet positions discharged at one side reference from the sheet discharge apparatus according to the present invention, the pre-alignment position and the alignment position.

C. Alignment Reference Position and Finishing Means (FIG. 13 and FIG. 14)

In the sheet discharge means 6 of the aforementioned configuration, the sheets are nipped by the rotating paired tray discharge rollers 4 and 5 and are fed from the discharge outlet 7 with the applied transport force and are discharged to the sheet storage means composed of the fixed stacking portion 8 (the first tray) and storage tray 9 (the second tray). FIG. 13 shows an embodiment of discharging sheets using one side reference, FIG. 14 shows an embodiment of discharging sheets using center reference.

Figure 15:
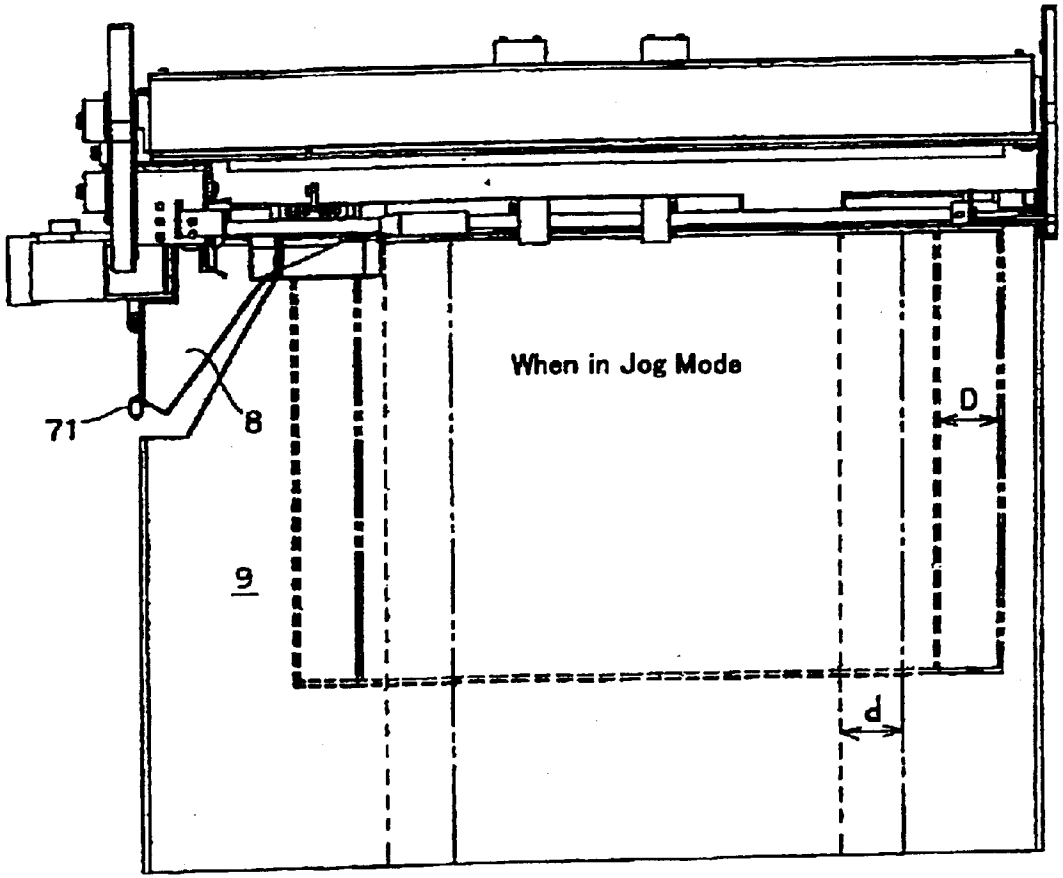
FIG. 15 is a drawing showing the sheet discharge position when the jog mode is operated on the sheet discharge apparatus according to the present invention.

Also, FIG. 15 shows the sheets being discharged when in the jog mode, which is described below. In the jog mode, while shifting each of the sheet bundles alternately a distance of D5, which is the offset amount, they are sequentially stacked when discharged, thereby offsetting each of the sheet bundles that are stacked, vertically.

The storage tray 9 (the second tray) is established to support three corners, excluding the sheet corner portion supported by the sheet single corner portion support means when finishing sheets by the stapler (finishing means) 23, which is described later. However, it is also perfectly acceptable for a size that supports one of the upstream corners of the three corners and a part of the back surface of the sheets. In this example, the storage tray 9 (the second tray) is long. That size has a dimension capable of storing the vertically long size of full sized sheets such as A3 or B4 (in this case, the length of A3 size).

The fixed stacking portion 8 (the first tray) as the aforementioned sheet single corner portion support means is formed so that the edge of the upper surface that supports sheets on the fixed stacking portion 8 (the first tray) is on the side of the single corner of the sheets from the diagonal line drawn between the two corners neighboring the single corner of the sheets when discharging the smallest size of sheet handled using the sheet discharge means 6. Here, the fixed stacking portion 8 (the first tray) as the aforementioned sheet single corner portion support means, is arranged above the single corner portion (the upper left corner in FIG. 13) upstream of the sheet discharge direction of the storage tray 9, to be a portion of the sheet storage surface for the storage tray 9 when looking from above.

Figure 3:
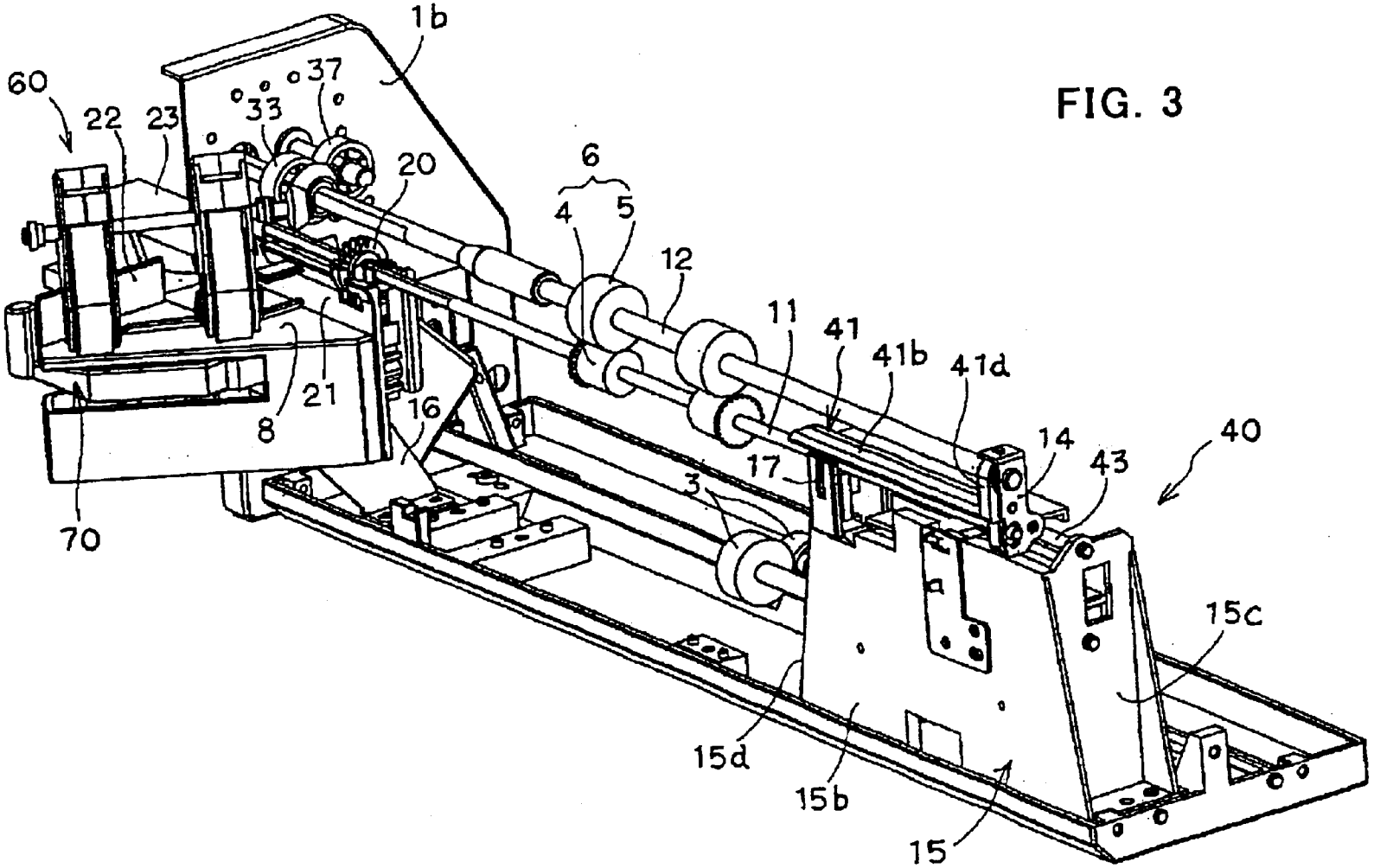
FIG. 3 is a perspective view of the sheet discharge apparatus according to the present invention showing the cover and storage tray removed.
Figure 4:
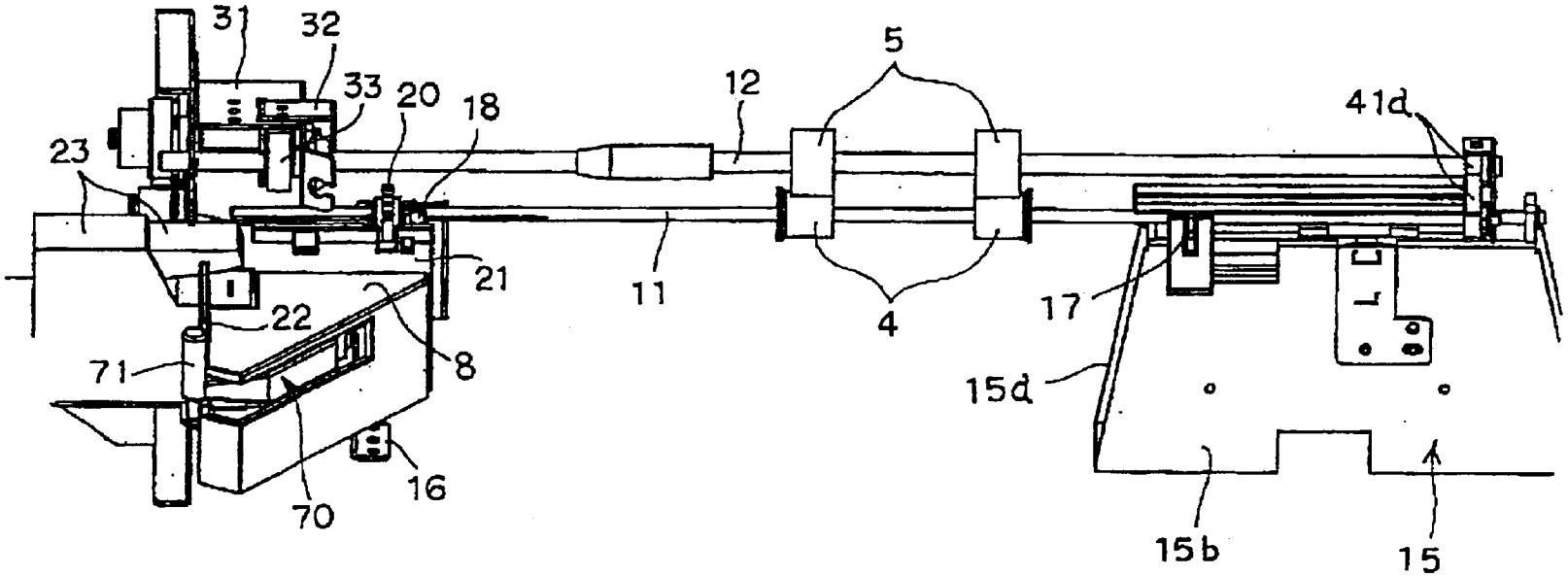
FIG. 4 is a perspective view of the sheet discharge apparatus shown in FIG. 3 with the base frame removed viewed from above.

As shown in FIG. 3 and FIG. 4, upstream of the fixed stacking portion 8 is established the abutting plate 21, either fixed or semi-fixed, as one of the positioning reference means (alignment reference member) to align at least one side of the sheets discharged by the discharge means 6, configuring the discharge direction reference surface that applies the discharge direction alignment reference position when aligning sheets.

On one side of the fixed stacking portion 8 is arranged the positioning plate 22 composed of the abutting reference (width direction alignment reference position) in the direction traversing the sheet discharge direction (hereinafter referred to as the width direction), as one of the position alignment reference means (alignment reference member) to align at least one side of the sheets discharged by the discharge means 6.

The finishing position is regulated by the abutting plate 21 (the discharge direction alignment reference position) and the positioning plate 22 (the width direction alignment reference position).

To the aforementioned fixed stacking portion 8 (the first tray) established as the finishing means is the stapler 23 that piercingly drives staples into and binds sheet bundles aligned by being pushed against this finishing position.

D. The Pre-alignment Movement Means (Sheet Horizontal Feed Means) 40

When discharging sheets with the side reference and the center reference, sheets are moved horizontally to the width direction alignment reference position only the distance of D1 to D4 in FIG. 13 and FIG. 14, by the sheet horizontal feed means of the jog means described below along with the pre-alignment movement means (side alignment means) 40 and are bound by the aforementioned stapler 23. Also, when in the jog mode, sheets are horizontally fed (traverse movement) only the amount of D5 in FIG. 15 for sorting.

For that purpose, the pre-alignment movement means 40 assumes the aforementioned sliding structure wherein the support shafts 11 and 12 on the paired tray discharge rollers 4 and 5 retract in the shaft direction. Furthermore, the structure is equipped with the sliding joint plate 41 and its sliding drive portion 45 to move together with the support shafts 11 and 12 in the shaft direction.

Figure 7:
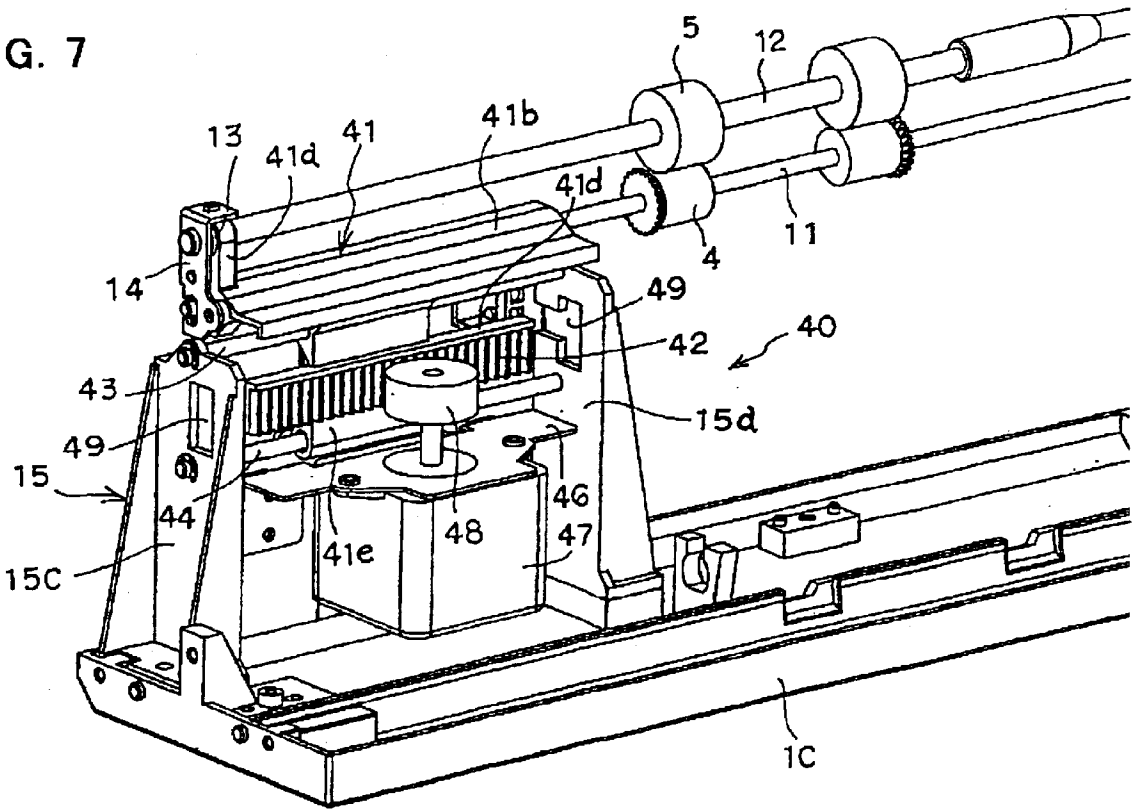
FIG. 7 is a perspective view of the sheet horizontal feeding means (dual use of the pre-alignment moving means and the sorting means) built into the stand frame shown in FIG. 5 viewed from the inside of the apparatus.
Figure 9:
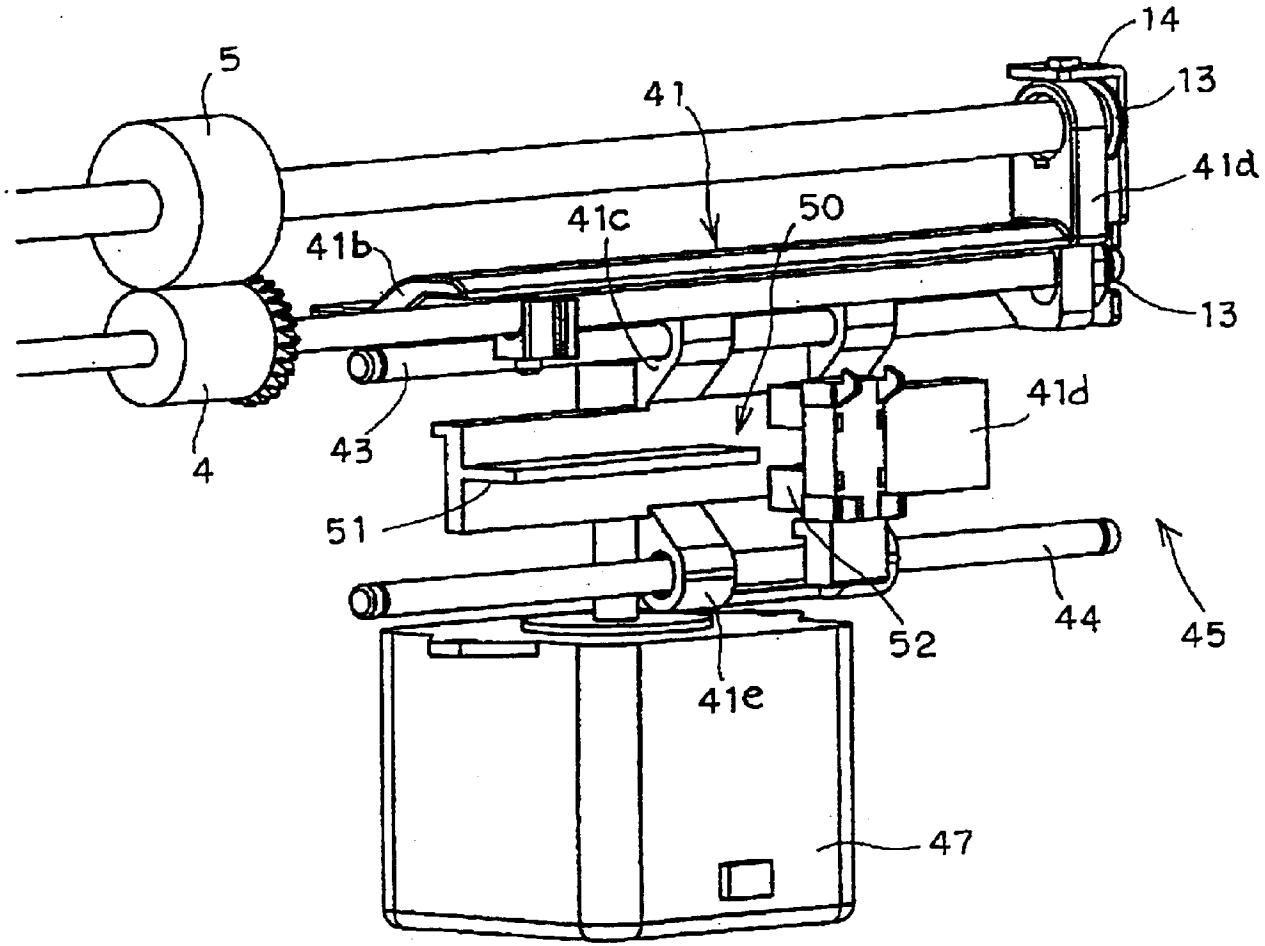
FIG. 9 is a perspective view showing the structure of the HP detection sensor.

As has already been described, the sliding joint plate 41, as shown in FIG. 7 and in FIG. 9 which is one configuring element of the pre-alignment movement means 40 is equipped with the head portion 41*b* forming a guide surface for the sheets, the ear portion 41*a* protrudingly established on the upper surface thereof, the neck portion 41*c* vertically downward in the lower surface of the head portion 41*b*, the torso portion 41*d* that continues widthwise and one leg portion 41*e* formed to approximately the same thickness as the neck portion. Also, the neck portion 41*d* and the leg portion 41*e* are movingly supported in the shaft direction by the two upper and lower guide rods 43 and 44 suspended in the horizontal direction between the side walls 15*a* and 15*c* on the U-shaped stand frame 15.

The support shafts 11 and 12 are rotatingly supported, the leading ends thereof inserted into the ear portion 41*a* on the sliding joint plate 41 and are configured to slide together in the shaft direction, being unitized by the sliding joint plate 41.

Next, the explanation shall focus on the structure of the sliding drive portion 45.

To structure the sliding drive portion 45, the rack 42 is established to the along the support shaft 11 direction torso portion 41*d* on the aforementioned sliding joint plate 41. Also, as a slide support frame, to the inner wall of the stand frame 15 is established the slide motor 47, via the mounting plate 46, the pinion gear 48 mounted to the output shaft of the slide motor 47 mates with the aforementioned rack 42.

The aforementioned configuration of the sliding drive portion 45 transmits drive to the sliding joint plate 41 along the guide rods 43 and 44 by rotating while the pinion gear 48 mates with the rack 42 on the sliding joint plate 41, according to the forward and reverse drive of the slide motor 47 controlled by a control means which is described below and in the end, advances and retracts the support shafts 11 and 12 linked to the sliding joint plate 41 and the paired tray discharge rollers 4 and 5 which are mounted on each of the support shafts.

Viewed differently, the sliding drive portion 45 is composed of the slide motor 47 which is equipped with the sliding joint plate 41 that rotatingly links the supporting shafts 11 and 12, the guide rods 43 and 44 that retractably supports the sliding joint plate 41 in the shaft direction, the stand frame 15 that mountingly supports the guide rods 43 and 44 mounted to the base frame 1*c* and the pinion gear 48 rotatingly mounted on the shaft of the sliding drive portion 45. Furthermore, the sliding joint plate 41 configuration is equipped with the linking portion (the ear portion 41*a*) the supporting portions (neck portion 41*c* and leg portion 41*e*) that comprises the shaft hole for the penetration of the guide rods 43 and 44 and the rack 42 that mates with the pinion gear 48 mounted on the rotating shaft of the slide motor 47.

To the side walls 15*a* and 15*c* on the stand frame 15, which acts as the slide supporting frame is formed the slide opening portion 49 for the rack 42 to enter to the outside of the side walls 15*a* and 15*c* on the stand frame 15 when the pinion gear 48 advances and retracts the sliding joint plate 41.

Figure 8:
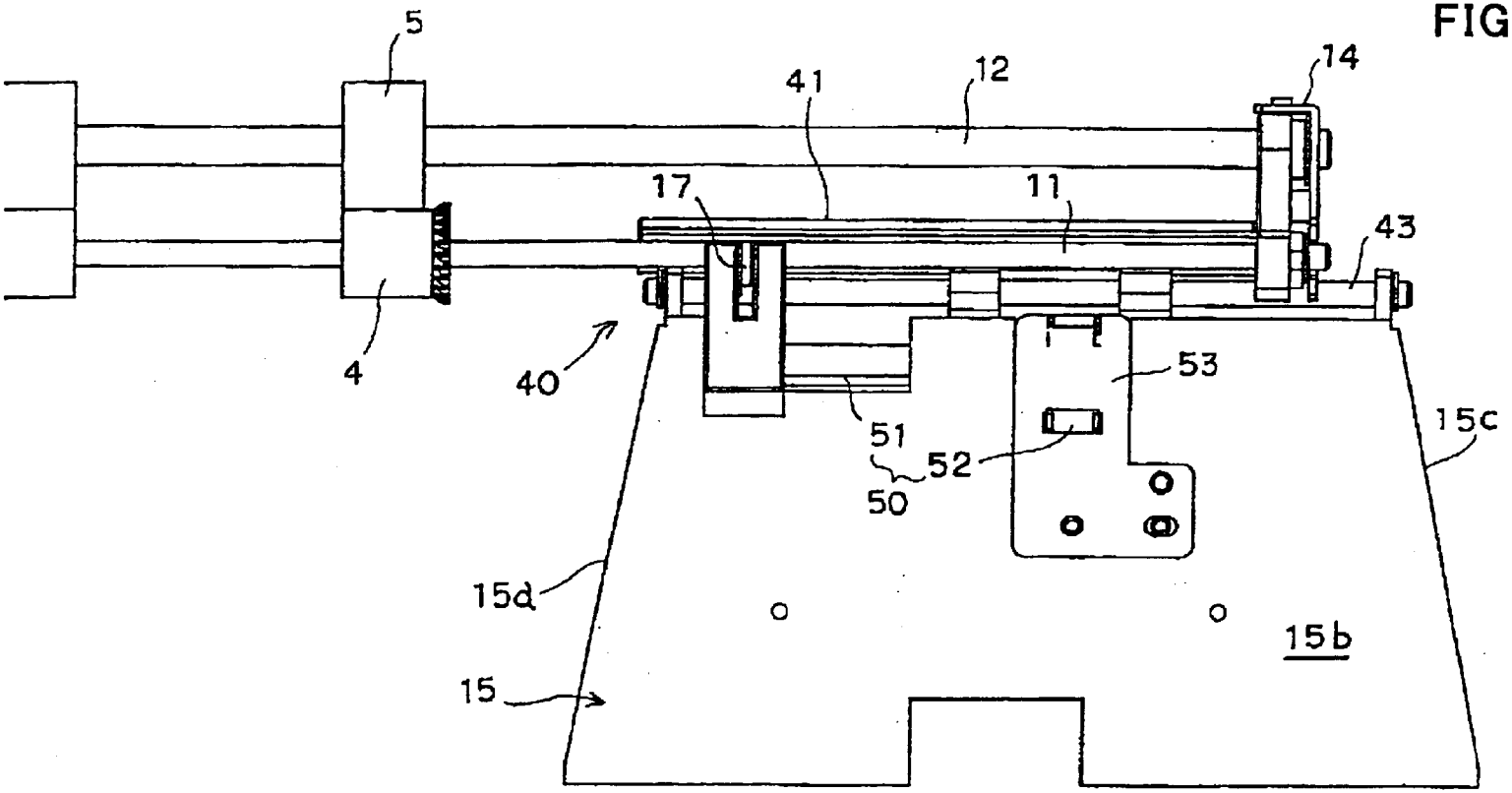
FIG. 8 is a drawing showing the HP detection sensor established in the stand frame on the sheet discharge apparatus.

Further, to the backside of the torso portion 41*d* on the sliding joint plate 41 is established the position detection protrusion 51 that extends with a plate shape in the horizontal direction, as shown in FIG. 9. This position detection protrusion 51 also functions to prevent warping by the bending of the sliding joint plate 41. Also, as shown in FIG. 8 and FIG. 9, to the front wall 15*b* on the stand frame 15, the interrupter 52 (paired optical elements for emitting and receiving) composing the transmissive type optical sensor that cooperate with the position detection protrusion 51 are mounted via the auxiliary plate 53. Also, the transmissive type optical sensor configured by the position detection protrusion 51 and the interrupter 52 (paired optical elements for emitting and receiving) function as the HP detection sensor 50 that detect the home position (HP) of the sliding joint plate 41, namely the support shafts 11 and 12 and turn ON when the position detection protrusion 51 interrupts the light of the interrupter 52 (paired optical elements for emitting and receiving).

In conventional apparatuses, after the paired discharge rollers have nipped the sheet, and have stopped the transport of the sheet, the sheet is discharged after sliding the discharge rollers. However, with this sheet discharge apparatus 1, according to the aforementioned configuration, even while the support shafts 11 and 12 are advancing or retracting in the shaft direction, it is possible to transmit drive from the transport motor 34 being sent via the linking gear 33 to the support shaft 12. That is to say that the advancing and retracting in the shaft direction of the tray discharge roller 5 mounted to the support shaft 12 and the tray discharge roller 4 mounted support shaft 11 and the transport of the sheet by the paired tray discharge rollers 4 and 5 occur simultaneously.

Through this configuration, the alignment process and the sorting process times can be shortened.

The support shaft 11 linked to the support shaft 12 by the sliding joint plate 41 is configured to advance and retract in the shaft direction by the sliding drive portion 45 (FIG. 9) which is described later, penetrating the first slide regulating member 19 shaft hole and the notched opening portion 38 established in the side frame 1*b* while leaving the discharge paddle 20, the movement thereof in the shaft direction regulated by the first slide regulating member 19, between the first slide regulating member 19 and the second bearing member 18.

With this structure, the tray discharge roller 4, which is mounted on the support shaft 11 advances and retracts in the shaft direction along with the tray discharge roller 5 that is the drive roller mounted to the support shaft 12 and simultaneous to the advancing and retracting, the tray discharge roller 4 nips and transports the sheet along with the tray discharge roller 5.

Furthermore, from both sides of the discharge paddle 20, the support shaft 11 is formed in a D shape for at least for the distance for the support shaft to advance and retract, the shaft hole in the discharge paddle 20 also formed into a D shape. With this type of structure, it is possible to transmit the rotation of the support shaft 11 to the discharge paddle 20 positioned between the first slide regulating member 19 and the second bearing member 18 by the sliding drive portion 45 while the support shaft 11 is advancing and retracting in cooperation with the support shaft 12. The sheets are discharged while the paired tray discharge rollers 4 and 5 advance and retract in the shaft direction along with the support shafts 11 and 12, the discharge paddle 20 acts to discharge sheets to a predetermined position between the first slide regulating member 19 and the second bearing member 18.

E. The Alignment Means (Pulling Means) 60 (FIG. 16 to FIG. 19)

The sheet discharge apparatus 1 comprises the alignment means 60 equipped with the belt unit (rotating body) for aligning sheets by securely pulling them to a finishing position on the fixed stacking portion 8. The following shall describe the configuration of the alignment means 60 using FIG. 16 to FIG. 19.

Figure 16:
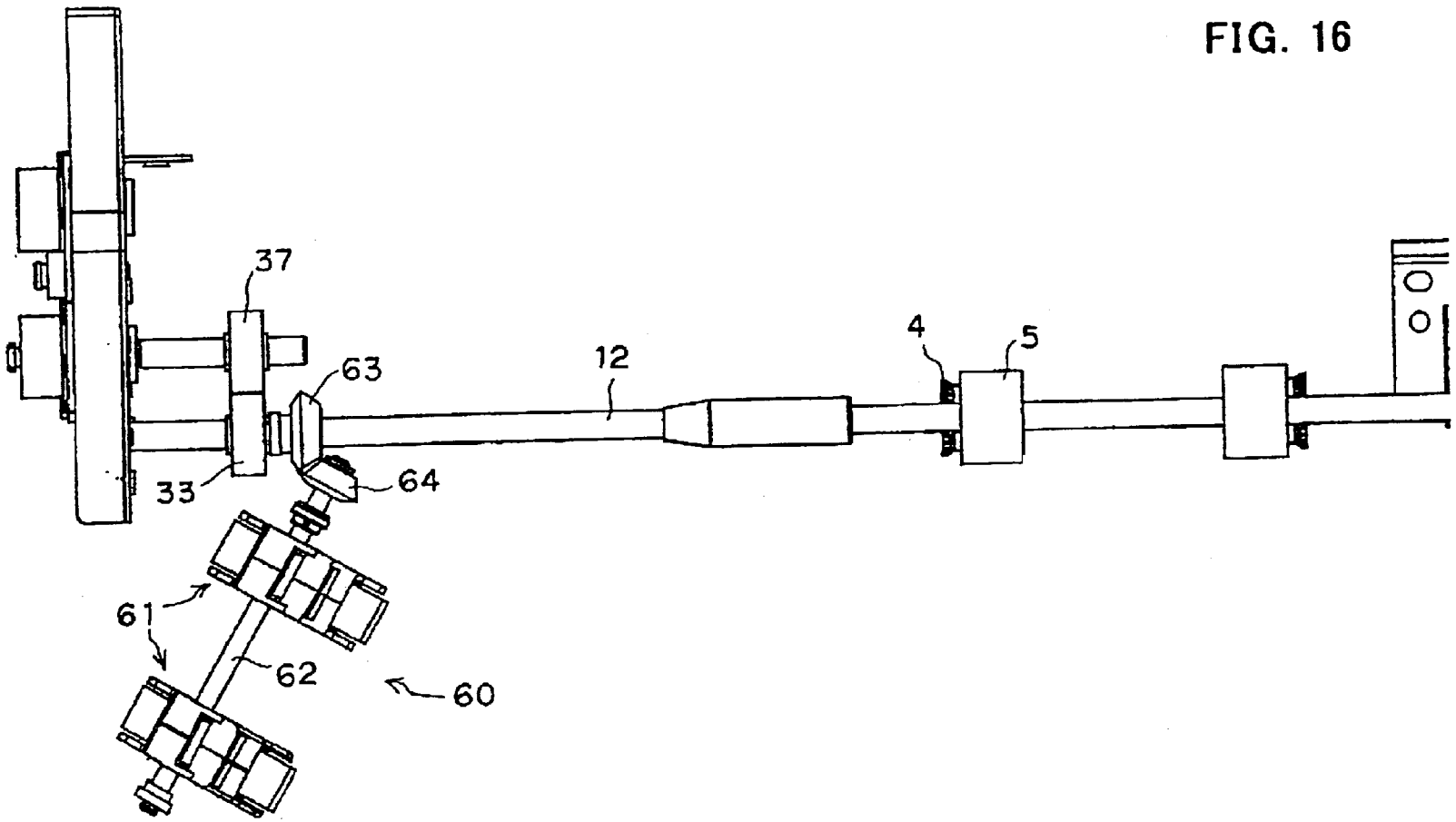
FIG. 16 is a plan view showing the motive power transmission system that rotates the belt unit support shaft added to the sheet discharge apparatus according to the present invention as the alignment means.
Figure 17:
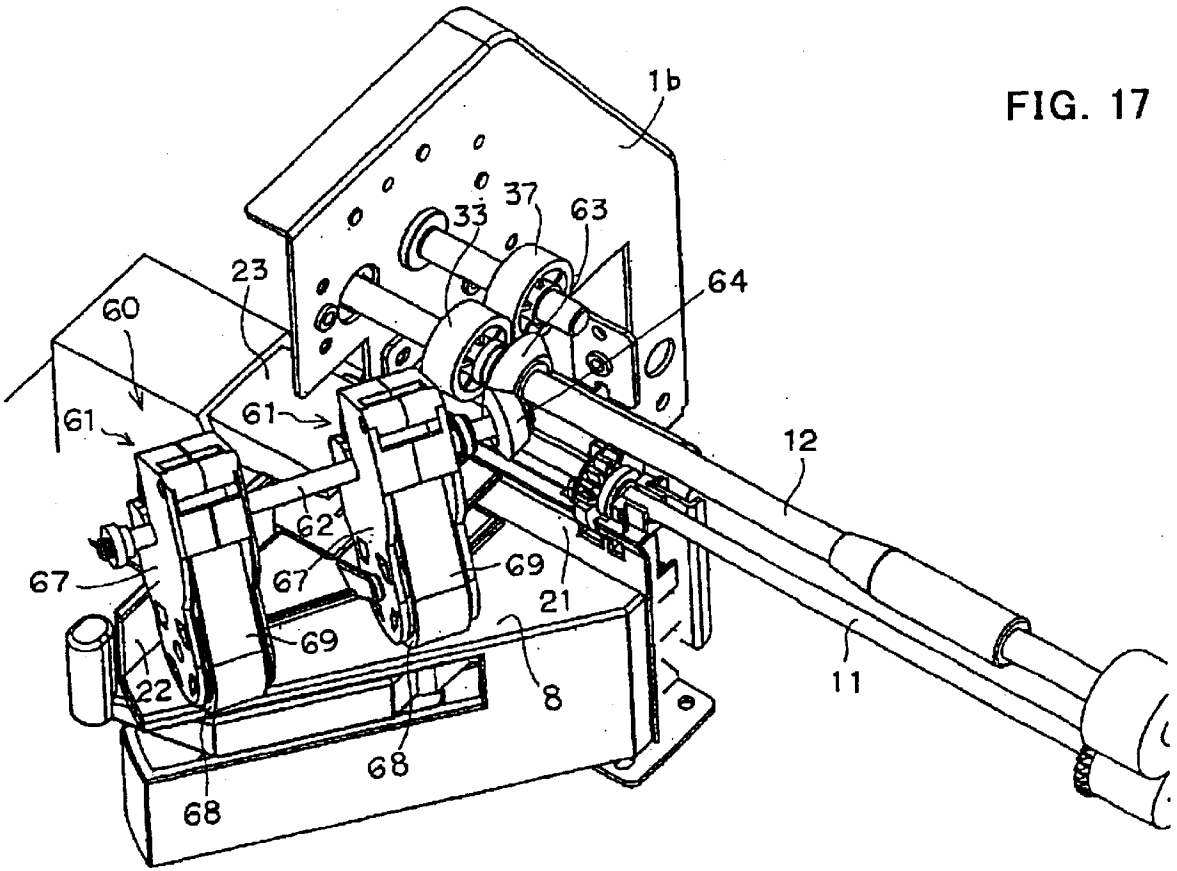
FIG. 17 is a perspective view showing the belt unit portion added to the sheet discharge apparatus according to the present invention as the alignment means.

As shown in FIG. 16 and FIG. 17, the alignment means 60 is composed of the belt unit 61 (rotating body) that sweeps sheets to pull them to the finishing position. According to this embodiment, two units are mounted in serial to the support shaft 62 thereto is applied the rotational drive force from the aforementioned support shaft 12 on the upper side. These two belt units 61 and 61 are operated together by the forward rotation of the support shaft 62 and are configured to urgingly move sheets that are being discharged to one side toward the pre-alignment position (nipping position) or the width direction alignment reference position by the paired tray discharge rollers 4 and 5, for accurate alignment at a finishing position determined by both the abutting plate 21 (the discharge direction alignment reference position) and the positioning plate 22 (the width direction alignment reference position).

Here, in this specification, the "pre-alignment position" is the nipping position of the belt unit 61 and more accurately, it is the furthermost inner position of the nipping position where sheets can be nipped by the belt unit 61.

As has already been described with FIG. 12, the upper support shaft 12 is the drive shaft rotated by the transport motor 34 via the linking gear 33 mated thereto and the force transmission mechanism (35*a* to 35*d* and 37). Furthermore, the movement to the shaft direction of the support shaft 12 of the linking gear 33 mated to the support shaft 12 is regulated by the leg portion 32*a* on the second slide regulating member 32 and the downward wall 31*b* on the second supporting member 31 (see FIG. 10).

Figure 18:
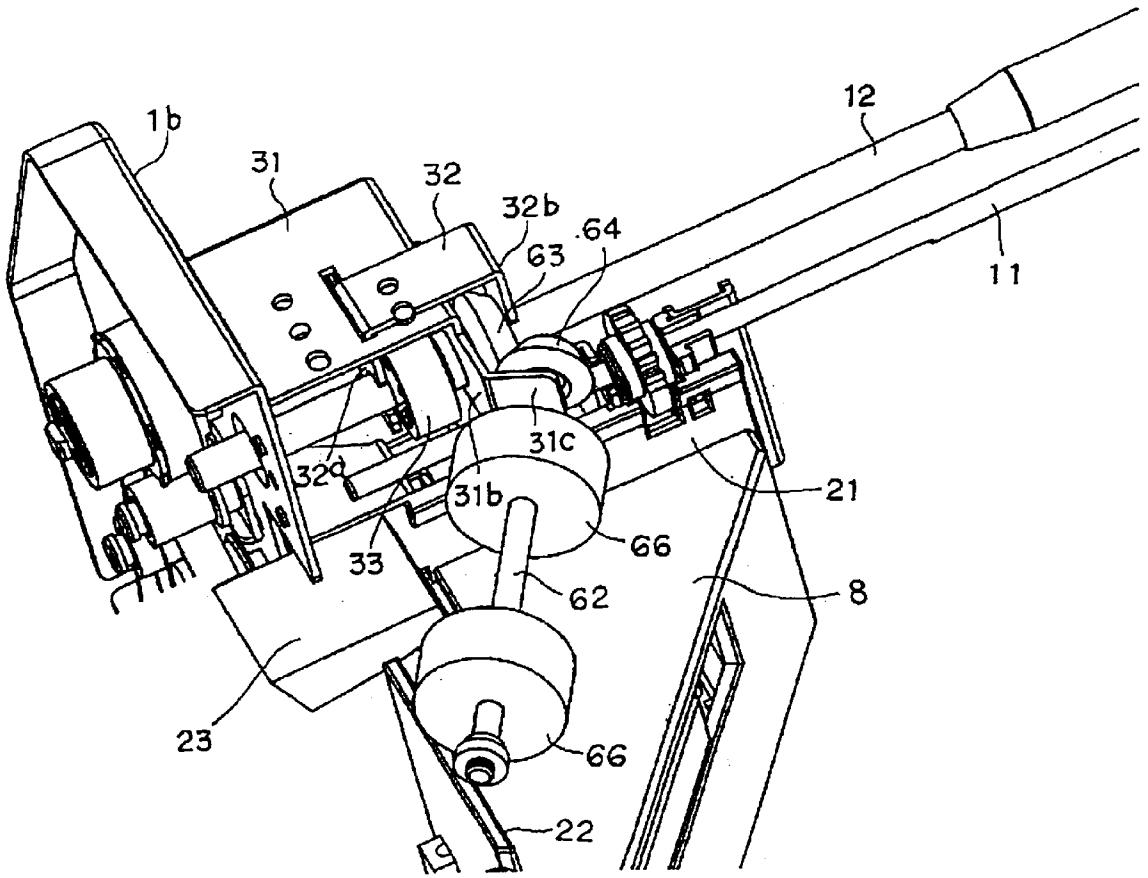
FIG. 18 is a perspective view showing only the drive pulleys of the belt unit of FIG. 17, in which the follower support pulleys and alignment belts are removed.
Figure 19:
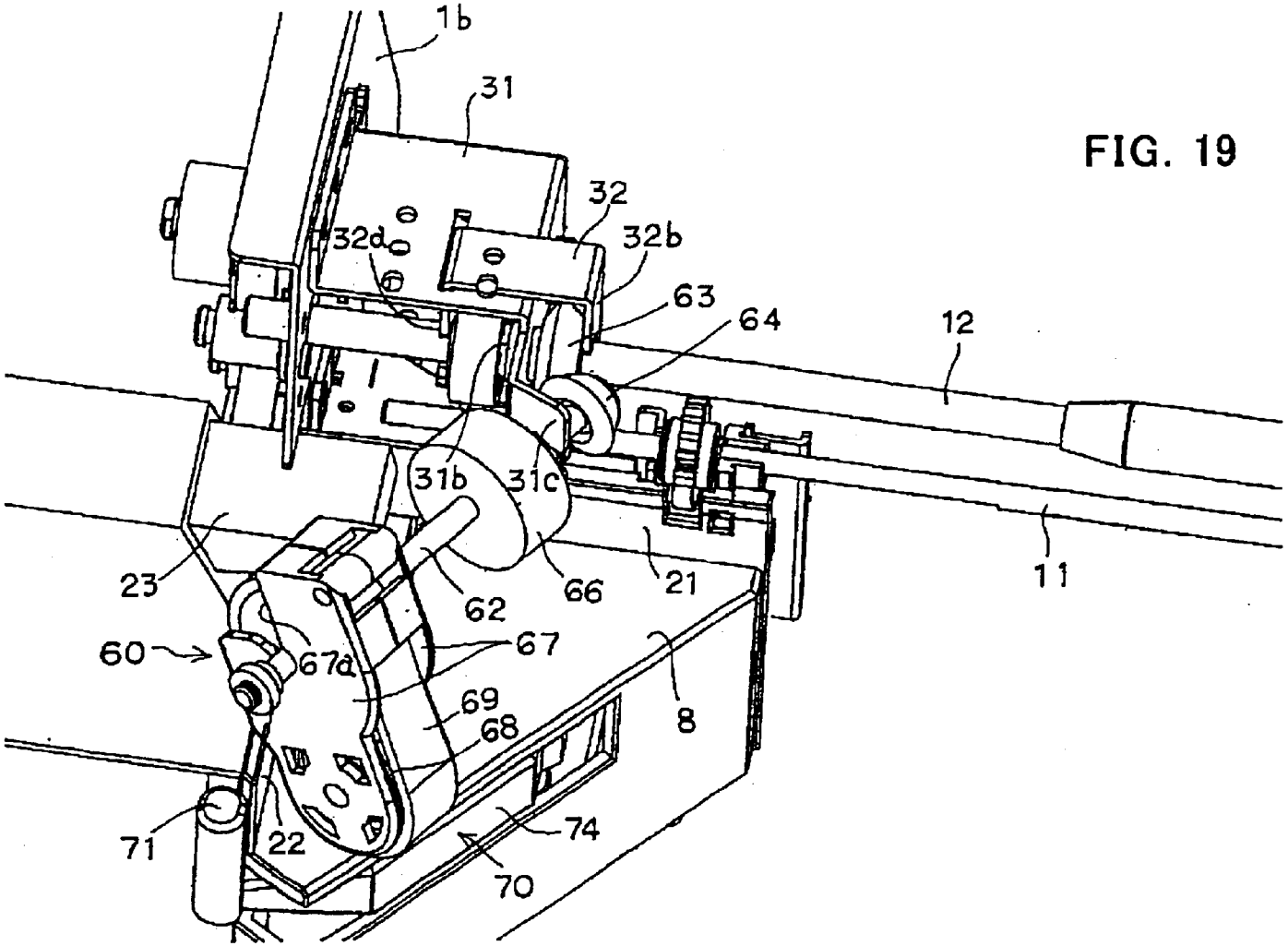
FIG. 19 is a perspective view showing only one drive pulley of the paired belt unit in FIG. 17.

To attain drive force for the belt units 61 from the support shaft 12, in other words, to transmit the rotational drive force from the support shaft 12 to the support shaft 62, as shown in FIG. 16 and in FIG. 17, to the inside in the shaft direction from the linking gear 33 on the support shaft 12 is disposed the first beveled gear 63. The first beveled gear 63, as shown in FIG. 18 and in FIG. 19, is positioned between the downward wall 31*b* on the second supporting member 31 and the leg portion 32*b* on the second slide regulating member 32, the downward wall 31*b* on the second supporting member 31 and the leg portion 32*b* on the second slide regulating member 32 regulating its movement in the support shaft 12 shaft direction.

To that regard, the support shaft 12 penetrates a plurality of members and is retractably mounted in the shaft direction. In other words, the support shaft 12 is retractably disposed in the shaft direction, penetrating the linking gear 33 shaft hole, the shaft holes for the leg portions 32*a* and 32*b* in the second slide regulating member 32 and the shaft hole in the vertical downward wall 31*b* on the second supporting member 31 and the opening portion 39 established in the side frame 1*b*. Furthermore, the support shaft 12 can slide in the shaft direction with the linking gear 33 the movement thereof in the shaft direction regulated by the second slide regulating member 32 leg portion 32*a* and the second supporting member 31 vertical downward wall 31*b* therebetween, by the slide drive portion 45, and can slide in the shaft direction with the first beveled gear 63 the movement thereof in the shaft direction regulated by the second supporting member 31 vertical downward wall 31*b* and the second slide regulating member 32 leg portion 32*b*.

Note that from both sides of the linking gear 33 and the first beveled gear 63 the support shaft 12 is formed in a D shape for at least for the distance for the support shaft to advance and retract, the linking gear 33, the discharge paddle 20 and the first beveled gear 63 also formed into a D shape.

On the other hand, to rotatingly support one end of the support shaft 62 on the belt units 61, as shown in FIG. 12, the L shaped mounting plate 65 is mounted to the side frame 1*b*, and thereto one end of the support shaft 62 is rotatingly supported while the support arm portion 31*c* is established extending from the vertical downward wall 31*b* on the second supporting member 31 to above the fixed stacking portion 8 (the first tray), thereto the other end of the support shaft 62 is rotatingly supported.

To the end of the support arm portion 31*c* on the support shaft 62, the second beveled gear 64 is mounted. The movement to the shaft direction of the second beveled gear 64 is regulated at a predetermined position in the shaft direction of the support shaft 12 and mates with the first beveled gear 63 that is established. This structure receives the drive from the transport motor 34 to rotate the support shaft 62.

One of the two belt units 61 and 61 which are the rotating bodies that compose the alignment means is disposed in a position near the discharge outlet of the support shaft 62, the other is disposed at the support shaft 62, in a position far from the discharge outlet 7. Both of the belt units 61 and 61 have the same configuration, so an explanation of one will be duly representative.

The belt units 61 which are the rotating bodies are composed of the drive pulley 66 (FIG. 18) mounted to the support shaft 62 and rotates along with the support shaft 62, the support plate 67 (FIG. 17) the arranged on both side, the trailing end mounted to the support shaft 62, the follower supporting pulley 68 (FIG. 19) positioned at the fixed stacking portion 8 side with a determined gap with the drive pulley 66 by being rotatingly supported on the leading end of the support plate 67 and the alignment belt 69 (FIG. 19) trained between the drive pulley 66 and the follower support pulley 68.

The support plate 67, as shown in FIG. 19, comprises the notch 67*a* for mating the trailing end thereof to the support shaft 62, the back portion of the notch portion 67*a* detachably mounted to the support shaft 62 with a constant gripping force. Therefore, the support plate 67 revolves as a unit with the support shaft 62 with the constant frictional force, and is configured to slidingly rotate around the support shaft 62 when an external force enough to overcome that constant frictional force is applied.

The support shaft 12 receives the drive of the transport motor 34 (FIG. 12) and when the tray discharge roller 5 rotates in the direction to discharge the sheet S, the support shaft 62 is rotatingly driven from the support shaft 12, to rotate the alignment belt 69 on the belt units 61 to sweep the sheet. The direction of rotation is where the alignment belt 69 intersects the positioning plate 22 and the abutting plate 21, in other words, the rotation in the direction to transport the sheet toward the stapler 23, which is the finishing position. To express this differently, the belt units 61 are arranged in the direction to transport the sheet S toward the stapler 23, which is the finishing position. The support arm portion 31*c* and the support plate 67 position the support shaft 62 so that the belt units 61 and 61 urge sheets discharged by the paired tray discharge rollers 4 and 5 to the abutting plate 21 and the positioning plate 22 on the fixed stacking portion 8, for alignment.

The length from the support shaft 62 on the belt unit 61 is determined so that it is longer than the distance from the support shaft 62 to the top surface of the fixed stacking portion 8 (the first tray). Therefore, when the belt units 61 are revolvingly operated unitized with the support shaft 62 by frictional force, the leading end of the belt units 61 touch the upper surface of the fixed stacking portion 8 (the first tray) from above at an angle and are unable to revolve in any other way. The support plate 67 on the belt units 61 overcome the frictional force and slip with regard to support shaft 62 thereby maintaining the idling position (the activating position where the alignment belt 69 touches the sheet discharged to the storage means) shown in FIG. 19. In other words, by applying only enough external force to overcome the constant frictional force between the support plate 67 and the support shaft 62, the belt unit 61 revolves round the support shaft 62 to enable it to switch to the position (retracted position) which is separated from the sheet discharged to the storage means.

The aforementioned support shaft 62 and support plate 67 function as the support means to movingly support the belt unit 61 which is the rotating body, between the activating position that touches the sheet discharged to the trays 8 and 9 which are the storage means, and the retracted position to separate from the sheet.

In the belt units 61 at the idling position (activating position) described above, the position where the alignment belt 69 touches the sheet is the pre-alignment position (nipping position), described above. As described with FIG. 13 and FIG. 14, when in the operating mode comprising pre-alignment, the sheet is pre-aligned to the pre-alignment position the distance of D1 or d1 (the distance of D4 or d4), and moved to the finishing position the distance of D2 or d2 (D5 or d5) by the belt units 61 to touch the sheet to the abutting plate 21 and the position plate 22 to be aligned. Or, the sheet is moved directly to the finishing position the distance of D3 or d3 (D6 or d6) passing through the pre-alignment position, to touch the abutting plate 21 and the position plate 22 to be aligned.

However, the alignment means (pulling means) 60 operates constantly hanging downward at an angle toward the sheet from the support shaft 62 while the support shaft 12 is rotating in forward so it acts as a load that applies a resistance force to the discharging sheets. For that reason, the effect of reverse transport (pulling in) by the alignment belts 69 push the sheet back, causing the sheet to be arranged obliquely, if the edges of the sheet are not completely discharged toward the fixed stacking portion 8. To eliminate this problem, to the support shaft 11 is established the discharge paddle 20. In other words, the discharge paddle 20 is disposed at a position corresponding to the fixed stacking portion 8 above the support shaft 11 and between the first slide regulating member 19 and the second bearing member 18 mounted to the support member 16, the discharge paddle 20 touches the sheet portion corresponding to fixed stacking portion 8 while rotating to apply an additional discharging force to the aforementioned sheet portion (to forcibly push it out).

F. Sheet Bundle Discharge Means 70 (FIG. 21 to FIG. 23)

As described above, the sheets pass through the prealignment (pre-alignment movement means 40) and this alignment (belt units 61) and are aligned sequentially at the finishing position and are stacked. When that is a sheet bundle having a determined number of sheets, the stapling operation is performed on a single corner by the stapler 23 which is the finishing means. The sheet bundle 90, as shown in FIG. 20, is stacked from the fixed stacking portion 8 (the first tray) to the storage tray 9 (the second tray) therebelow. Because there is a space for stacking and storing sheets between the fixed stacking portion 8 (the first tray) and the storage tray 9 (the second tray) therebelow, in other words, because there is a level, the sheet bundle 90 has the bending portion 90*a* configured by the level bent along that level.

Figure 22:
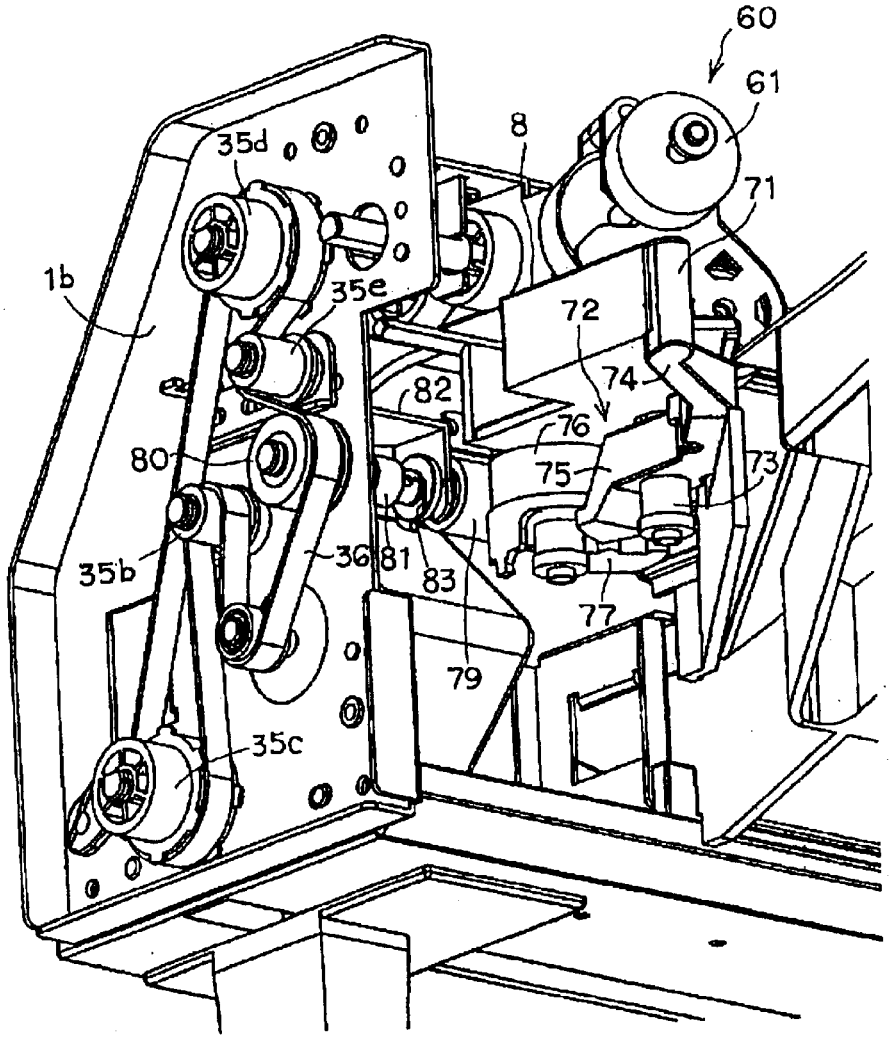
FIG. 22 is a perspective view viewed from below and showing a structure of the sheet bundle discharge means (sheet moving means) in the sheet discharge apparatus according to the present invention.
Figure 23:
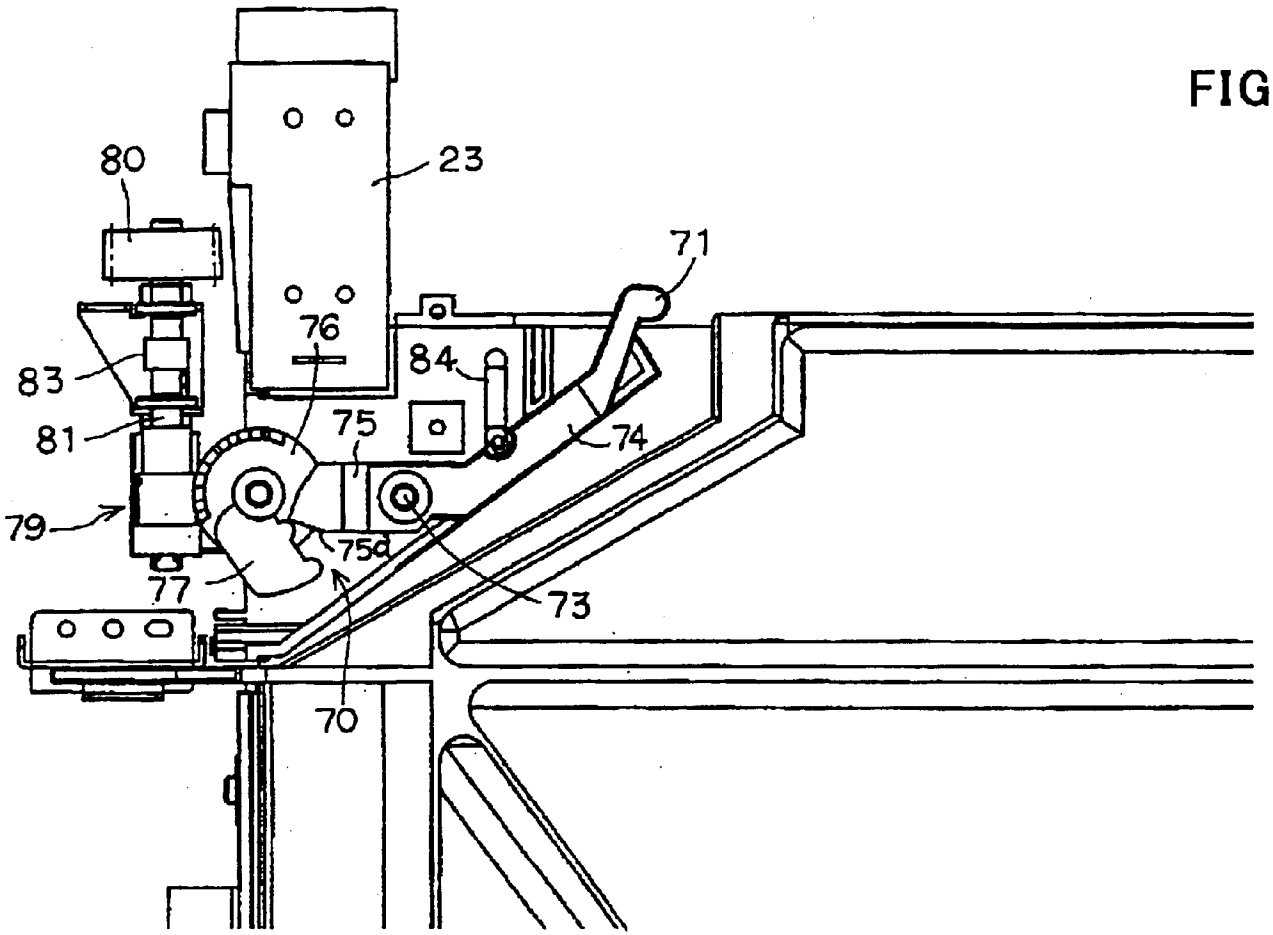
FIG. 23 is a rear view viewed from below and showing the sheet bundle discharge means (sheet moving means) structure in the sheet discharge apparatus according to the present invention.

The sheet bundle discharge means 70 shown in FIG. 21 to FIG. 23 pushes the sheet bundle 90 in this state in the direction traversing the sheet transport direction, from the side and is the means for discharging it to a region outside of the fixed stacking portion 8 (the first tray). The sheet bundle discharge means 70, in this embodiment, is composed of the pushing member 71 that pushes the curved portion 90*a* of the sheet bundle 90 in a direction traversing the direction of transport to move the sheet bundle from the fixed stacking portion 8 (the first tray) to the storage tray 9 (the second tray) therebelow, and the revolution drive mechanism 72 (drive means) that revolves that member.

Arranged to configure the revolution drive mechanism 72 is the rotating lever 74 that rotates around the rotating center 73 in the gap between the fixed stacking portion 8 (the first tray) and the storage tray 9 (the second tray) therebelow, as shown in FIG. 21. To the leading edge of the rotating lever 74 is disposed the aforementioned pushing member 71, extending up and down forming a pushing bar. This rotating lever 74 is equipped with the contact arm 75 formed with the contact portion 75*a* on the leading end thereof (FIG. 23), extending obliquely downward in the opposite side from the rotating center shaft 73.

To rotatingly drive the aforementioned rotating lever 74, to the circumference of the shaft 78 is rotatingly mounted near the contact portion 75*a*, the worm-wheel 76 having a cam equipped with the cam 77 to act on the contact portion 75*a*. When the worm-wheel 76 with the cam reciprocally rotates around the shaft 78, which is described below, the cam 77 touches the aforementioned contact portion 75*a* and revolves it a determined amount. Also, the worm gear 79 that mates with the worm wheel 76 with the cam is established on the side opposite to the side where the aforementioned rotating lever 76 exists. This worm gear 79 is established on the shaft 81 which is established on the single direction clutched pulley 80, the single direction clutched pulley 80 mounted to form the gear train composing the rotating drive mechanism for the aforementioned support shaft 11 and support shaft 12.

Specifically, as shown in FIG. 22, the shaft 81 on the single direction clutched pulley 80 is rotatingly mounted to the side frame 1*b* and the support plate 82 and the relay pulley 35*e* is rotatingly mounted to the side frame 1*b*. Then, the output from the transport motor 34 is transmitted from the motor pulley 35*a* mounted on that output shaft via the timing belt 36 to the relay pulley 35*b*, the transport roller pulley 35*c* and the follower pulley 35*d*, and the force transmission mechanism is configured to transmit to the unidirectional clutched pulley 80 via the relay pulley 35*e*. To the shaft 81 that is the output side of the single direction clutched pulley 80 the aforementioned worm gear 79 is mated and through the action of the single direction clutch, the single direction clutch shuts off when the transport motor 34 is rotated in forward causing the single direction clutched pulley 80 to idle. The other way, when the transport motor 34 is rotated in reverse, the single direction clutch turns on transmitting rotational drive force to the shaft 81 to rotate the worm gear 79.

Figure 24A:
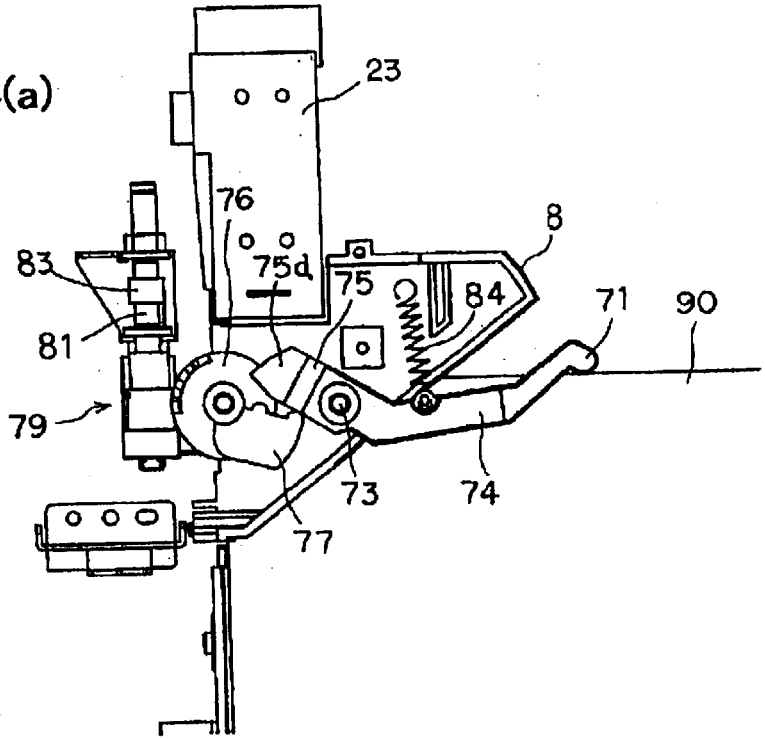
FIGS. 24(*a*) and 24(*b*) are rear views showing the operation of the sheet bundle discharge means (sheet moving means) in the sheet discharge apparatus according to the present invention; wherein FIG. 24(*a*) shows a state in the middle of discharge, and FIG. 24(*b*) shows a state immediately after discharge is completed.
Figure 24B:
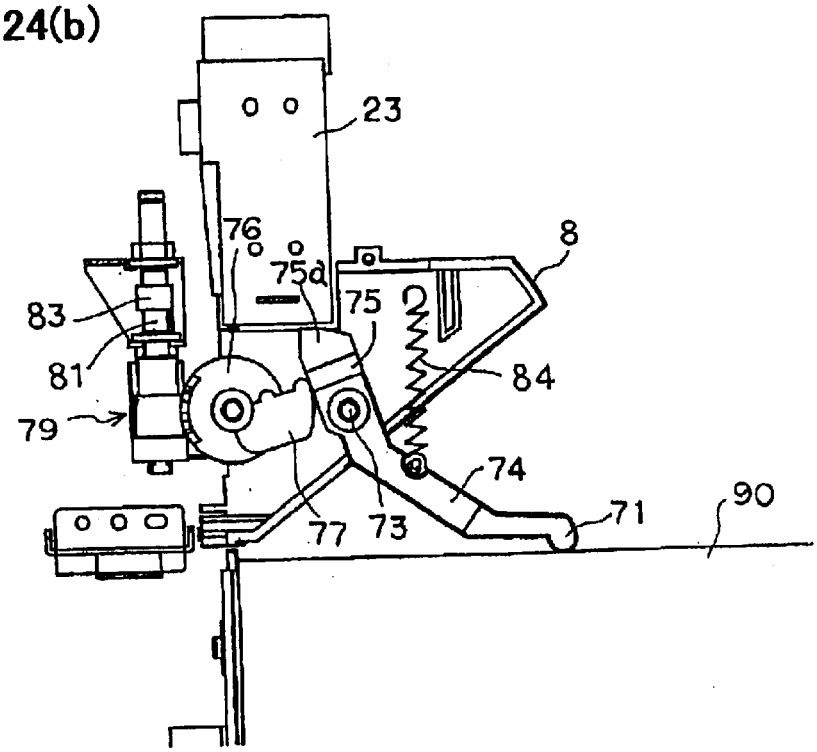

When the worm gear 79 rotates, the worm wheel 76 with the cam mated thereto rotates. The cam 77 in the state shown in FIG. 23, unitized thereto the worm wheel, touches and presses the contact portion 75*a* on the contact arm 75 to rotate the rotating lever 74 around the rotating center shaft 73 as depicted in FIGS. 24(*a*) and 24(*b*). This revolves the pushing member 71 around the rotating center shaft 73 as depicted in FIGS. 24(*a*) and 24(*b*) to push the sheet bundle 90 to outside of the region of the fixed stacking portion 8 (the first tray).

Figure 25C:
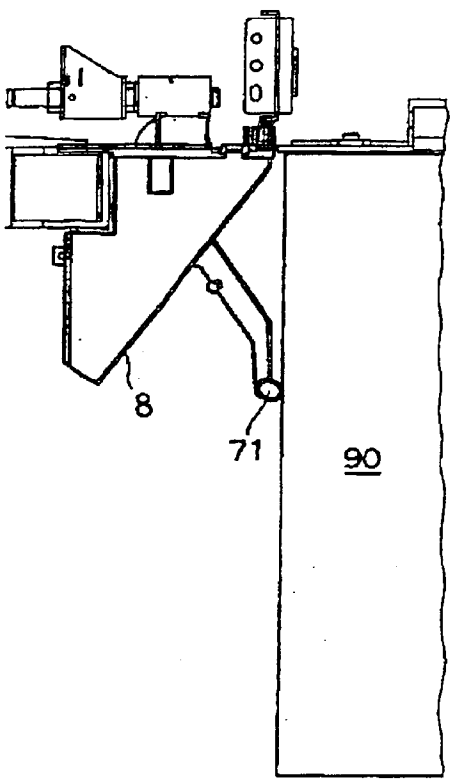
FIGS. 25(*a*), 25(*b*) and 25(*c*) are partial plan views showing the operation of the sheet bundle discharge means (sheet moving means) in the sheet discharge apparatus according to the present invention, wherein FIG. 25(*a*) shows a state prior to discharge, FIG. 25(*b*) shows a state in the middle of the discharge, and FIG. 25(*c*) shows a state immediately after the discharge is completed.
Figure 25B:
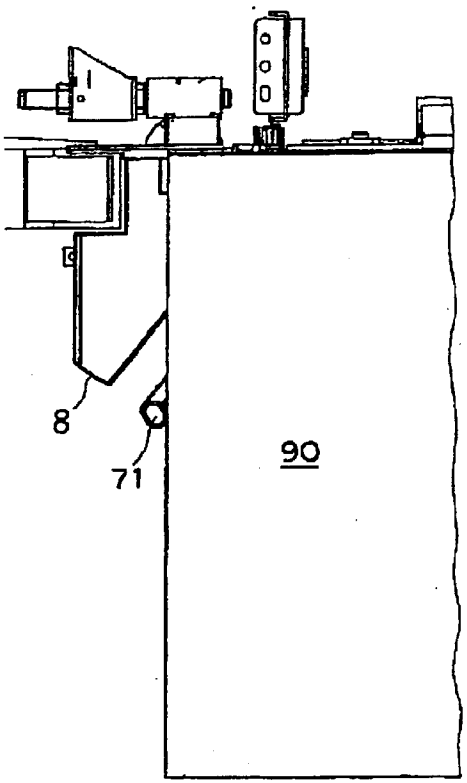
Figure 25A:
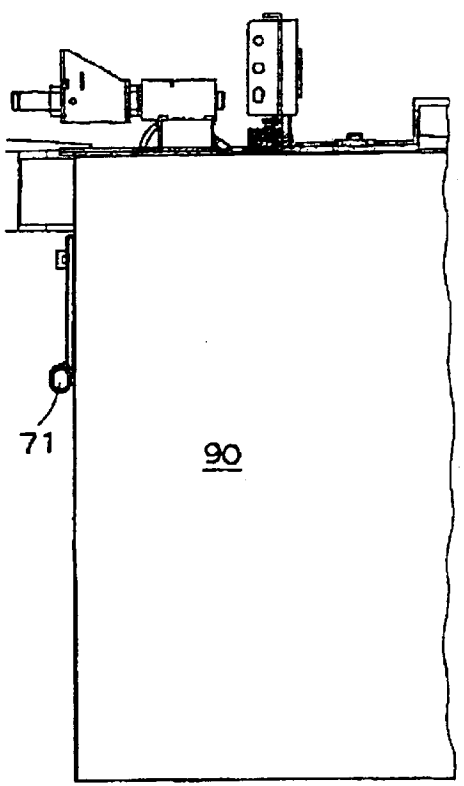

In this way, the sheet bundle 90, as shown in FIG. 25(*a*) to FIG. 25(*c*), is discharged from the fixed stacking portion 8 (the first tray) to the top of the storage tray 9 (the second tray).

When the sheet bundle 90 reaches the position shown in FIG. 24(*b*) pushed out of the region of the fixed stacking portion 8 (the first tray), the direction of rotation of the transport motor 34 switches from reverse rotation to forward rotation, the shaft 81 becomes free and the recovery spring 83 mounted to the shaft 81 returns the worm wheel 76 with the cam to the state depicted in FIG. 23. The rotating lever 74 also returns to the state depicted in FIG. 23 by the action of the recovery spring 84.

The mechanism (revolving drive mechanism 72) to revolving drive the pushing bar 72 is configured by the aforementioned elements 74 to 84.

G. Rotating Bodies Support Means 160 (FIGS. 26(*a*), 26(*b*) to FIG. 27)

The following shall explain the support means 160 that supports the belt unit 61 which is the rotating body switchable between an activating position and a retracted position. FIGS. 26(*a*) and 26(*b*) show a portion of support means 160.

The support means 160 is configured to include the solenoid 161 which is the switching drive source to rotate the support shaft 62, the support plates 67 and the support plates. Specifically, to the support plates 67 is established the lever 67*b* in a direction forming an 'L' shape in the lines connecting with the support shaft 62, the following support pulley 68 (FIG. 19) and the support shaft 68*a*, the leading tip is connected thereto with the solenoid 161 plunger 162 via the spring 163.

The support plates 67, as described above, revolve as a unit with the support shaft 62 with a constant frictional force, and are configured to slidingly rotate around the support shaft 62 when an external force enough to overcome that constant frictional force is applied. The length from the support shaft 62 on the belt unit 61 is determined so that it is longer than the distance from the support shaft 62 to the top surface of the fixed stacking portion 8 (the first tray).

Therefore, when the belt units 61 revolve as a unit with the support shaft 62, the leading edge of the belt units 61 touches the surface of the fixed stacking portion 8 (the first tray) obliquely from above to be at the activating position shown in FIG. 26(*a*). The belt units 61 support plate 67 overcomes the frictional force to slide on the support shaft 62 without being able to revolve any lower than that, to maintain the idle position shown in FIG. 19 (the activating position where the alignment belt 69 touches the sheets discharged to the storage means).

On the other hand, when the solenoid 161 is urged, the plunger 162 is retracted are displayed the lever 67*b* is pulled via the spring 163 so that belt units (rotating bodies) rotate around the support shaft 62 which is the rotating pivot point set higher than the discharge means. In other words, by applying from the solenoid 161 only enough external force to overcome the constant frictional force between the support plate 67 and the support shaft 62, the belt unit 61 revolves round the support shaft 62 to switch it to the position (retracted position) shown in FIG. 26(*b*) which is separated a constant distance above the sheet discharged to the fixed stacking portion θ (the first tray) which is the storage means.

With regard to control, before the trailing edge of the sheet in the discharge direction is discharged to the sheet storage means (the fixed stacking portion 8 and the storage tray 9), specifically, before the sheet is completely discharged to the sheet storage means, if the sheet has reached the aforementioned predetermined position on the storage means (the position where the rotating bodies act to align the sheets), the belt units (rotating bodies) 61 are switched from the activating position shown in FIG. (26(*a*) to the retracted position (separated position) separated from the sheets, shown in FIG. 26(*b*). This control means controls the aforementioned support means 160.

Also, as shown in FIG. 47, when moving the belt units 61 from the activating position to the retracted position, and the belt units 61 rotatingly move around the support shaft 62 in an arc, the sheet S that is touching the alignment belt 69 is pushed, but because the alignment belt is rotating in the alignment direction, the sheet S is swept in. The sheet S is not pushed, but held in its aligned state.

Then, subsequently, the belt unit rotating body) 61 moves again to the touching position (activating position shown in FIG. 26(*a*)) to move the sheet again to the positioning plate (alignment reference member) 22 to ensure accurate sheet alignment.

In this way, the belt units 61 can be appropriately retracted so the sheets are not hindered by the existence of the belt units and they can enter the region where they can be swept by the belt units 61. Through this, it is possible to handle an expanded number of sheets (stacking height) to stack to be aligned and expanded sheet types, to ensure the freedom of processing modes with which to handle them.

Note that as shown in FIG. 27, the support means 61 is controlled to hold the belt units (rotating bodies) 61 at the retracted position also when the sheet bundle 90 that has been stapled by the stapler (finishing means) 23 is discharged by being pushed by the pushing member 71 on the sheet bundle discharge means 70.

H Example of Control (FIG. 28 to FIG. 33)

FIG. 28 is a drawing showing the sheet being discharged while moving horizontally toward the rotating bodies for alignment. In the cases shown in the drawing, the edge of the sheet moved horizontally only the distance of D4 while simultaneously being discharged along the center reference, is carried to the pre-alignment position (X1) and then the A4 portrait size sheet S is moved (alignment movement) to the alignment position (X2) where the positioning plate 22 exists, by the belt units (rotating bodies) 61. In this embodiment, as shown in FIG. 29(*a*), when the sheet bundle 90 on the storage means is stacked exceeding a fixed stacking height, in other words, exceeding the support shaft 68*a* on the follower support pulley 68 (equivalent to the rotating center when the rotating bodies are composed of friction rollers), the maximum capacity of the action to sweep the sheets using the belt units (rotating bodies) 61 is exceeded thereby disallowing the sheets Sa that are being moved horizontally to be swept. In such a case, as shown in FIG. 29(*b*), the belt units (rotating bodies) 61 are switched to the retracted position under the control of the support means 160.

FIG. 30 shows the status of sheet discharge when the sheet discharge reference is a rear reference (the reference using the left hand edge of the sheets when looking at the discharge outlet from the downstream direction of discharge as the reference) and is set to match the pre-alignment position X1 (pre-alignment position discharge). When using this pre-alignment position discharge, the sheets only discharged by the paired tray discharge rollers 4 and 5 which are the discharge means 6, and the sheets are not offset (moved horizontally), to pass through the pre-alignment position X1 which is the predetermined position (the position where the rotating bodies act to align). At this time, the belt units (rotating bodies) 61 exist as obstacles in the path where sheets are discharged and hinder the discharge of sheets, as can be seen in FIG. 31(*a*). In such a case, as shown in FIG. 31(*b*), the belt units (rotating bodies) 61 are switched to the retracted position under the control of the support means 160.

FIG. 32 shows the maximum size that can be handled for the sheet S, A3 size, and because it is big, its edge matches the pre-alignment position X1 (the predetermined position where the rotating bodies act to align the sheets). In this case, the sheets are only discharged by the paired tray discharge rollers 4 and 5 which are the discharge means 6, and the sheets are not offset (moved horizontally), to pass through the pre-alignment position X1 which is the determined position. At this time, the belt units 61 exist as obstacles in the path where sheets are discharged and hinder the discharge of sheets, as can be seen in FIG. 33(*a*). In such a case, as shown in FIG. 33(*b*), the belt units 61 are switched to the retracted position under the control of the support means 160.

Including the above described cases, when the sheet reaches the predetermined position on the storage means before the trailing edge of the sheet in the discharge direction is discharged to the storage means, the control means switches the rotating bodies to the retracted position to control so that they do not obstruct the discharge of the aforementioned sheets.

I. Control Means (a) Control Apparatus (FIG. 34)

The following shall describe the control means.

FIG. 34 is a block diagram showing the circuit configuration of the sheet discharge apparatus according to this embodiment. 111 is the micro-computer CPU (central processing unit) composing this control unit, 112 is the ROM (read only memory) storing the program data that the CPU 111 uses to control each part, 113 is the RAM (random access memory) disposed with memory for the CPU 111 to use to process data, 114 I/O port, and 115 is the interface (I/F) for the host computer 116 on the image forming apparatus main unit 100 to connect externally using a communications line.

The aforementioned CPU 111, ROM 112, RAM 113, I/O port 114 and interface 115 are electrically connected via a bus line 117.

To the aforementioned I/O port 114 are connected the HP detection sensor 50 that detects the home position of the support shafts 11 and 12 on the paired tray discharge rollers 4 and 5, the inlet sensor 131 (FIG. 2) established at the paper path 2 inlet that is the transport path and the discharge sensor 134 established on the discharge outlet 7 on the paper path 2. The discharge sensor 134 is a supplementary disposed sensor and can be omitted.

The inlet sensor 131 and the discharge sensor 134 are composed of the light source arranged sandwiching the sheet transport path and the transmissive type light sensor composed from the light receptor elements, turning ON when the sheet passes therethrough and interrupts the light. In other words, the sheet S passes through the paper path 2 between the upper guide 2*a* and the lower guide 2*b* in the processing apparatus 1 and is discharged, the detection sensors composed of the light source arranged to sandwich the paper path 2 and the light receptor elements determine whether or not the sheet S has passed therethrough, for each sheet, to perform detection for passing sheets and for retained sheets. Also, it is detected whether or not the sheet S has been discharged or not by the detection sensor composed of the light source arranged sandwiching the sheet discharge outlet 7 downstream of the paired tray discharge rollers 4 and 5 and the light receptor elements.

Still further, to the I/O port 114, are connected the motor driver 118 on the transport motor 34 that rotatingly drives the support shafts 11 and 12 on the paired tray discharge rollers 4 and 5 according to the data from the host computer 116, and the motor driver 119 on the slide motor 47 that moves the support shafts 11 and 12 on the paired tray discharge rollers 4 and 5 in the shaft direction according to the data from the host computer 116.

The aforementioned transport motor 34 and slide motor 47 are configured, for example, by stepping motors. The CPU 111 controls drive by supplying the determined pulse motor control signals to the motors 34 and 47.

The output from the inlet sensor 131, the discharge sensor 134 and the HP detection sensor 50 are applied to the finisher apparatus' microcomputer CPU 111. Also, information from operating means composed of the start key, the sorting sheet count setting keys, the total recording count setting keys and the ten-keys from the image forming apparatus main unit 100 are input to the finisher apparatus micro-computer CPU 111.

(b) Control Apparatus (FIG. 35 to FIG. 41)

The aforementioned CPU 111 controls the pre-alignment, the sheet finishing apparatus and the sheet bundle discharge process shown in FIG. 35 to FIG. 41 based on a program.

At step ST1 in FIG. 35, first it checks whether there has been a staple request instruction (step ST1). If there has been a staple request instruction, it checks whether the sheet area edge is at the front side from the pre-alignment position (step ST2). If YES, then it enters the stapling mode at the pre-alignment position X1 while discharging the sheets.

(i) When the sheet area edge is on the front side from the pre-alignment position (FIG. 35 to FIG. 36).

First, is a check whether the alignment caterpillar (belt units 61) is at the activating position (the position to touch the sheet) (step ST3). Here, the belt units 61, after discharging a sheet bundle, are at the retracted position for the first sheet of the next sheet bundle, and at the activating position for the second sheet and beyond. Initially, the solenoid 161 is off and it returns the alignment caterpillar (belt units 61) from the retracted position (FIG. 26(*a*)) to the activating position (FIG. 26(*b*)) (step ST7) and proceeds to step ST5. Also, for the second sheet and beyond, it proceeds to the step ST5 while at the retracted position (step ST4). Then, at step ST5, it starts the transport motor 34 in the forward direction (step ST5).

Note that in the mode (FIG. 37) which does not staple, describe next, and the rear reference pre-alignment position discharge mode (FIG. 38 to FIG. 39) these move to the retracted position at a comparatively high speed, but in the mode that carries the sheet to the pre-alignment position X1 while discharging, the time stopped at the activating position is extended to ensure a longer time to push the sheets that have been discharged.

Continuing on, it waits until the trailing edge of a sheet exits the inlet sensor 131 (step ST6). This is to prevent accidents by moving the support shaft 11 and the support shaft 12 in the shaft direction and sliding the sheet regardless of whether or not the trailing edge of the sheet is nipped by the paired transport rollers 3.

If the trailing edge of the sheet exits the inlet sensor 131, the solenoid 161 turns on to switch the alignment caterpillar (belt units 61) from the activating position to the retracted position (step ST7). This is to free the trailing edge of the sheets and to return the pre-alignment to the retracted position before pre-alignment starts. However, as another example of control, the timing for the sheet to come to the pre-alignment position X1 according to each sheet size and the discharge reference is different, it is possible for the alignment caterpillar (belt units 61) to stay at the activating position until just before it arrives to the pre-alignment position X1.

(i-1) Alignment Process (FIG. 40)

As described above, if the trailing edge of a sheet exits the inlet sensor 131 and the alignment caterpillar (belt units 61) switches to the retracted position, the alignment process using the pre-alignment means is performed (step ST8).

FIG. 40 shows the sub-routine of the alignment process of the pre-alignment means. In the alignment process using the pre-alignment means shown in FIG. 40, based on the data and the instructions from the image forming apparatus main unit 100, it checks the discharge destination and determines that it is one of the following: The discharge destination is either in a "straight position," an "offset positioned (jog position)," or a "staple position" (step ST61).

If the discharge destination is a "straight position," nothing happens and the flow shown in FIG. 40 is exited (step ST62).

If the discharge destination is the "offset positioned (jog position)," it determines the position offset 20 mm to the right (−20 mm) with the required alignment speed of 150 mm/s and from the HP as the required alignment printing position to ensure the determined offset movement amount or the jog movement amount (step ST63) and begins the alignment process by moving to that position (step ST64).

If the discharge destination is the "staple position," it checks whether the sheet is being discharged to either the "center reference," the "front reference (side reference discharge)," or the "rear reference (side reference discharge)" from the image forming apparatus main unit 100, based on the data and instructions received from the image forming apparatus main unit 100 (step ST65). Here, looking downstream in the discharge direction at the discharge outlet, using the right side edge of the sheet is called the "front reference" and using the left side edge of the sheet is called the "rear reference."

The distance of movement (required alignment position) from each discharge reference to the pre-alignment position is calculated, that distance and the required alignment speed (step ST66 to ST72) are determined and the alignment process to move to that position is started (step ST64).

In other words, for the "center reference," the distance of movement to the pre-alignment position is calculated (step ST66) according to the width of the sheets (for example, D1 and D4 shown in FIG. 13), the results are set as the required alignment position, and it determines 150/s as the required alignment speed (step ST67) and begins the alignment process to move to that position (step ST64).

Also, for the "front reference (side reference discharge)," if discharging with the right edge of the tray as the reference, namely that shown in FIG. 14, the distance of movement to the pre-alignment position is calculated (step ST68) according to the width of the sheets (for example, d7 and d9 shown in FIG. 14), the results are set as the required alignment position, and it determines 150/s as the required alignment speed (step ST69) and begins the alignment process to move to that position (step ST64).

Next, for the "rear reference (side reference discharge) (step ST70), if discharging with the left side of the tray, namely that shown in FIG. 14, the distance of movement (distance $\alpha$) of the support shafts 11 and 12 on this finisher apparatus for the sheet is already known, so the constant distance of movement $\alpha$ mm from the discharge reference is set as the required alignment position (step ST71), and it determines 50 mm/s as the required alignment position and required alignment speed (step ST72) and begins the alignment process to move to that position (step ST64).

In the alignment process, sheets are actually moved only the aforementioned calculated distance, and the alignment process starts by sending them to the pre-processing position (step ST64). Through this, sheets are transported and discharged by the rotation of the paired tray discharge rollers 4 and 5, and movement thereof in the shaft direction is executed by the aforementioned alignment process, which pushes sheets to the nipping position of the belt units 61 which are the pre-alignment position.

After completing the alignment process (FIG. 40) using the pre-alignment means, the program returns to step ST8 in FIG. 35 and proceeds to step ST9. At this point, the trailing edge of the sheet has exited the inlet sensor 131 (see step ST3), so it sets "alignment roller retracting pulses" which are the number of pulse required for the sheet to exit the paired tray discharge rollers 4 and 5 (step ST9). It waits for the alignment roller retracting pulses to be counted up (step ST10).

The "alignment roller retracting pulse" set at the aforementioned step ST9 is calculated up, and if it is verified that the paired tray discharge rollers 4 and 5 have been exited (step ST10), the program proceeds to the step ST11 shown in FIG. 36, the solenoid 161 is turned off and the belt unit 61 returns from the retracted position (FIG. 26(*a*)) to the activating position (FIG. 26(*b*)) (step ST7). This moves the belt units 61 to the activating position to touch the sheet when the trailing edge of the sheet is nipped (while being discharged) in the sheet discharge means 6.

Continuing, the belt units 61 are set corresponding to the sheet size (step ST12) for the pulling pulse (the pulse for the alignment caterpillar to pull) which is the feed amount necessary to feed the sheet horizontally to the positioning plate (alignment reference member) 22.

The reason for changing the pulling pulse set according to the sheet size is to increase pulling amount for large sheets because sliding occurs between the alignment caterpillar and the sheets due to the large size sheets and their weight. Specifically, large sized sheets have larger loads when being moved by the belt units 61 (due to the weight of the sheets) thereby increasing the amount of slipping that occurs between the belt units 61 and the sheets. As the size of the sheets increase, the drive pulse of the belt units 61 is adjusted considering that transfer errors can occur more easily due to the slipping.

Then, if the pulling pulse of the belt units 61 (the pulling pulse of the alignment caterpillar) calculation is done (step ST13), it determines whether or not that that is the final sheet (step ST14). If it is the final sheet, it holds the belt units 61 at the activating position shown in FIG. 26(*a*) (step ST15) and returns to step ST2 of FIG. 35.

Regarding the next sheet, the aforementioned step ST2 to step ST13 are repeated to sequentially stack sheets in the sheet storage means which is composed of the fixed stacking portion 8 and the storage tray 9. The set number of sheets are thus stacked.

At step ST14, it is affirmatively decided that that sheet is the final sheet. The sheet bundle is stapled, then the sheet bundle is discharged. It is presumed that the belt units 61 are held at the activating position shown in FIG. 26(*a*) (step ST16) and first, the transport motor 34 is stopped (step ST17). Then, it calls up the staple and bundle discharge process (step ST18).

(i-2) Staple and Bundle Discharge Processes (FIG. 41)

FIG. 41 shows the flow for the staple/sheet bundle discharge processing. In the staple and sheet bundle discharge processes, first the staple motor (not shown in the drawings) is rotated in forward to execute the finishing process (step ST81). At the finishing process, the stapler 23, which is the finishing means, staples the sheet bundle and stapling is completed (step ST82).

When the staple operation is completed, the belt units 61 are switched and held at the retracted position as in FIG. 27 (step ST83). At step ST84, the direction of rotation of the transport motor 84 that had until then been forward, switches to reverse rotation, and the transport motor 34 is started set at 50 mm/s for the transport request speed, and to 140 mm as the transport supply distance (step ST85).

Because the transport motor 34 is rotated in reverse, the one-way clutched pulley 80 on the aforementioned sheet bundle discharge means 70 turns on and the rotational force of the transport motor 34 is transmitted, the worm gear 79 rotates the worm wheel 76 with the cam, unitized thereto the cam 77 presses the contact portion 75*a* on the contact arm 75 to rotate the rotating lever 74 around the circumference of the rotating center shaft 73. This revolves the pushing member 71 around the rotating center shaft 73 as depicted in FIGS. 25(*a*) to 25(*c*) to push the sheet bundle 90 to outside of the region of the fixed stacking portion 8 (the first tray). The sheet bundle 90 is discharged from the fixed stacking portion 8 (the first tray) to the top of the storage tray 9 (the second tray).

When the sheet bundle discharge process is completed, it returns from step ST86 in FIG. 41 to step ST18 in FIG. 36, proceeds then to step ST19 to complete the series of operations from discharging, pre-alignment, alignment, finishing (stapling) to sheet bundle discharge.

(ii) When There is No Stapling (FIG. 37)

If there is no stapling request instruction in the decision at the aforementioned step 1, it proceeds to the flow shown in FIG. 37.

This mode does not staple, so alignment is unnecessary. Therefore, the alignment caterpillar (belt units 61) is uniformly moved to the retracted position. In this case, regarding sheets that are discharged that touch the pre-alignment position (because of a wide sheet size or the alignment reference) even when not being aligned by the pulley, the caterpillar is moved to the retracted position earlier than the staple mode so that alignment caterpillar (belt units 61) does not touch the sheets.

First, it checks whether the sheet area edge is at the front side from the pre-alignment position (step ST31). If it is no, there is a check whether the alignment caterpillar (belt units 61) is at the activating position (the position to touch the sheet) (step ST32). If the alignment caterpillar (belt units 61) is at the activating position, it switches to the retracted position (step ST33) and forward rotates the transport motor (step ST34).

However, in the decision at step ST31, if the sheet rear edge is at the front side from the pre-alignment position, the alignment caterpillar (belt units 61) will not interfere, so it omits these steps ST32 to ST33 and immediately forward rotates the transport motor (step ST34).

It waits for the sheet discharge to be completed (step ST35). If the discharge of the sheets is completed, it verifies whether that was the final sheet (step ST36). If it is no, it returns to step ST34. It continues forward rotating, the transport motor, waits for the discharge of the final sheet, then quits the process.

(iii) When the sheet area edge is not on the front side from the pre-alignment position (FIG. 38 to FIG. 39).

First, is a check whether the alignment caterpillar (belt units 61) is at the activating position (the position to touch the sheet) (step ST41). If the belt units 61 are still at the activating position, it is necessary to switch them to the retracted position. First, the transport motor 34 is started in the forward rotating direction (step ST42) and at the point the leading edge of the sheet arrives at the inlet sensor 131 (step ST43), the belt units 61 are immediately switched from the activating position to the retracted position (step ST44). In this way, the reason why it is switched to the retracted position at the point where the leading edge of the sheet is detected, is to securely return it to the retracted position before the leading edge of the sheet touches alignment caterpillar (belt units 61).

Continuing on, it waits until the trailing edge of a sheet exits the inlet sensor .131 (step ST45). If the trailing edge of the sheet has exited the inlet sensor 131, it sets "alignment roller retracting pulses" which are the number of pulse required for the sheet to exit the paired tray discharge rollers 4 and 5 (step ST46). It waits for the alignment roller retracting pulses to be counted up (step ST47).

The "alignment roller retracting pulse" set at the aforementioned step ST9 is calculated up, and if it is verified that the paired tray discharge rollers 4 and 5 have been exited (step ST47), the program proceeds to the step ST48 shown in FIG. 39, the solenoid 161 is turned off and the belt unit 61 returns from the retracted position (FIG. 26(*a*)) to the activating position (FIG. 26(*b*)) (step ST48).

Continuing, the belt units 61 are set corresponding to the sheet size (step ST49) for the pulling pulse (the pulse for the alignment caterpillar to pull) which is the feed amount necessary to feed the sheet horizontally to the positioning plate (alignment reference member) 22. The reason for changing the pulling pulse set according to the sheet size is to increase pulling amount for large sheets because sliding occurs between the alignment caterpillar and the sheets due to the large size sheets and their weight.

Then, if the pulling pulse of the belt units 61 (the pulling pulse of the alignment caterpillar) calculation is done (step ST50), it determines whether or not that that is the final sheet (step ST51). If it is the final sheet, it holds the belt units 61 at the activating position shown in FIG. 26(*a*) (step ST52) and returns to step ST41 of FIG. 38.

Regarding the next sheet, the aforementioned step ST41 to step ST50 are repeated to sequentially stack sheets in the sheet storage means which is composed of the fixed stacking portion 8 and the storage tray 9. The set number of sheets are thus stacked.

At step ST51, it is affirmatively decided that that sheet is the final sheet. The sheet bundle is stapled, then the sheet bundle is discharged. It is presumed that the belt units 61 are held at the activating position shown in FIG. 26(*a*) (step ST53) and first, the transport motor 34 is stopped (step ST54). Then, it calls up the staple and bundle discharge process (step ST55).

The stapling and sheet bundle discharge processes are performed (FIG. 41) and when completed, it returns from step ST86 in FIG. 41 to step ST55 in FIG. 39, proceeds then to step ST56 to complete the series of operations from discharging, pre-alignment, alignment, finishing (stapling) to sheet bundle discharge.

In conventional apparatuses, after sheets are completely discharged to the tray, either the alignment plate or the alignment bar pushes the sheets to move them to the alignment reference member to align the sheets, while with the controlled pre-alignment in this embodiment of the sheet discharge apparatus 1, the sorting means positioned further upstream in the direction of sheet transport than the belt units 61 and 61 that are the alignment means, can align the sheet SS using pre-alignment with high precision and high efficiency without having to add a dedicated alignment means.

Because the advancing and retracting of the slide joint plate 41 of the sorting means, the support shafts 11 and 12 and the paired tray discharge rollers 4 and 5 mounted on each shaft and the sheet transport by the paired tray discharge rollers 4 and 5 are performed in parallel simultaneously, the alignment operation to the pre-alignment position can be started while the sheet SS is being discharged by the paired tray discharge rollers 4 and 5 further increasing alignment efficiency.

Note that the sheet discharge apparatus according to the present invention can be configured as a sheet discharge apparatus or can be configured as a simple sheet discharge apparatus that is not equipped with these, or can be configured as an image forming apparatus equipped with the sheet discharge apparatus.

(c) Other Controls (FIG. 43 to FIG. 46)

The aforementioned CPU 111 controls the pre-alignment, the sheet finishing apparatus and the sheet bundle discharge process shown in FIG. 43 to FIG. 46 based on a program.

At step ST101 in FIG. 43 it checks whether there is a staple instruction (step ST101), and if there is, it starts forward rotation of the staple motor (step ST102).

Continuing on, it waits until the trailing edge of a sheet exits the inlet sensor 131 (step ST103). This is to prevent accidents by moving the support shaft 11 and the support shaft 12 in the shaft direction and sliding the sheet regardless of whether or not the trailing edge of the sheet is nipped by the paired transport rollers 3.

If the trailing edge of a sheet exits the inlet sensor 131, the alignment process using the pre-alignment means is performed (step ST104).

FIG. 46 shows using the sub-routine of the alignment process of the pre-alignment means. The alignment process of the pre-alignment means in FIG. 46, based on the data and the instructions from the image forming apparatus main unit 100, checks the discharge destination and determines that it is one of the following: The discharge destination is either in a "straight position," an "offset positioned (jog position)," or a "staple position" (step ST121).

If the discharge destination is a "straight position," nothing happens and the flow shown in FIG. 46 is exited (step ST122).

If the discharge destination is the "offset positioned (jog position)," it determines the position offset 20 mm to the right (−20 mm) with the required alignment speed of 150 mm/s and from the HP as the required alignment printing position to ensure the determined offset movement amount or the jog movement amount (step ST123) and begins the alignment process by moving to that position (step ST124).

If the discharge destination is the "staple position," it checks whether the sheet is being discharged to either the "center reference," the "front reference (side reference discharge)," or the "rear reference (side reference discharge)" from the image forming apparatus main unit 100, based on the data and instructions received from the image forming apparatus main unit 100 (step ST125). The distance of movement (required alignment position) from each discharge reference to the pre-alignment position is calculated, that distance and the required alignment speed (step ST126 to ST132) are determined and the alignment process to move to that position is started (step ST124).

In other words, for the "center reference," the distance of movement to the pre-alignment position is calculated (step ST126) according to the width of the sheets (for example, D1 and D4 shown in FIG. 13), the results are set as the required alignment position, and it determines 150/s as the required alignment speed (step ST127) and begins the alignment process to move to that position (step ST124).

In other words, for the "front reference (side reference discharge)," the distance of movement to the pre-alignment position is calculated (step ST128) according to the width of the sheets (for example, d1 and d4 shown in FIG. 14), the results are set as the required alignment position, and it determines 150/s as the required alignment speed (step ST129) and begins the alignment process to move to that position (step ST124).

Next, for the "rear reference (side reference discharge) (step ST130), if discharging with the right side of the tray, namely that shown in FIG. 14, the distance of movement (distance $\alpha$) of the support shafts 11 and 12 on this finisher apparatus for the sheet is already known, so the constant distance of movement $\alpha$ mm from the discharge reference is set as the required alignment position (step ST131), and it determines 50 mm/s as the required alignment position and required alignment speed (step ST132) and begins the alignment process to move to that position (step ST124).

In the alignment process, sheets are actually moved only the aforementioned calculated distance, and the alignment process starts by sending them to the pre-processing position (step ST124). Through this, sheets are transported and discharged by the rotation of the paired tray discharge rollers 4 and 5, and movement thereof in the shaft direction is executed by the aforementioned alignment process, which pushes sheets to the nipping position of the belt units 61 which are the pre-alignment position.

After completing the alignment process (FIG. 46) using the pre-alignment means, the program returns to step ST104 in FIG. 43 and proceeds to step ST105. At this point, the trailing edge of the sheet has exited the inlet sensor 131 (see step ST103), so it sets "alignment roller retracting pulses" which are the number of pulse required for the sheet to exit the paired tray discharge rollers 4 and 5 (step ST105). It waits for the alignment roller retracting pulses to be counted up (step ST106).

The "alignment roller retracting pulse" set at the aforementioned step ST105 is calculated up, and if it is verified that the paired tray discharge rollers 4 and 5 have been exited (step ST106), the solenoid 161 is turned off and the belt unit 61 returns from the retracted position (FIG. 26(*a*)) to the activating position (FIG. 26(*b*)) (step ST107). This moves the belt units 61 to the activating position to touch the sheet when the trailing edge of the sheet is nipped (while being discharged) in the sheet discharge means 6.

Next, it waits for the sheet to be discharged to the sheet storage means composed of the fixed stacking portion 8 (the first tray) and the storage tray 9 (the second tray) (step ST108). If the discharge of the sheets to the sheet storage means is completed, the pulling pulse (the alignment caterpillar pulling pulse) of the belt units 61 are set corresponding to the sheet size (step ST109) which is the feed amount necessary to feed the sheet the determined number of times (in this case two times) to the positioning plate (alignment reference member) 22.

The reason for changing the pulling pulse set according to the sheet size is to increase pulling amount for large sheets because sliding occurs between the alignment caterpillar and the sheets due to the large size sheets and their weight. Specifically, large sized sheets have larger loads when being moved by the belt units 61 (due to the weight of the sheets) thereby increasing the amount of slipping that occurs between the belt units 61 and the sheets. As the size of the sheets increase, the drive pulse of the belt units 61 is adjusted considering that transfer errors can occur more easily due to the slipping.

By setting the alignment caterpillar pulling pulse to correspond to the sheet size as described above, the belt units 61 feed for that pulse count (sweeping operation). At the position of the determined value of pulses (in this case, the cyclical position determined by for every pulse value) determined in advance as the switching point within the belt units 61 pulling pulse range (the alignment caterpillar pulling pulse), the belt units 61 is moved at least twice from the retracted position to the activating position. In this example, it changes from the activating position to the retracted position shown in FIG. 26(*a*) once, then returns to the activating position shown in FIG. 26(*b*) again. (step ST110)

For that reason, even if the sheet is fed obliquely and hits the positioning plate 22 which is the alignment reference member or the abutting plate 32 and even if the leading edge is curled, the restriction on the sheet is freed by the movement of the belt unit 61 to the retracted position, the curl is alleviated. The belt unit 61 returns to the activating position and moves the sheet to the alignment reference member again to ensure an accurate sheet alignment.

Then, it proceeds to FIG. 45, and if the pulling pulse of the belt units 61 (the pulling pulse of the alignment caterpillar) calculation is done (step ST111), it determines whether or not that that is the final sheet (step ST112). If it is the final sheet, it switches the belt units 61 to the retracted position shown in FIG. 26(*b*) (step ST113) and returns to step ST102 of FIGS. 29(*a*) and 29(*b*).

Regarding the next sheet as well, the aforementioned step ST102 to step ST111 are repeated to sequentially stack sheets in the sheet storage means which is composed of the fixed stacking portion 8 and the storage tray 9. The set number of sheets are thus stacked.

At step ST112, it is affirmatively decided that that sheet is the final sheet. The sheet bundle is stapled, then the sheet bundle is discharged. It is presumed that the belt units 61 are held at the retracted position shown in FIG. 27(*a*) (step ST114) and the transport motor 34 is stopped (step ST115). Then, it calls up the staple and bundle discharge process (step ST116).

The flow for stapling and the bundle discharge process is the same as shown in FIG. 41.

The sheet discharge apparatus or the image forming apparatus according to the present invention is equipped with a discharge means for discharging sheets, a storage means for receiving sheets discharged by that, a alignment reference member for aligning at least one side of sheets discharged to that, rotating bodies that contact sheets at a predetermined position on the aforementioned storage means to move sheets to the aforementioned alignment reference member, a support means that movingly supports the aforementioned rotating bodies between an activating position that contacts sheets at the aforementioned predetermined position and a retracted position that separates from sheets at the aforementioned determined position, and a control means to control the aforementioned support means to position the aforementioned rotating bodies at the aforementioned retracted position when the aforementioned sheet reaches the aforementioned determined location before the trailing edge of sheets in the discharge direction is discharged to the aforementioned storage means by the aforementioned discharge means.

For that reason, according to the present invention, in the embodiment wherein while sheets are moved horizontally toward an alignment rotating body they are discharged, or the embodiment wherein sheets are discharged with the sheet edge aligned at a predetermined position (the position where the rotating bodies align the sheets), or the embodiment wherein the sheet edge touches the predetermined position (the position where the rotating bodies align the sheets) because the sheets are large sized, and those sheets that are touching thereto are discharged, the rotating bodies are switched to the retracted position so that the rotating bodies do obstruct the discharge of the sheets. Through this, it is possible to handle an expanded number of sheets (stacking height) to stack to be aligned, to allow the freedom of the processing modes with which to handle them or to allow the handling of expanded sheet types.

The sheet discharge apparatus or the image forming apparatus of the present invention is configured to move the rotating bodies at least two times from the retracted position to the activating position when the rotating bodies are moving the sheets discharged to the storage means to the alignment reference member, specifically, the rotating bodies such as rollers, paddles or belts are configured to move the sheets to the alignment reference member while repeatedly separating and touching the sheets. For that reason, even if the sheet is fed obliquely and hits the alignment reference member or the leading edge is curled, the restriction on the sheet is freed by the separation of the rotating bodies to the retracted position, to allow the sheet leading edge to slide down under its own weight and to become flat, thereby alleviated the curl. Therefore, when the rotating body moves to the activating position again, the sheet is moved to the alignment reference member properly to ensure an accurate sheet alignment.

What we claim is:

1. A sheet discharge apparatus comprising:

discharge means for discharging sheets;

storage means for receiving the sheets discharged from the discharge means;

alignment reference member for aligning at least one side of the sheets discharged to the storage means;

rotating bodies for touching the sheets at a predetermined position on the storage means and for moving the sheets to the aforementioned alignment reference member;

support means for supporting the rotating bodies to move freely between an activating position to contact the sheets at the predetermined position and a retracted position away from the sheets at the predetermined position; and control means for controlling the support means to position the rotating bodies at the retracted position when the sheets reach the predetermined position before a trailing edge of the sheets in a sheet discharge direction is discharged to the storage means.

2. A sheet discharge apparatus according to claim 1, wherein said support means supports the rotating bodies to move freely between the activating position to contact the sheets at the predetermined position and the retracted position away from the sheets at the predetermined position around a rotating pivot established above the discharge means.

3. A sheet discharge apparatus according to claim 1, wherein said control means controls the support means to position the rotating bodies at the alignment position at least until the sheets reach the predetermined position.

4. A sheet discharge apparatus according to claim 1, wherein said control means controls the support means to hold the rotating bodies at the retracted position until the trailing edge of the sheet is discharged from the discharge means.

5. A sheet discharge apparatus according to claim 1, further comprising offset means for offsetting a position of the sheets relative to the rotating bodies to move the sheets discharged to the storage means by the discharge means to the predetermined position.

6. A sheet discharge apparatus according to claim 1, wherein said control means controls the support means to move the rotating bodies at least twice from the retracted position to the activating position when the rotating bodies move the sheets discharged to the storage means to the alignment reference member.

7. A sheet discharge apparatus according to claim 1, further comprising finishing means for finishing the sheets on the storage means after the rotating bodies completely moves a final sheet discharged to the storage means to the alignment reference member.

8. A sheet discharge apparatus according to claim 1, wherein said control means controls the support means to hold the rotating bodies at the activating position for a final sheet discharged to the storage means until the finishing means completely finishes.

9. A sheet discharge apparatus according to claim 1, wherein said rotating bodies is set to move the sheets by a distance longer than a distance from the rotating bodies to the alignment reference member.

10. A sheet discharge apparatus according to claim 1, wherein said control means controls the rotating bodies to move the sheets by a variable distance according to a size of the sheets.

11. A sheet discharge apparatus according to claim 7, further comprising sheet bundle discharge means for discharging the sheets finished by the finishing means from the finishing means, said control means controlling the support means to hold the rotating bodies at the retracted position when the sheet bundle discharge means discharges the sheets finished by the finishing means from the finishing means.

12. A sheet discharge apparatus according to claim 1, wherein said control means rotates the rotating bodies in a direction that the sheets move to the alignment reference member while the rotating bodies move from the activating position to the retracted position.

13. A sheet discharge apparatus according to claim 1, wherein said control means rotates the rotating bodies in an alignment direction when the rotating bodies are retracted while the storage means receives the sheets discharged from the discharge means.

14. A sheet discharge apparatus according to claim 1, wherein said control means rotates the rotating bodies in an alignment direction when the rotating bodies are retracted while the storage means receives the sheets discharged from the discharge means, and rotates the rotating bodies in a direction that the sheets move to the alignment reference member while the rotating bodies move from the activating position to the retracted position.

15. A sheet discharge apparatus according to claim 1, wherein control means rotates the rotating bodies in a direction that the sheets move to the alignment reference member while the rotating bodies move at least from the retracted position to the activating position, and move again to the retracted position.

16. An image forming apparatus comprising the sheet discharge apparatus according to claim 1, sheet feeding means for feeding the sheets one at a time, and image forming means for forming desired images on the sheets fed by the sheet feeding means.

* * * * *